US005837120A

United States Patent [19]

Forand et al.

[11] Patent Number: 5,837,120

[45] Date of Patent: Nov. 17, 1998

[54] METHOD AND APPARATUS FOR ELECTROCHEMICAL PROCESSING

[75] Inventors: James L. Forand; Harold M. Keeney, both of Whitehall, Pa.; Erik S. Vananglen, Gheens, La.

[73] Assignee: Electroplating Technologies, Inc., Coplay, Pa.

[21] Appl. No.: 574,416

[22] Filed: Dec. 15, 1995

Related U.S. Application Data

[63] Continuation-in-part of Ser. No. 316,530, Sep. 30, 1994, Pat. No. 5,476,578, which is a continuation-in-part of Ser. No. 533,500, Sep. 25, 1995, Pat. No. 5,679,233.

[51] Int. Cl.[6] ..... C25D 17/00

[52] U.S. Cl. ..... 205/93; 205/138; 204/207; 204/289

[58] Field of Search ..... 204/209, 207, 204/206, 203, 217, 215, 289; 205/93, 129, 130, 138

[56] References Cited

U.S. PATENT DOCUMENTS

| | | | |
|---|---|---|---|
| 3,619,383 | 11/1971 | Eisner | 205/93 |
| 4,039,398 | 8/1977 | Furuya | 205/145 |
| 4,406,761 | 9/1983 | Shimogori | 205/709 |
| 4,652,346 | 3/1987 | Polan | 205/111 |
| 4,828,653 | 5/1989 | Traini | 205/96 |
| 5,476,578 | 12/1995 | Forand | 204/207 |

*Primary Examiner*—John Niebling
*Assistant Examiner*—Brendan Mee
*Attorney, Agent, or Firm*—Charles A. Wilkinson

[57] ABSTRACT

A continuous strip is electrochemically processed in an electrolytic processing bath using either a thin flexible or resilient dielectric wiping blade or an open web, plastic mesh to wipe bubbles of gas from the surface, sever dendritic material, if such is present, and to remove a surface layer of partially depleted electrolytic solution, replacing with fresh solution and to stabilize strip portions extending between support rolls. The resilient dielectric wiper blade is preferably used with perforated anodes which allow fresh electrolytic solution to flow into the space between the anodes and the strip surface after being expelled by passage of the strip past the wiping blade. The wiping blades may also be angularly oriented with respect to the strip to increase the wiping effectiveness. The open web, plastic mesh wiper is particularly effective in providing the best spacing between the strip and the electrodes to prevent arcing and also prevents catching of any filter cloth used over the electrodes upon the strip. Electrodes in a circular configuration may be used.

61 Claims, 28 Drawing Sheets

Fig. 19
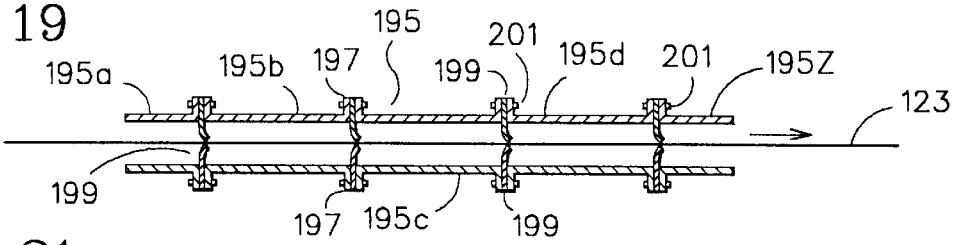
Fig. 21
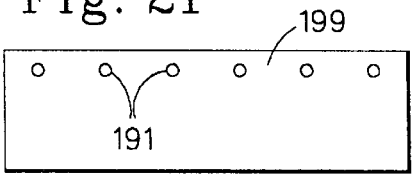
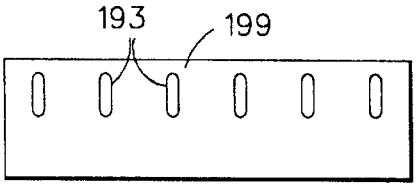
Fig. 22
Fig. 20
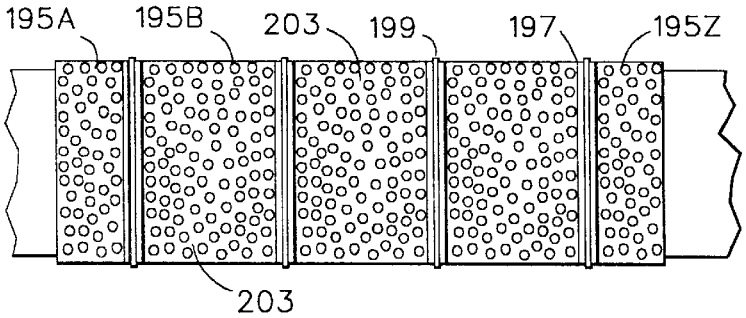
Fig. 23
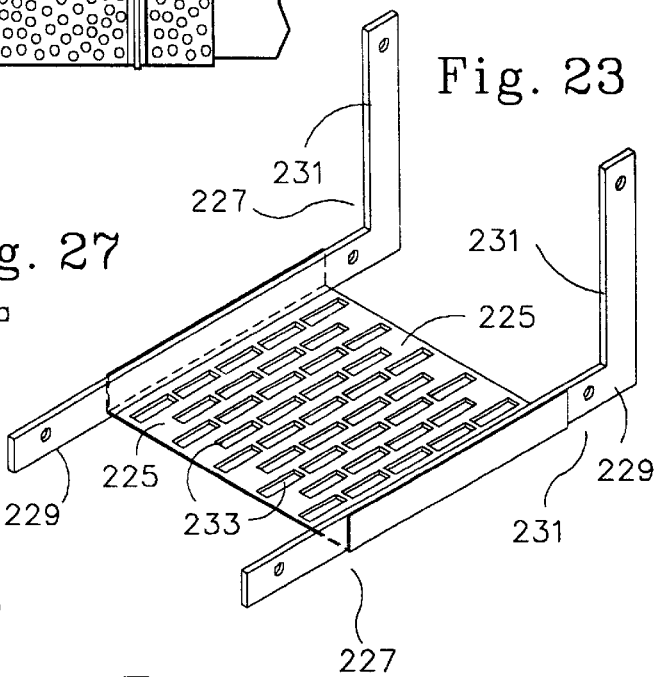
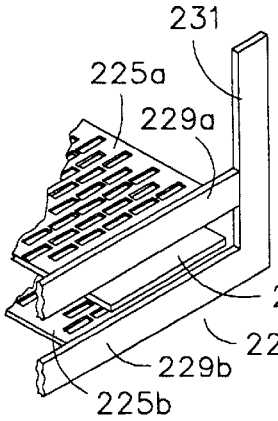
Fig. 24
Fig. 27
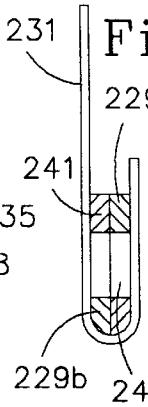
Fig. 25
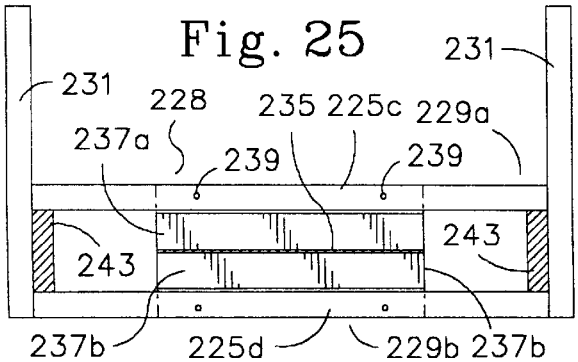
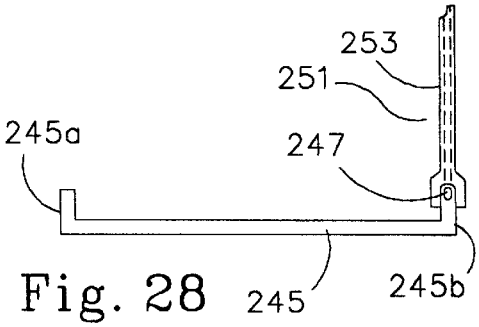
Fig. 28

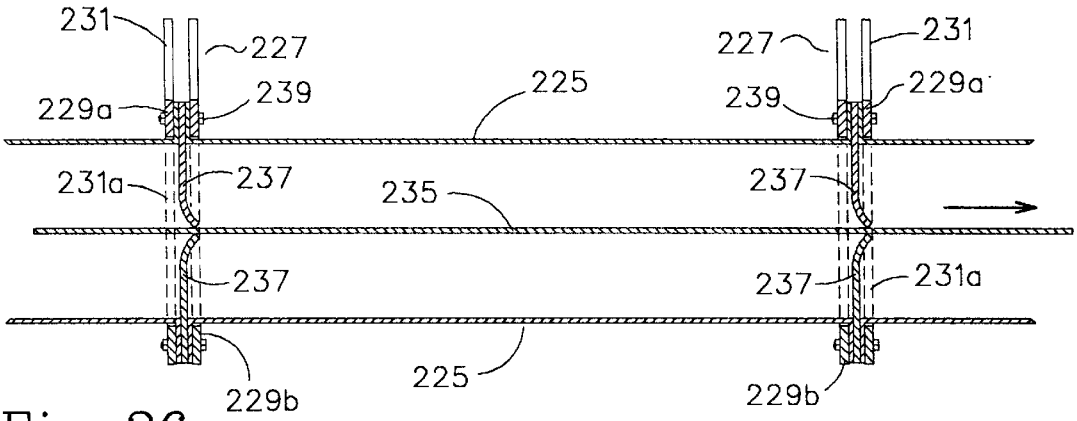
Fig. 26
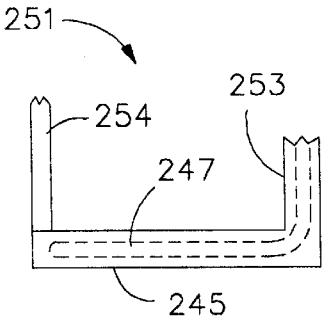
Fig. 28A
Fig. 30
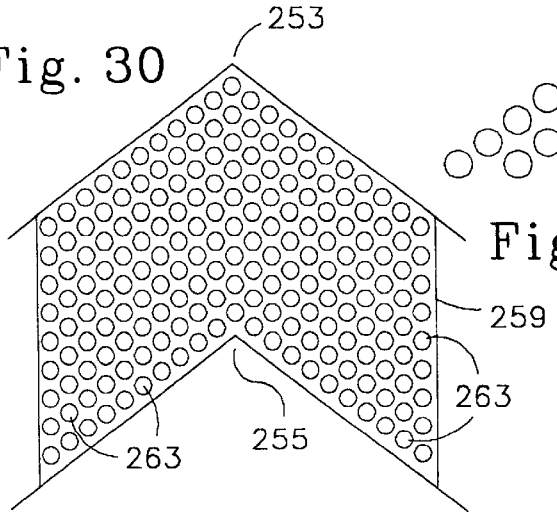
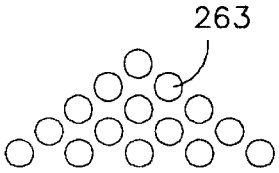
Fig. 30A
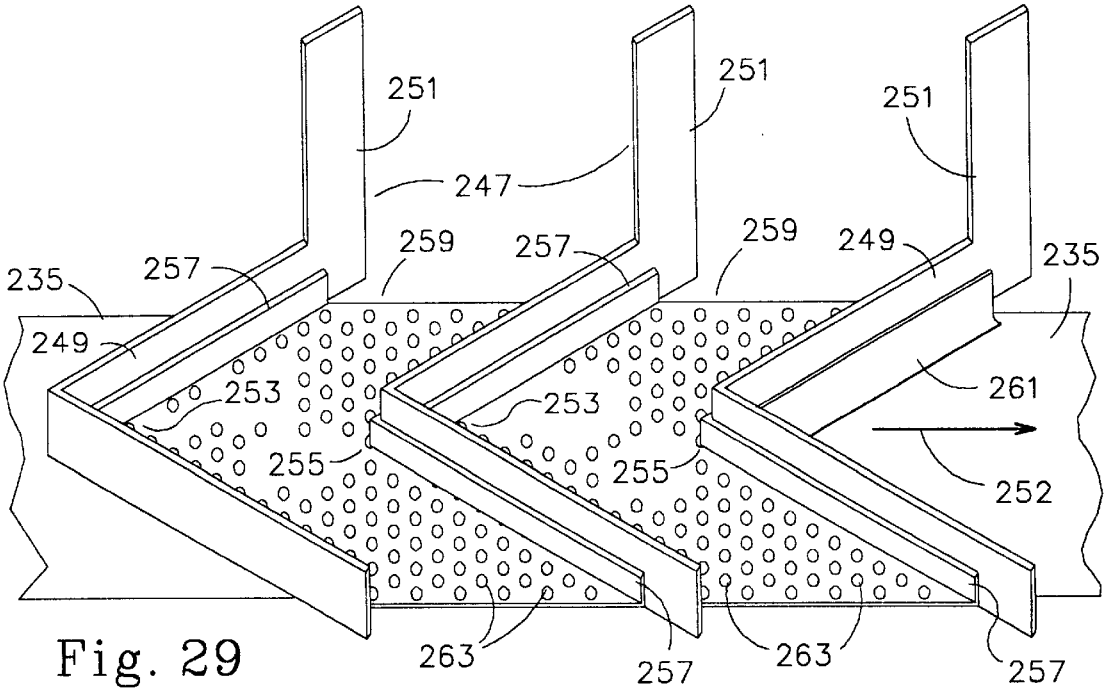
Fig. 29

Fig. 31
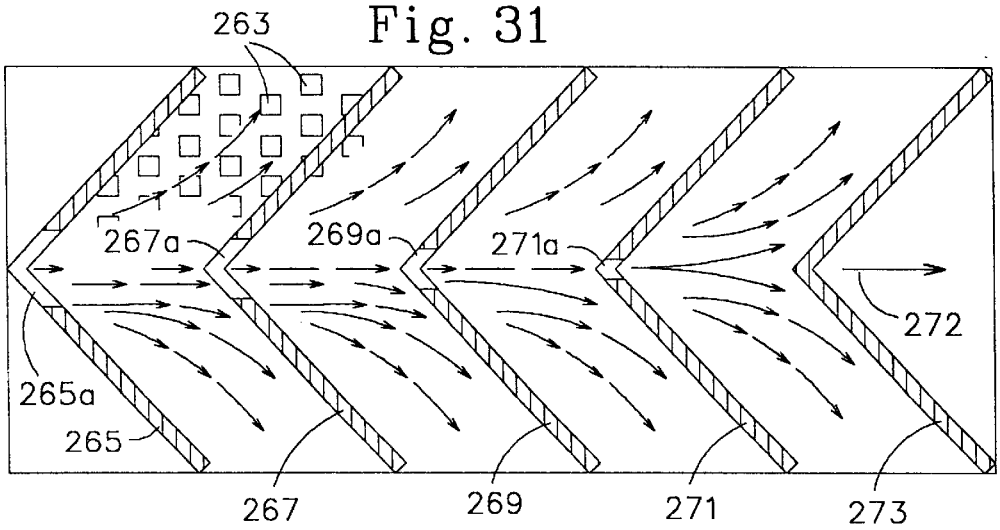
Fig.31A
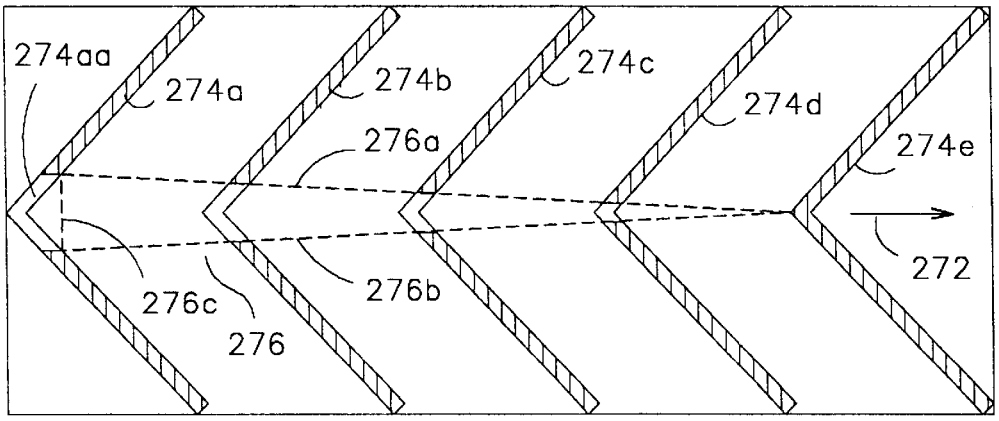
Fig. 32
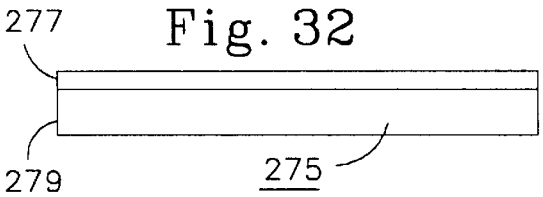
Fig. 34
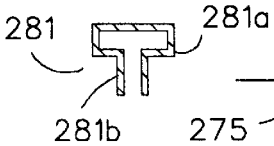
Fig. 33
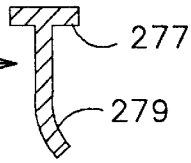
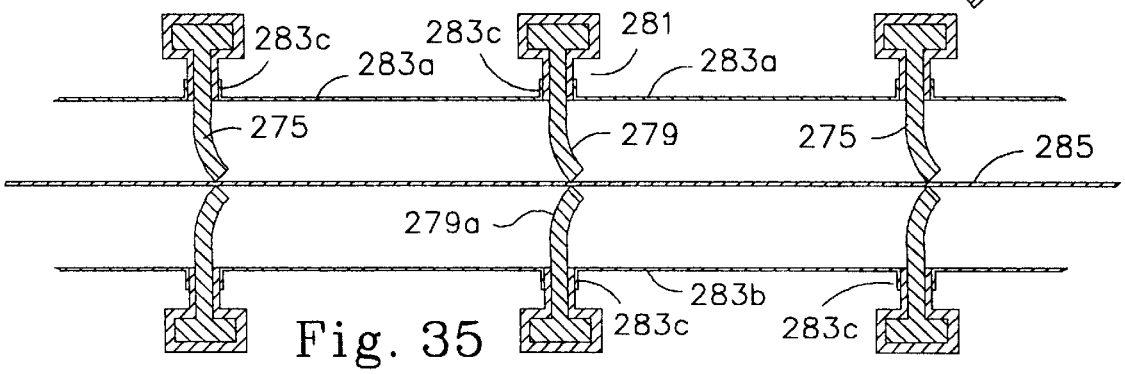
Fig. 35

Fig. 42
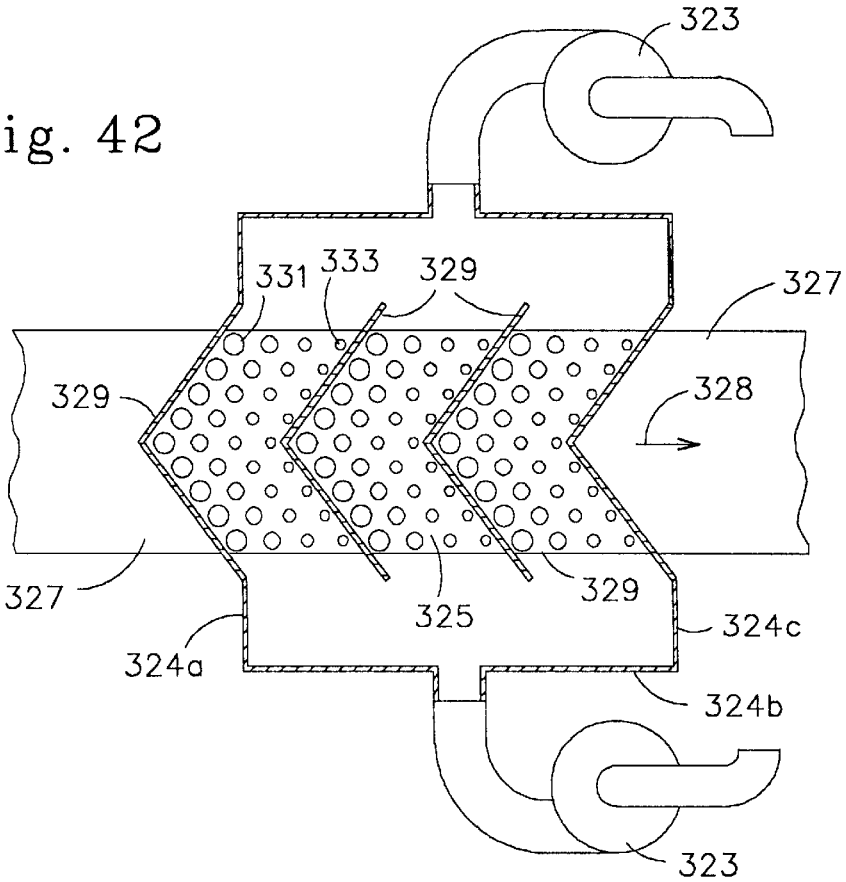
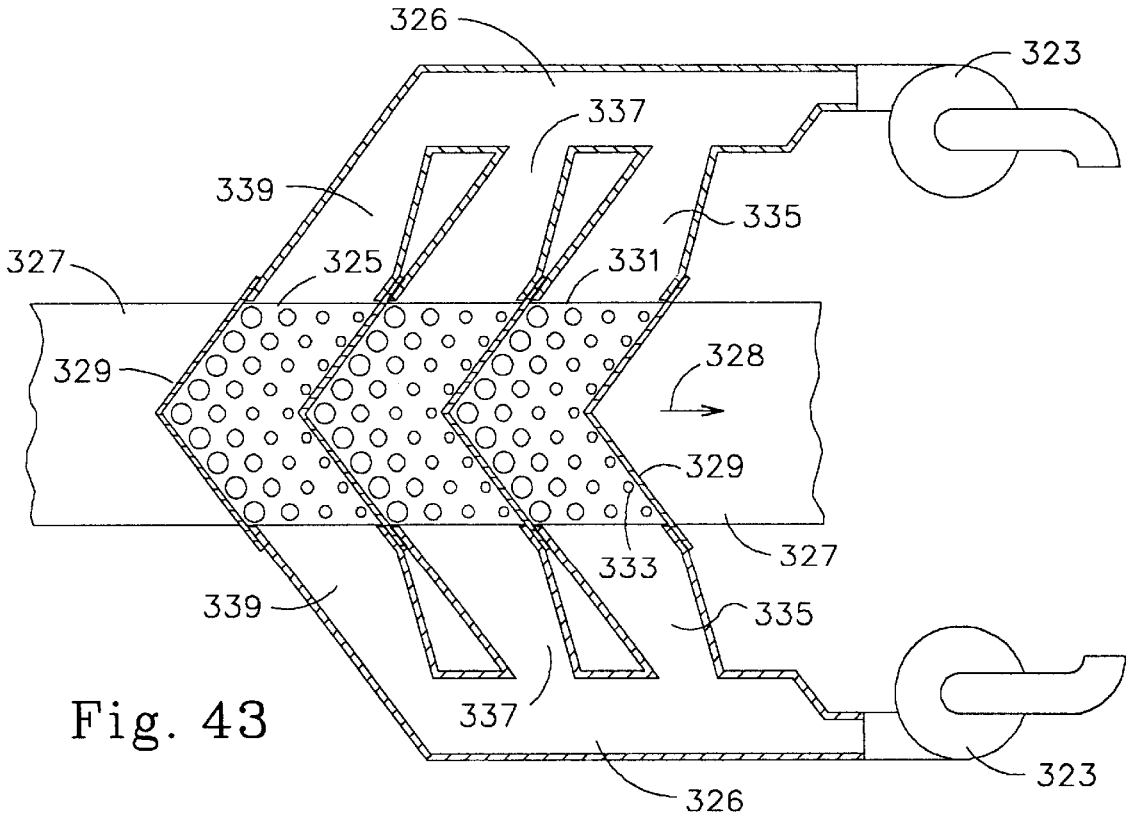
Fig. 43

Fig. 44
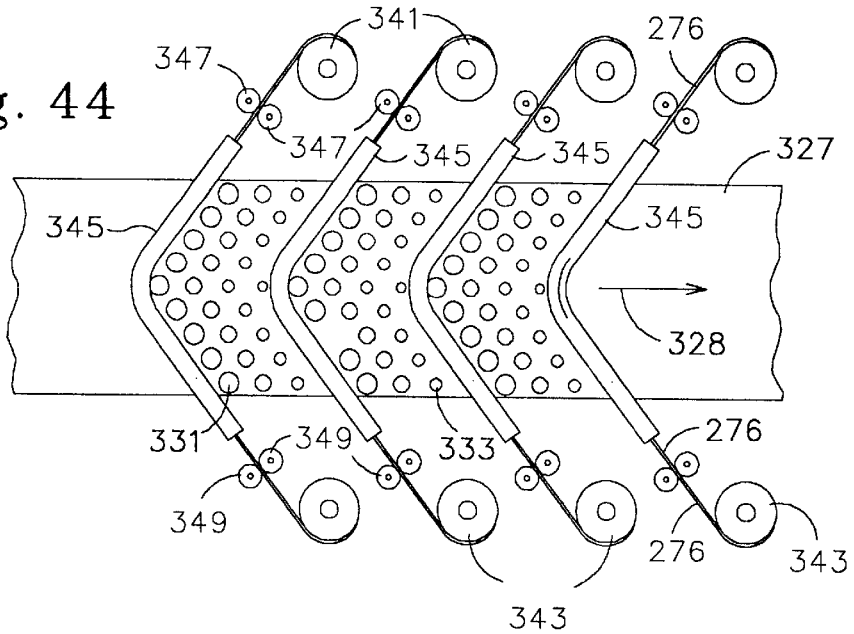
Fig. 46
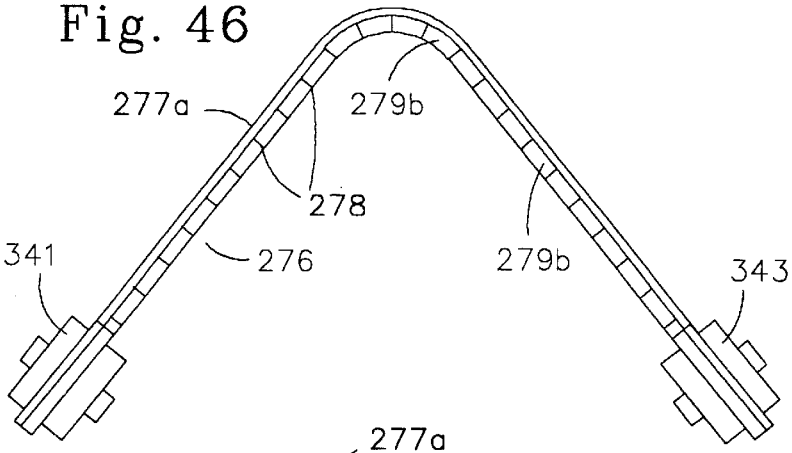
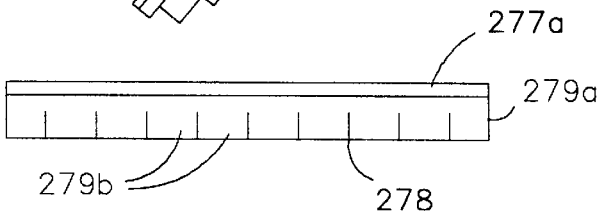
Fig. 45
Fig. 47
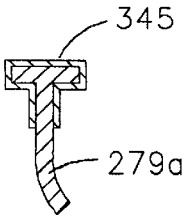
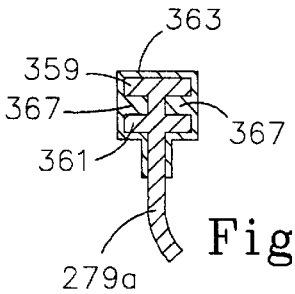
Fig. 49
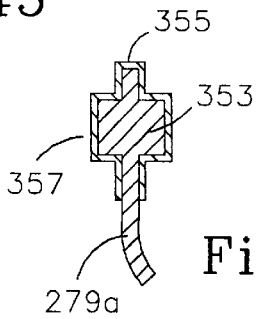
Fig. 48

Fig. 59
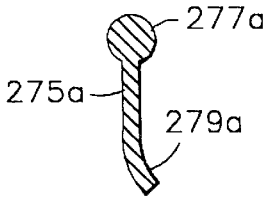
Fig. 60
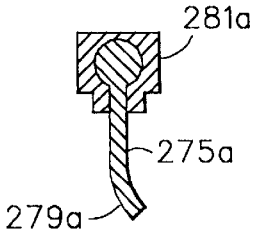
Fig. 61
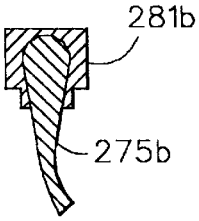
Fig. 63
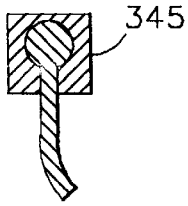
Fig. 64
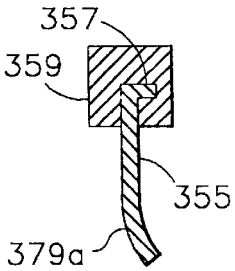
Fig. 65
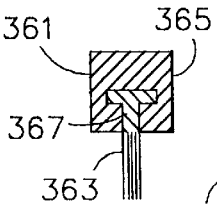
Fig. 66
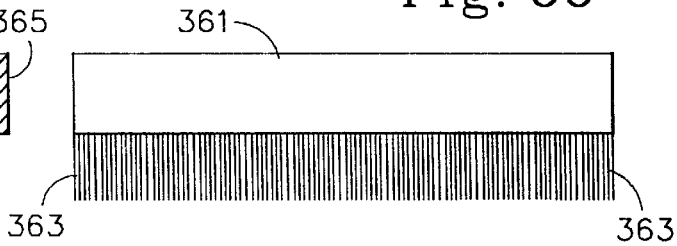
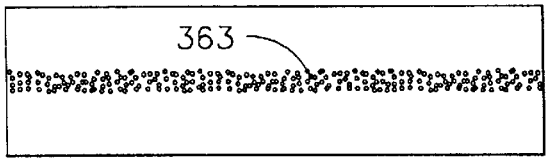
Fig. 67
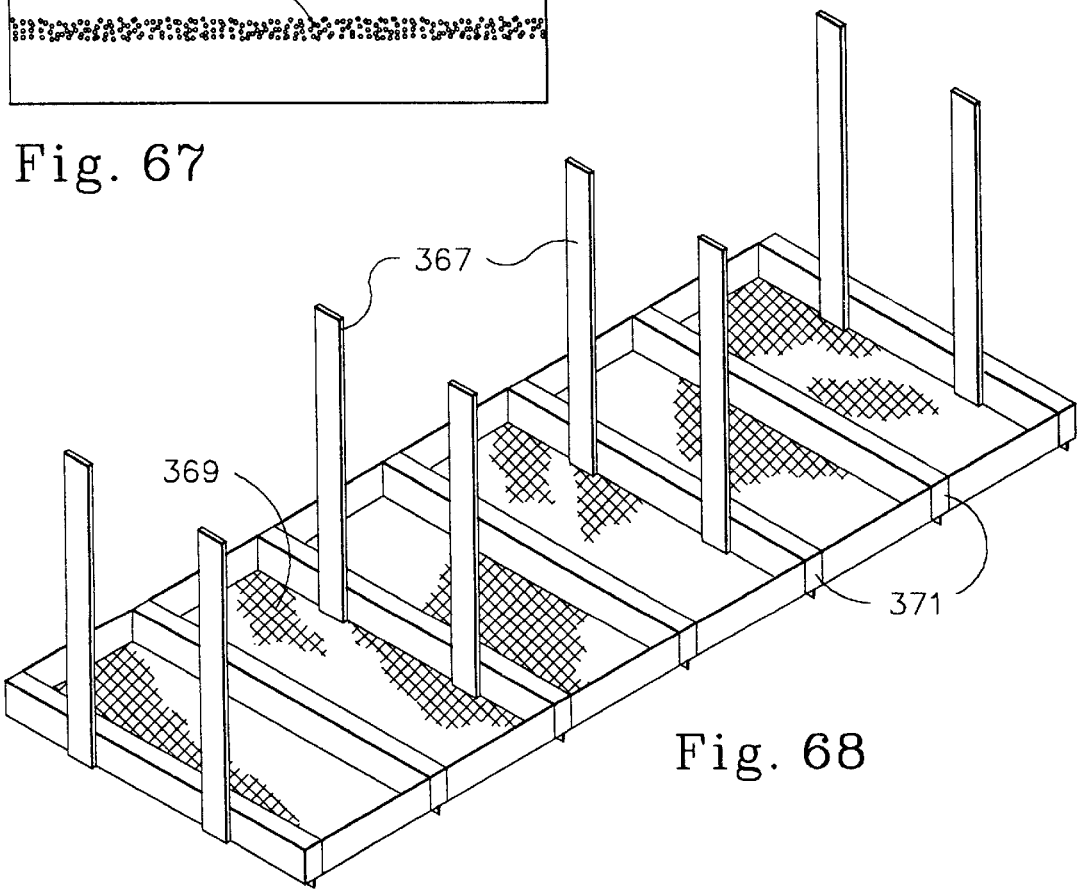
Fig. 68

Fig. 74
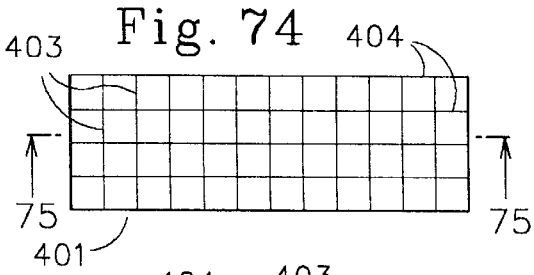
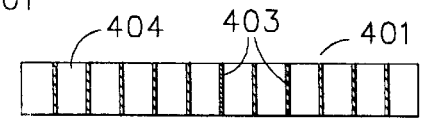
Fig. 75
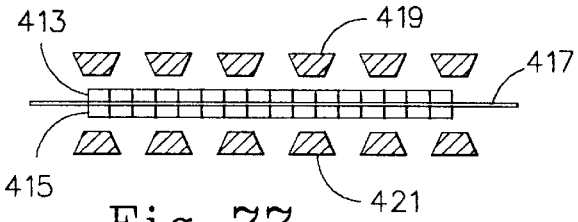
Fig. 77
Fig. 78
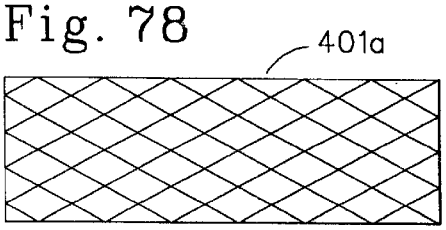
Fig. 79
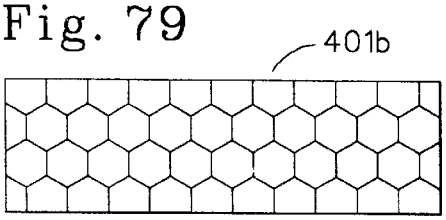
Fig. 80
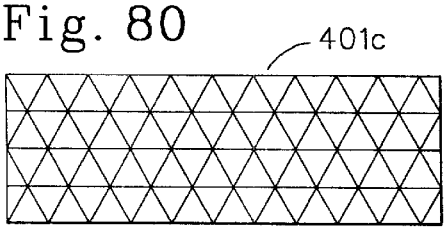
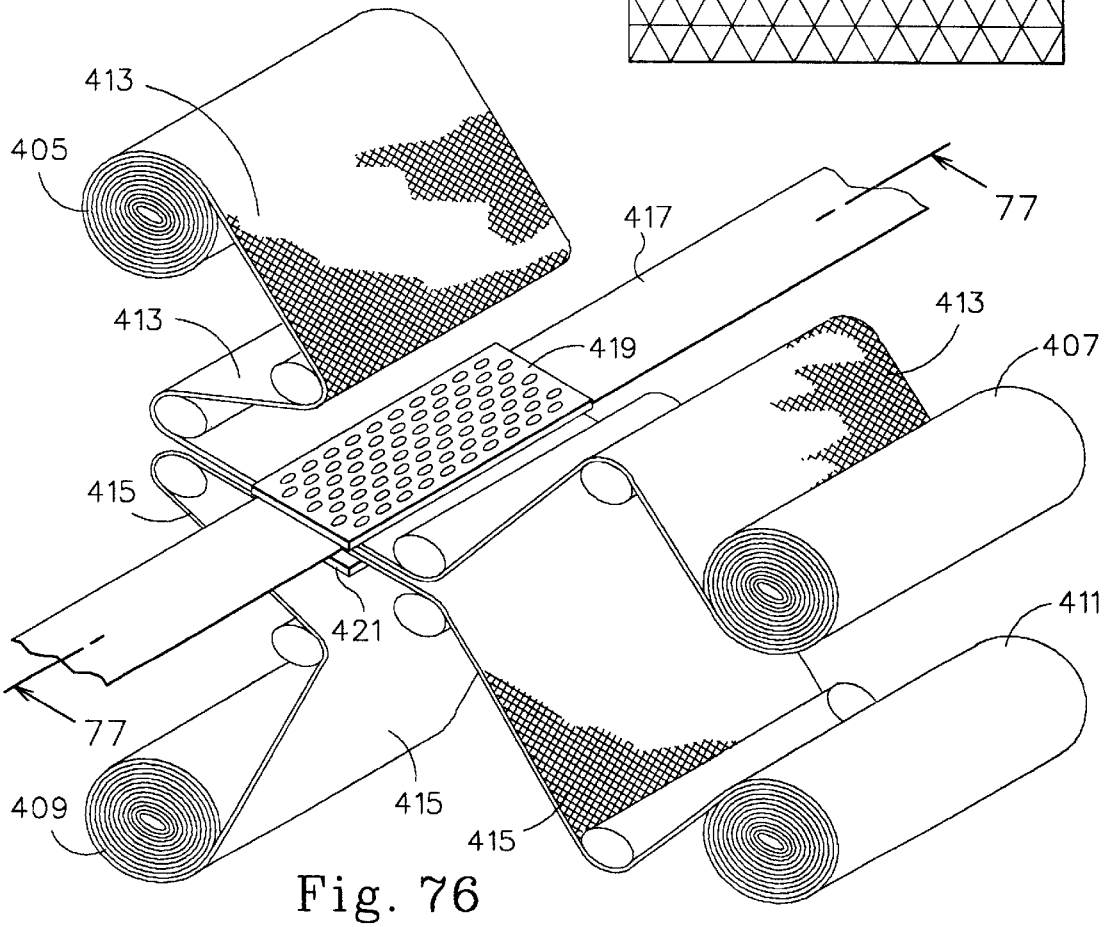
Fig. 76

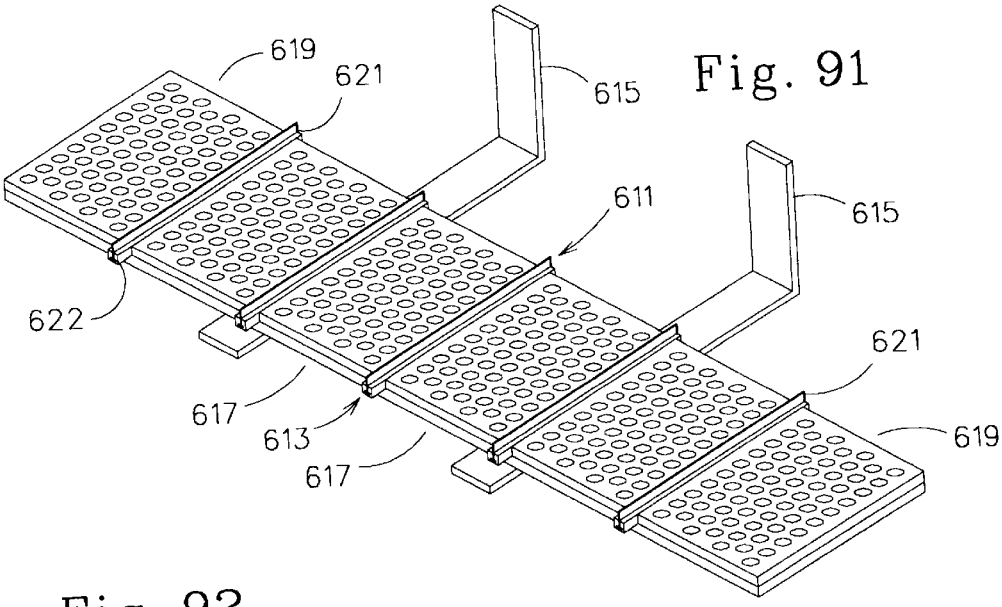
Fig. 91
Fig. 92
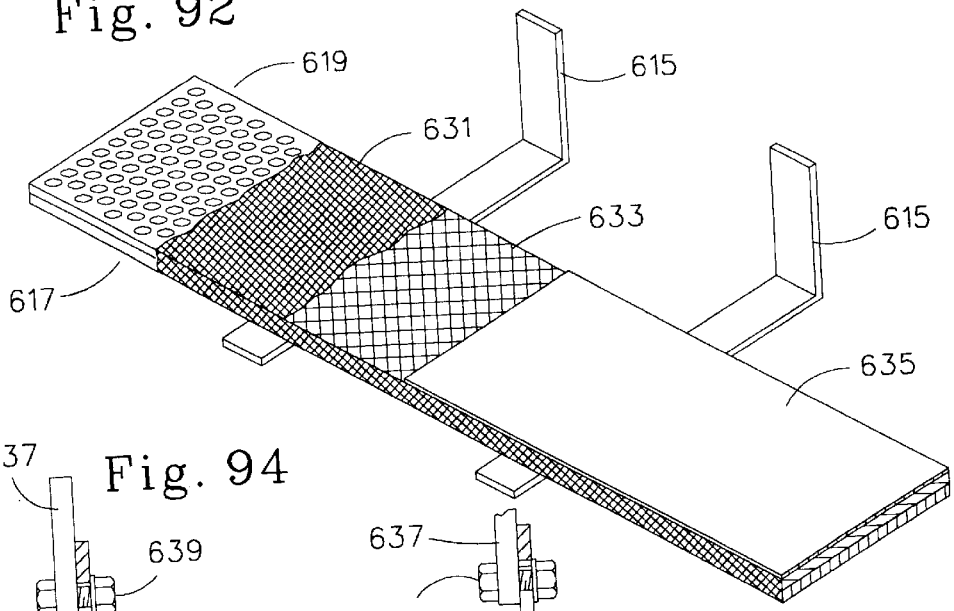
Fig. 94
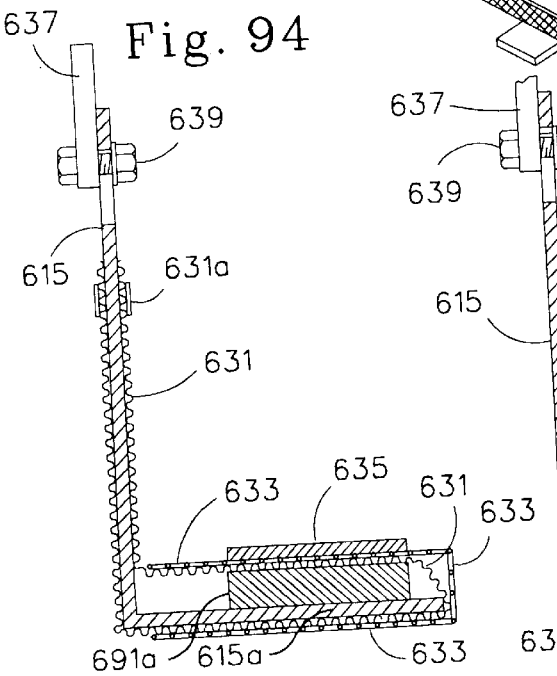
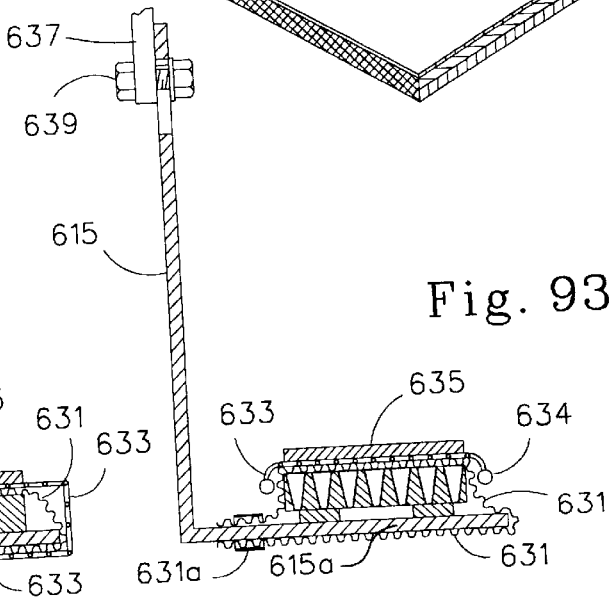
Fig. 93

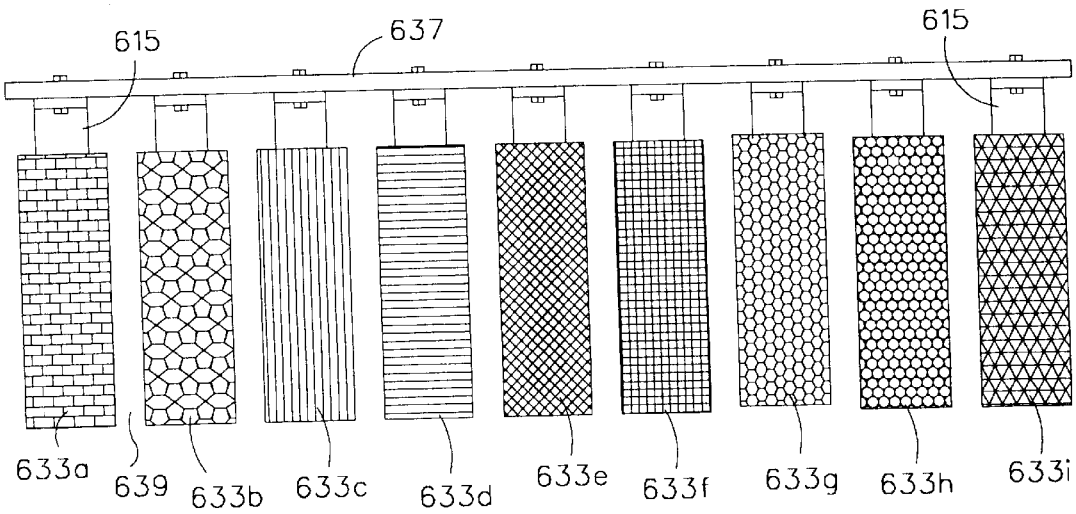
Fig. 95
Fig. 96
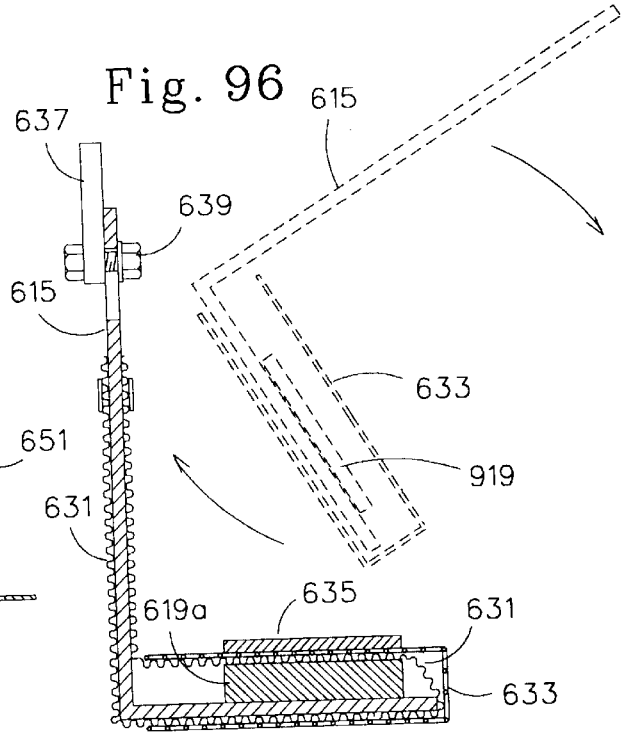
Fig. 97
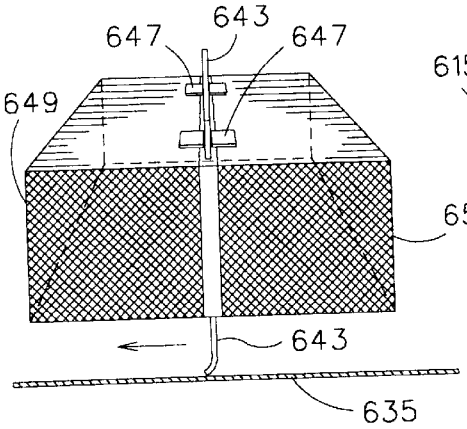
Fig. 98
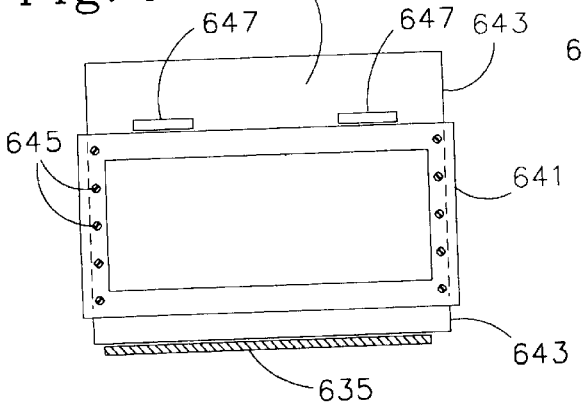
Fig. 99
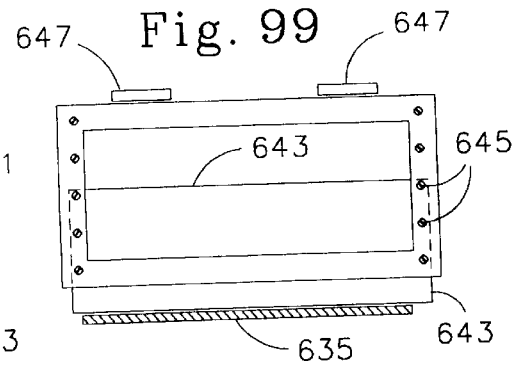

Fig. 102
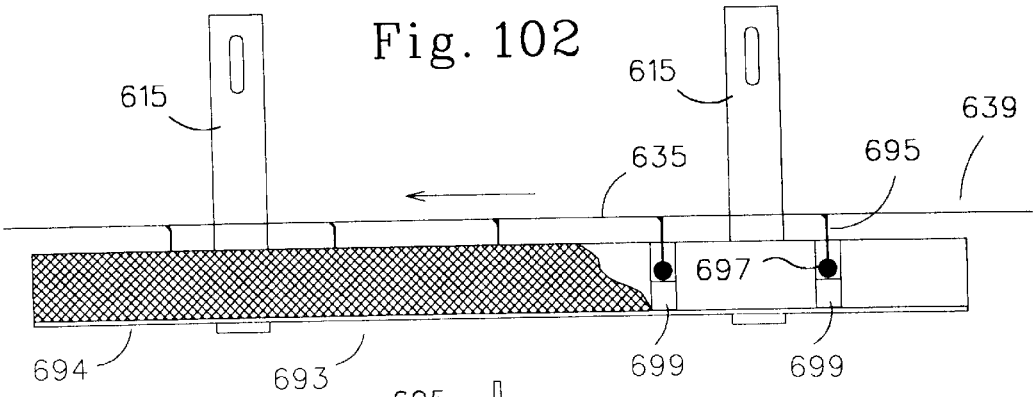
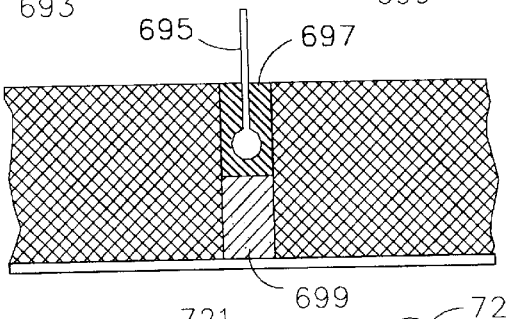
Fig. 103
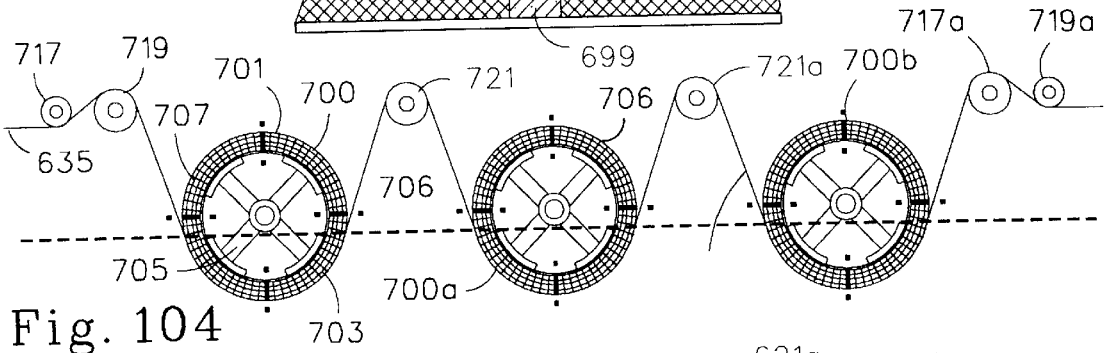
Fig. 104
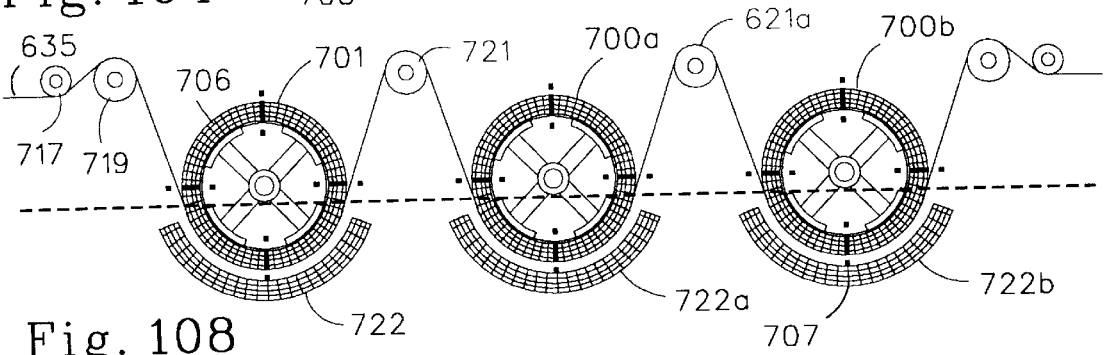
Fig. 108
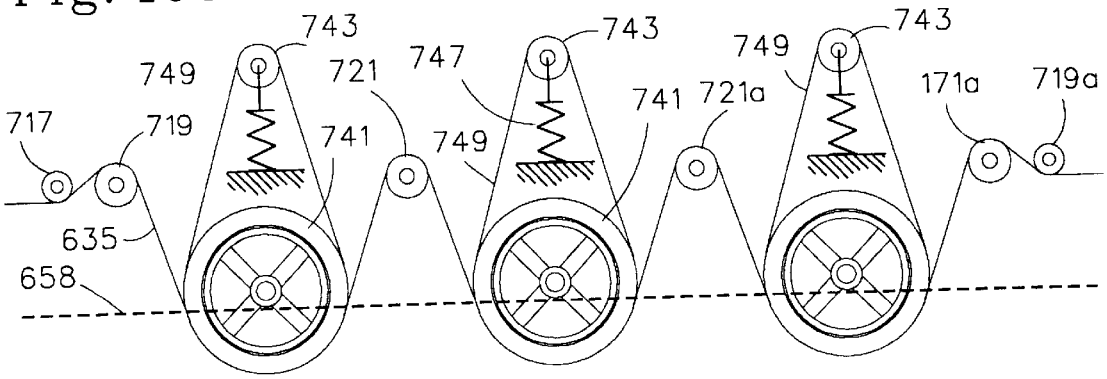
Fig. 109

Fig. 110
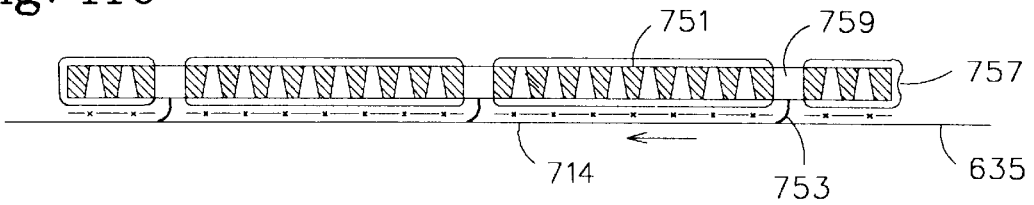
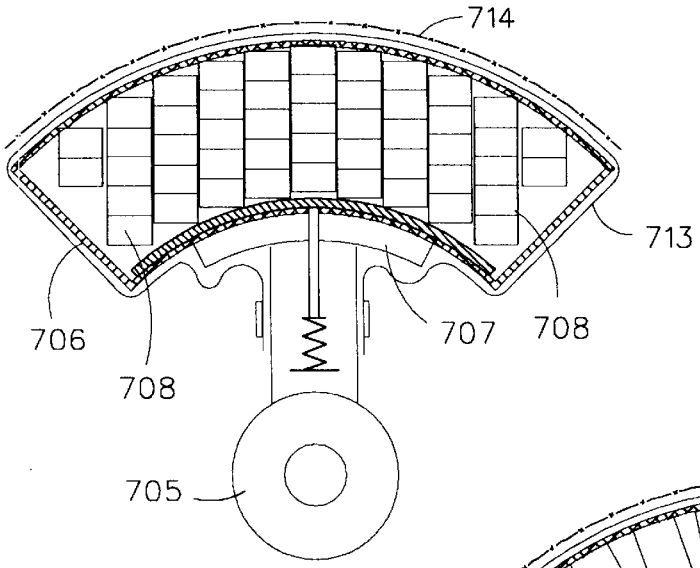
Fig. 105
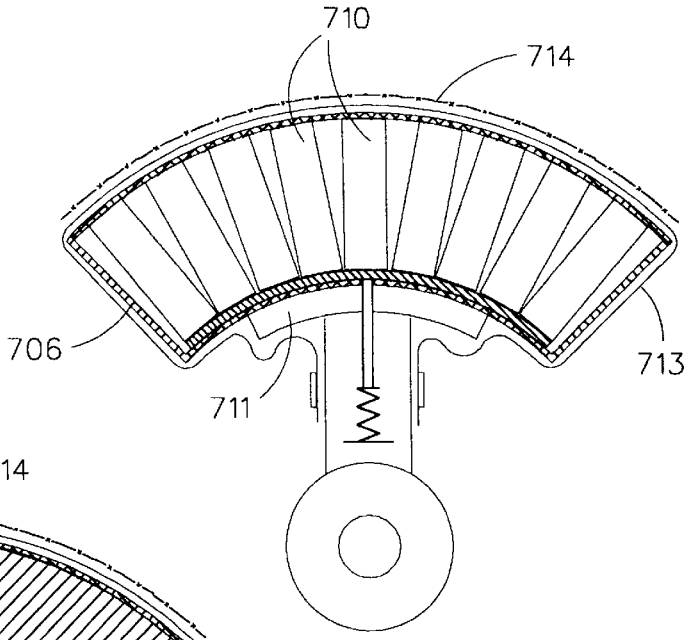
Fig. 107
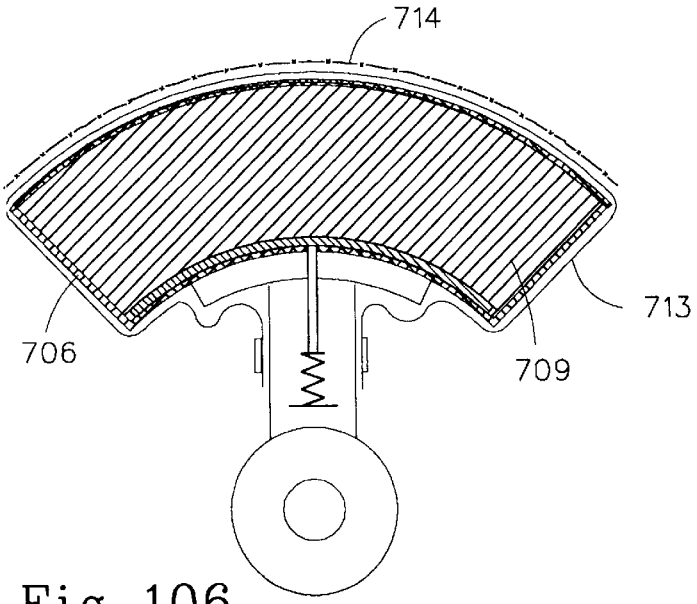
Fig. 106

METHOD AND APPARATUS FOR ELECTROCHEMICAL PROCESSING

RELATED APPLICATIONS

This application is a continuation-in-part of U.S. application Ser. No. 08/316,530 filed Sep. 30, 1994 now U.S. Pat No. 5,476,578 as well as PCT application PCT/US95 111, 232 filed Aug. 30, 1995 and U.S. application 08/533,500 filed Sep. 25, 1995, now U.S. Pat No. 5,679,233

BACKGROUND OF THE INVENTION (1) Field of the Invention.

This invention relates to the deposition of metallic coatings from plating solutions as well as anodizing of metals. More particularly, this invention relates to wiping the cathodic coating surface of sheet and strip and during continuous electroplating as well as continuous anodizing and more particularly still to the use of a substantially solid wiper blade during such electroplating or anodizing.

(2) Prior Art

As detailed more particularly in U.S. application Ser. No. 08/316,530 filed Sep. 30, 1994, now U.S. Pat. No. 5,476,578 the disclosure of which is hereby expressly incorporated in and made a part of the present application, a number of coatings are deposited from so-called plating baths subjected to an imposed electrical potential basically enhancing an already naturally occurring tendency for metal ions in the solution to plate out.

Since the coating of a cathodic workpiece is largely merely the acceleration of a naturally occurring process or phenomena, fairly small changes in technique and apparatus accentuating those conditions that favor deposition and de-emphasizing these conditions that disfavor deposition, may have rather large effects upon the final coating obtained. The history of improvements in the field, therefore, is largely one of progressive small improvements and adjustments to improve the conditions for deposition of various coating metals on a metallic substrate temporarily included as the cathode in a plating circuit.

It has been found, for example, by the present inventors as well as others that it is conducive to good coating results to remove the hydrogen bubbles which are produced at the cathodic work surface by transfer of electrons not only to the positive ions of the coating metal in the solution, but also to positive hydrogen ions in the electrolytic solution. The initial cathodic film is believed to be a combination or mixture of both hydrogen ions and atomic or molecular hydrogen. This film initially is only one atom thick. It interferes to some extent with good coating in that it may tend to hold the larger metallic coating ions away from the surface to be coated. However, the hydrogen atoms are small and the layer of hydrogen is initially discontinuous so that their initial interference with coating is not too serious.

If nothing is done to remove the hydrogen from the surface coating during the coating process, coating will usually continue, even though it may be seriously interfered with by the increasing hydrogen present as the thickness of the hydrogen layer increases the interference with efficient plating out of metal atoms upon the substrate surface. Such hydrogen, as it accumulates, however, tends to coalesce into larger local accumulations resulting in small bubbles and then larger and larger bubbles until such bubbles have sufficient volume and buoyancy to overcome their initial attraction for or adhesion to the substrate surface and float upwardly in the solution to the surface where they are finally dissipated into the surrounding atmosphere or local environment. Consequently, the hindrance to coating caused by the presence of hydrogen gas at the surface of a cathodic workpiece does not tend to progress to the limit where it would cut off electrolytic plating completely. However, hydrogen is still a very significant hindrance to rapid coating or plating and the larger bubbles clinging to the surface of a workpiece may even lead to macroscopic pits and other defects in an electrolytic coating.

A second significant problem which has been long recognized in electrolytic coating baths is depletion of the electrolytic solution as coating progresses. In many cases, the only result is that the coating rate slows down as there are progressively less coating metal ions in the solution to plate out. This decreasing coating rate has been counteracted by pumping in fresh coating solution, throwing in chunks of soluble coating metal for solution to "beef up" the electrolyte as well as other expedients. The trend has been for closer and closer control of the electrolyte composition during coating. Sometimes this has been implemented by continuous testing or analysis of the electrolytic bath as coating progresses. In addition, the coating solution baths have been mixed by impellers or the like, force circulated and re-circulated as well as frequently tested to hold them to a desired composition.

It has also been recognized that the coating bath next to a workpiece being coated may become locally depleted of coating metal ions and that such depletion may compromise efficient coating. Some installations have adopted the expedient of forced circulation of electrolyte past the point of coating or through a restricted coating area to increase the efficiency of coating. If the forced circulation is rapid enough, such circulation in itself also tends to detach bubbles of hydrogen from the cathodic coating surface, in effect, "killing two birds with one stone". However, the use of forced circulation of this type by pumps, jets and the like is not only unwieldy and expensive, but is believed by some to possibly have detrimental effects upon the coating itself because of the generalized rapidity of movement between the coating solution and cathodic workpiece, which macroscopically, at least, may interfere with efficient plating out of the metallic ions upon such work surface. Among the processes which have made use of rapid forced circulation is the so-called gap coating process in which a small coating gap between a coating anode and a cathodic workpiece is created and electrolytic solution is forced rapidly through such gap or opening.

Depletion of the coating solution has recently been found by one of the present inventors to be particularly serious in chrome plating solutions in which insoluble electrodes are used. It has been found that unless the chromium plating operation is maintained substantially continuous and at a fairly uniform rate that hard chrome is difficult to efficiently plate out in a brush-type coating operation, or, for that matter, in semi-brush type operations.

While various efforts to remove hydrogen bubbles from the coating surface in an electrolytic coating bath at the point of deposition have been tried, none has provided the ultimate quality of coating and efficiency of the coating operation which has been desired. Likewise, the ultimate in practical prevention of localized depletion in a coating bath has also not been attained.

A further problem in the continuous coating of a flexible material such as sheet, strip and wire products is that the efficiency of electroplating usually increases as the spacing between the electrodes, one of which is the material to be coated, decreases. In other words, the efficiency of coating is usually inversely related to the spacing between the electrodes one of which is the workpiece. However, due to the flexibility of the material being coated, it must, as a practical matter, be held away from the opposing electrode a sufficient distance to prevent arcing between the cathodic work material and the coating electrodes or anodes. The longer the unsupported run of material past the coating electrodes, the more deviation of the flexible material from its intended path is likely to occur, while closer spacing of supporting rolls or the like decreases the area available for coating and interferes with continuous coating. Very close spacing of the coating electrodes and the material being coated has been effected by the so-called jet coating process alluded to previously, but such process is complicated and sensitive to minor changes, making it suitable only for highly sophisticated coating lines.

There has been a need, therefore, for a means for removing hydrogen bubbles and cathodic film from a cathodic coating surface, preventing localized depletion of the coating bath with respect to coating material as well as allowing closer spacing of the coating electrodes and material being coated. The present applicants have found that a very effective means for accomplishing all three of these purposes is by the use of a relatively thin wiping blade applied to the surface of the workpiece at spaced intervals with a light contact. Such wiping blade deviates or strips away from the coating surface the relatively stable surface layer of electrolyte which tends to be drawn along with a moving cathodic surface, mixing and encouraging replenishing of the electrolyte next to the cathodic surface. It also at the same time wipes or sweeps away bubbles of hydrogen as well as encourages coalescence of small bubbles and films of hydrogen into large bubbles for subsequent wiping away. In addition, the wiping blade very effectively supports the material being coated, particularly in the case of relatively flexible material, and prevents its deviation from its intended path and, therefore, allows closer spacing of the coating electrodes and the surface of the material being coated.

The present inventors have also found that some of the same benefits attained in electro-coating are likewise obtained in the process of anodizing if the discontinuous blades of the invention are used to prevent the accumulation of bubbles of oxygen on the anodic workpiece and also to decrease the heating of the solution next to the anodic workpiece while permitting closer spacing between the anodic workpiece and the cathodic electrodes. The flexible wiping blades of the invention also significantly reduce the power requirements of the process, other things being equal, by allowing closer approach of the workpiece and the adjacent electrodes.

The present inventors have also now found that their preferred flexible wiping blades can often be replaced by contact of the surface of the strip with a plastic mesh arrangement and preferably a transversely flexible plastic mesh which serves to space the strip from adjacent electrodes as well as particularly interrupt passage of any barrier layer on the surface of the strip.

Some of the more pertinent prior art patents generally illustrating the history of the development of various solutions to some of the above-noted problems, particularly with respect to electrocoating, are as follows:

U.S. Pat. No. 442,428 issued Dec. 9, 1890 to F. E. Elmore.

U.S. Pat. No. 817,419 issued Apr. 10, 1906 to O. Dieffenbach.

U.S. Pat. No. 850,912 issued Apr. 23, 1907 to T. A. Edison.

U.S. Pat. No. 1,051,556 issued Jan. 28, 1913 to S. Consigliere.

U.S. Pat. 1,236,438 issued Aug. 14, 1917 to N. Huggins.

U.S. Pat. No. 1,473,060 issued Nov. 6, 1923 to E. N. Taylor.

U.S. Pat. No. 1,494,152, issued May 13, 1924 to S. O. Cowper-Coles.

U.S. Pat. No. 2,473,290 issued Jun. 14, 1949 to G. E. Millard.

U.S. Pat. No. 3,183,176 issued May 11, 1965 to B. A. Schwartz, Jr.

U.S. Patent No. 3,715,299 issued Feb. 6, 1973 to R. Anderson et al.

U.S. Pat. No. 3,751,346 issued Aug. 7, 1973 to M. P. Ellis et al.

U.S. Pat. No. 3,772,164 issued Nov. 13, 1973 to M. P. Ellis et al.

U.S. Pat. No. 3,886,053 issued May 27, 1975 to J. M. Leland.

U.S. Pat. No. 4,125,447 issued Nov. 14, 1978 to K. R. Bachert.

U.S. Pat. No. 4,176,015 issued Nov. 27, 1979 to S. Angelini.

U.S. Pat. No. 4,210,497 issued Jul. 1, 1980 to K. R. Loqvist et al.

U.S. Pat. No. 4,235,691 issued Nov. 25, 1980 to K. R. Loqvist.

U.S. Pat. No. 4,399,019 issued Aug. 16, 1983 to W. A. Kruper et al.

U.S. Pat. No. 4,595,464 issued Jun. 17, 1986 to J. E. Bacon et al.

U.S. Pat. No. 4,853,099 issued Aug. 1, 1989 to G. W. Smith.

U.S. Pat. No. 4,931,150 issued Jun. 5, 1990 to G. W. Smith.

Some prior patents related to anodizing as well as some of the above problems are as follows:

U.S. Pat. No. 3,074,857 issued Jan. 22, 1963 to D. Altenpohl.

U.S. Pat. No. 3,650,910 issued Mar. 21, 1972 to G. W. Froman.

U.S. Pat. No. 3,865,700 issued Feb. 11, 1975 to H. A. Fromson.

U.S. Pat. No. 4,152,221 issued May 1, 1979 to F. G. Schaedel.

U.S. Pat. No. 4,502,933 issued Mar. 5, 1985 to T. Mori et al.

U.S. Pat. No. 4,248,674 issued Feb. 3, 1981 to H. W. Leyh.

The following patents from the above compilation of patents are particularly illustrative of some of the more interesting disclosures of problems and solutions found in the above listed prior art.

U.S. Pat. No. 1,473,060, issued Nov. 6, 1923 to E. N. Taylor, discloses the use of a brush-type wiper in a coating tank environment to remove small gas bubbles and solid impurities from the coating surface intermittently (about 3 seconds out of every minute of coating) allowing the coating process to proceed uninterrupted during the time the brush is not operating.

U.S. Pat. No. 1,494,152, issued May 13, 1924 to S. O. Cowper-Coles, contains an early disclosure of a depleted layer of electrolyte carried around adjacent to the surface of a cathodic workpiece as well as bubbles of gas on the surface. The Cowper-Coles solution to these problems is to rapidly oscillate the cathodic workpiece to in effect shake off the bubbles and depletion layer (referred to by Cowper-Coles as the cathodic layer). The brushing takes place above the electrolyte surface as the hoop-type workpiece rotates into and out of the electrolyte.

U.S. Pat. No. 2,473,290 issued Jun. 14, 1949 to G. E. Millard discloses an electroplating apparatus for plating crankshafts and the like with chromium in which a curved anode partially surrounds the portion of the workpiece to be coated. The curved anode has orifices in its surfaces to allow the escape of bubbles formed during the coating process and also has extending through its surface, a support for a so-called positioning block or scraper block 54 which is provided to maintain a close spacing between the anode and cathodic workpiece. Millard states also that his spacing block removes gas bubbles from the cathode and also removes threads of chromium. He also states that the block, which has a significant width along the line of coating, dresses and polishes the cathode during plating. The aim of Millard, is clearly to burnish or compact the coating surface somewhat in the manner of the earlier Huggins patent. While Millard talks, therefore, about scraping off the gas bubbles and also removing "threads" of chromium by which it is understood that he means dendritic material, he is primarily interested in conducting a burnishing operation and spacing his cathode from his anode by his relatively wide spacer block.

U.S. Pat. No. 2,844,529 issued Jul. 22, 1958 to A. Cybriwsky et al. discloses a process and apparatus for rapidly anodizing aluminum. The Cybriwsky patent proposes maintaining a constant temperature differential between the aluminum surface and the electrolytic bath. Contact rolls are spaced throughout the apparatus but are not used for the purposes of removing gas bubbles from the metal strip.

U.S. Pat. No. 3,079,308 issued Feb. 26, 1963 to E. R. Ramirez et al. discloses a typical process of anodizing including a pumping means to transfer electrolyte onto the surface of the metal strip. A contact cell is used to provide a positive charge on the anode. There is no disclosure of a method for removing gas bubbles from the strip.

U.S. Pat. No. 3,183,176 issued May 11, 1965 to B. A. Schwartz, Jr., discloses the electrolytic treatment or coating of a bore by use of a brush coating apparatus mounted on a drill press. The inside of the bore is acted upon by a series of centrifugally extended rotating vanes having dielectric outer covers.

U.S. Pat. No. 3,359,189 issued Dec. 19, 1967 to W. E. Cooke et al. discloses a continuous anodizing process and apparatus wherein the turbulent longitudinal flow of electrolyte (as opposed to the more traditional streamline flow), either concurrent or countercurrent along the continuous workpiece, allows for increased thickness of anode oxide coating films. The Cooke et al. patent does not fully explain why increasing the turbulence of the electrolyte flow bolsters the coating efficiency. It is believed by Cooke et al., however, that the turbulent electrolyte helps disperse heat from the coating surface.

U.S. Pat. No. 3,650,910 issued Mar. 21, 1972 to G. W. Froman discloses a method for anodizing an aluminized steel strip wherein gas bubbles (both $H_2$ and $O_2$) are prevented from accumulating on the strip by moving the strip at faster speeds. The speed, as disclosed in the specification, is approximately 30 feet/minute. The Froman technique is an entirely different approach from both the use of a flexible wiper means and the electrolyte agitation technique described above to remedy the problem of bubble accumulation.

U.S. Pat. No. 3,715,299, issued Feb. 6, 1973 to R. Anderson et al. includes a disclosure of plastic vanes positioned close to a workpiece to cause turbulence and break up a boundary layer upon an adjacent cathodic workpiece. Anderson et al. does not directly sweep away the boundary layer or gas bubbles, but only causes turbulence and believes this at least partially breaks up and discourages the formation of a boundary layer.

U.S. Pat. No. 4,125,447 issued Nov. 14, 1978 to K. R. Bachert, discloses the use of a brush attached to a movable anode within a hollow member being electroplated. The brush comprises a plurality of bristles made from plastic or other insulated material which rub against the inside surface of the tube being electroplated as the anode vibrates.

U.S. Pat. No. 4,176,015 issued Nov. 27, 1979 to S. Angelini, discloses the brushing of the surface of a series of bars as they are passed in a straight line through an anode immersed within an electroplating bath. The brushing is provided by a glass fiber brush comprising a blade having a layer of fiber scraping material compressed between side plates which is said to remove a cathodic film from the coated surface.

U.S. Pat. No. 4,210,497 issued Jul. 1, 1980 to K. R. Loqvist et al. discloses the coating of hollow members including movement inside the cavity of such members of an electrolytic solution by means of a "conveyor" which consists of a resiliently and electrically insulating material such as perforated, net-like or fibrous strip which is wound helically around a reciprocating anode. The function of the resilient electrically insulated material is to act as a conveyor of electrolyte, foam and gases which can be supplemented by forming the anode as a screw conveyor.

U.S. Pat. No. 4,227,291 issued Oct. 14, 1980 to J. C. Shumacher discloses an energy efficient process for the continuous production of thin semiconductor films on metallic substrates. The process is a cathodic deposition of germanium or silicon from an electrolyte upon an aluminum-coated steel substrate. The patent thus discloses a cathodic coating process rather than an anodizing process. The patent discloses, however, a suction apparatus that removes spent electrolyte and recirculates it. There is no device used for the specific purpose of removing gas from the vicinity of the strip, including no flexible wiping blades.

U.S. Pat. No. 4,235,691 issued Nov. 25, 1980 to K. R. Loqvist, discloses the use of angular plastic wiping blades upon the surface of a round workpiece during electroplating. The angular plastic blades are mounted in a cylindrical mounting that rotates about the round workpiece. Bubbles of hydrogen are wiped from the surface by the blades.

U.S. Pat. No. 4.248,674 issued Feb. 3, 1981 to H. W. Lehy discloses an anodizing process for producing anodized aluminum stock for lithography in which a differential anodized coating is placed on the two sides. The operation of a contact cell is explained and the use of a perforated cathode disclosed to facilitate circulation of electrolyte. No use of thin wiper blades or the removal of gases from the strip or foil surface is disclosed.

U.S. Pat. No. 4,399,019 issued Aug. 16, 1983 to W. A. Kruper et al. discloses a modified tank type coating process and apparatus in which a boundary layer is broken up on an interior coating surface by use of a series of mixing blades or vanes. Kruper et al. uses "mixing blades or vanes," and preferably moving blades to essentially stir up his electrolytic solution between a perforated anode and the interior surface of his workpieces and, therefore, disturb or mix the boundary layer which develops on the work surface, which boundary layer becomes quickly depleted of coating material and replace it with a mixture of depleted and fresh electrolytic solution. Kruper et al. uses hard plastic vanes attached to his perforated anode. The plastic vanes are more or less triangular in shape or cross section with one side of the top attached to the perforated anode, the other side of the top forming the leading edge of the blade, and the base forming the trailing edge of the blade. As the blades move in a circle within the space between the internal surfaces of the bearing housings which are to be coated and the surface of the moving or rotating anode, the flat leading surface of the blades stirs the electrolytic solution and causes turbulence which mixes the solution in the working space and causes flow both inwardly and outwardly through the orifices in the rotating anode assembly into and from the main body of coating solution within the center of the perforated anode assembly. Kruper et al. indicates that he prefers to maintain a space between his stirring blades and the coating surface of the workpiece. However, in an incidental disclosure without details, Kruper et al. also indicates that the stirring blade could less desirably extend to the coated surface and in such case it is preferred that the blades be somewhat resilient such as in a windshield wiper or a brush. Exactly what sort of shape this would be is not clear, but it seems clear in either case that the resiliency would cause the triangular structure shown to be compressed inwardly, forming a seal between the blade and the coated surface interfering with the electrocoating operation.

U.S. Pat. No. 4,502,933 issued Mar. 5, 1985 to T. Mori et al. discloses an apparatus for electrolytic treatment including anodizing of a metal web. The Mori et al. patent addresses the problem of gas accumulation and provides some historical background noting past solutions in this area. According to the Mori et al. patent, electrolyte agitation appears to be the traditional solution towards reducing bubble formation. Because electrolyte agitation requires a much larger pump, however, the added power consumption negates the cost-saving benefits from the removal of the gas. Another solution noted by Mori et al. has been transporting the aluminum web vertically through the bath. Problems stemming from this technique include supplying sufficient power to the metal web and the added maintenance cost of the unusual design. Finally, a partition plate method is stated by Mori et al. to be disclosed in Japanese Patent Publication No. 21840/80 wherein partition plates extend "along the length" of the aluminum web in the bath and apparently perpendicular to the aluminum web in the bath. The partition plates form a channel which intensifies the agitation of the electrolyte. By narrowing the region with the plates, the agitation removes the bubbles from the metal surface more effectively. This technique, like the first technique described, requires a larger pump and therefore suffers from the same disadvantages. The Mori et al. patent, like the other techniques, attempts to remove bubbles by agitating the flow of electrolyte. Electrical insulating members extend transverse of the direction of a metal web and above the level of the electrodes adjacent the web surface and therefore spaced from the web surface to allegedly vigorously agitate the electrolyte in the vicinity of the web.

U.S. Pat. No. 4,595,464 issued Jun. 17, 1986 to J. E. Bacon et al., discloses the use of a so-called brush belt for continuously treating a workpiece. The brush belt is in the form of a continuous loop which passes over suitable rollers or pulleys and brings plating solution in the brush portion to the plating area. Essentially, Bacon et al. provides an absorbent belt which passes in opposition to the material to be coated.

U.S. Pat. No. 4,853,099 issued Aug. 1, 1989 to G. W. Smith discloses a so-called gap coating apparatus and process in which a relatively small elongated gap is established through which coating solution is passed at a high rate. It is said that the ultra high flow rate allows very high current densities. It is stated the process is not well suited for chromium plating, because high current densities do not increase the plating out of chromium.

U.S. Pat. No. 4,931,150 issued Jun. 5, 1990 to G. W. Smith, discloses a so-called gap-type electroplating operation in which a selected area of workpieces is coated by forming an electrode closely about such so-called gap and passing electrolytic solution through the gap at a high rate. It is stated that the ultra-high volume flow assures the removal of gas bubbles, the maintenance of low temperature and high solution pressure contact with the anode surface and a workpiece surface. It is stated that gaps approaching two and one half inches can employ the invention, but the gap would preferably be smaller, but at least 0.05 inches in width. It is stated that a fresh plating solution having a controlled temperature and no staleness is available at all times in the gap for uniform plating and while in high pressure contact with the surface of the gap. In practice, the plating solution is forced in a vertically upward direction so that any gas generated by the electrolysis in the gap migrates upwardly in the same flow direction as the plating solution is being driven and, therefore, can readily escape. It is also stated that chromium is difficult to use in the invention because chromium deposits slowly regardless of current density so that the deposition is slow and the advantages of gap plating are not fully attained.

While other processes and apparatus have, therefore, been available to remove hydrogen bubbles from cathodic coating surfaces, sever and remove dendritic material in coating processes such as the electrolytic coating of chromium and prevent depletion of the electrolytic solution and to some extent, establish a desirable coating gap between the coating electrode and the material being coated, all such prior processes have had drawbacks and none has been effective to accomplish all four or even two or three of the disclosed aims of the present invention by themselves. The same is true, generally, with respect to anodizing of workpieces including the anodizing of aluminum strip, aluminized steel, aluminum foil for capacitor production, aluminum for lithography, and other suitable metals such as magnesium and copper, various aluminum alloys and even stainless steel where a colored oxide on the surface is desired.

BRIEF DESCRIPTION OF THE INVENTION

It has been discovered that a very effective acceleration of electrolytic coating plus the production of considerably better quality coatings can be attained by the use of a wiper blade or thin dielectric guide bearing upon continuous coating material, said wiper or guide blade having a substantially solid wiping or support edge portion which is resiliently biased against the cathodic coating surface. The blade itself may be resilient or it may be biased against the coating surface by associated resilient means while the cathodic coating surface moves relative to such wiping blade and also a closely spaced anode. Preferably the wiping blade is mounted upon the anode or even made a portion of the anode structure, but it may also have an alternative means for mounting. The wiper blade or guide blade effectively removes bubbles of hydrogen from the cathodic work surface and in those cases where dendritic material extends from the surface during the establishment of the coating, effectively severs such dendritic material and allows it to be removed from the coating vicinity. Dendritic material may extend from the coating during deposition, for example, in the production of chromium electroplated coatings and the like. The solid wiper blades also effectively block the passage of a surface layer or film of electrolyte next to the cathodic plating surface when such surface and a surface film of electrolyte are moving together relative to the main body of electrolyte and causes replacement of such surface film with new electrolyte, thus preventing gradual depletion of the surface layer of electrolyte. In a preferred arrangement, the wiping blade is combined with a perforated anode which allows ready escape of the depleted electrolyte layer and replacement with fresh electrolyte. The blade also may serve very effectively as a guide blade to support flexible substrate material to be electroplated between more widely spaced support rolls or the like. The very thin restricted surface of the guide blade does not interfere with the coating operation and adjusts itself to an increase of coating thickness as electrolytic coating progresses.

The plastic wiping blade, it has now been discovered, can be in some cases replaced with a plastic mesh either actively or passively drawn across the surface of a passing strip. The plastic mesh serves as a spacer between the strip and adjacent electrodes and also serves to wipe the surface of the strip either by direct contact or by turbulence induced in the electrolyte by passage of the strip past the plastic mesh or in some cases by active passage of the plastic mesh across the surface of the strip. One particularly preferred arrangement is to use a combination of the flexible wiping blades and open-web, plastic mesh wipers to complement each other.

The invention can also be applied to anodizing by using the thin wiping blade to wipe bubbles of oxygen from the anode and also to continuously remove any overheated solution from adjacent to the anodic work surface as well as to stabilize the spacing between the anodic workpiece, or web, and adjacent cathodes to allow closer spacing between the electrodes and workpieces.

BRIEF DESCRIPTION OF THE DRAWING

FIG. 19 is a diagrammatic side view of a series of resilient wiper blades mounted in a sectionalized anode for use in continuous electrolytic coating of a sheet or strip.

FIG. 20 is a plan view of the top of the sectionalized anode and resilient wiper blade arrangement shown in FIG. 19.

FIG. 21 is a side or longitudinal view of one of the wiper blades shown in FIGS. 19 and 20 mounted in a sectionalized anode.

FIG. 22 is a side view of an alternative slotted wiper blade for use in the sectionalized anodes of FIGS. 19 and 20.

FIG. 23 is an isometric view of a preferred mounting arrangement for flanged anodes such as shown in FIGS. 19 and 20.

FIG. 24 is a diagrammatic view of a support or single hanger accommodating both a top and bottom flanged anode arrangement.

FIG. 25 is a side or longitudinal view of an alternative embodiment of a lead coated conductive cooper hanger or harness for the electrode and wiper blade assembly of the invention.

FIG. 26 is a diagrammatic side view of one embodiment of the electrode and wiper assemblies similar to those shown in FIGS. 23 through 25 in use on a line.

FIG. 27 is a side view of a hanger for the electrode and wiper blade arrangement shown in FIG. 25.

FIG. 28 is a sectional side or longitudinal view of an alternative flanged anode construction in accordance with the invention.

FIG. 28A is a sectional transverse view at right angles to the view in FIG. 28 of the alternative flanged anode arrangement.

FIG. 29 is a diagrammatic oblique view of the an alternative wiping blade arrangement in accordance with the invention.

FIG. 30 is a top view of one of the perforated flanged anodes shown in FIG. 29.

FIG. 30A is a diagram showing the staggered arrangement of orifice in the perforated flanged anodes shown in FIGS. 29 and 30.

FIG. 31 is a top view of an alternative embodiment of the arrangement of the invention shown in FIG. 29.

FIG. 31A is a diagram illustrating a preferred construction of the arrangement of the invention illustrated in FIG. 31.

FIG. 32 is an elevation of a T-shaped or section wiping blade in accordance with the invention.

FIG. 33 is a cross-section through the wiping blade shown in FIG. 32.

FIG. 34 is an end view of a holder or track for the T-shaped blade shown in FIGS. 32 and 33.

FIG. 35 is a broken away side view of T-shaped wiping blade and track as shown in FIGS. 32 and 33 in use wiping a strip surface.

FIG. 42 is a diagrammatic plan view of an improved embodiment of the perforated anode and chevron wiping blade of the invention.

FIG. 43 is a diagrammatic plan view of an alternative embodiment of the version of the invention shown in FIG. 42.

FIG. 44 is a diagrammatic plan view of an improved arrangement of the embodiment of the invention shown in FIGS. 32 through 36.

FIG. 45 is a side elevation of the modified T-shaped wiping blade used in the embodiment of FIG. 44.

FIG. 46 is a diagrammatic oblique view of the modified version of the T-blade shown in FIG. 45 arranged in the form it takes as shown in FIG. 44 with the blade mounted in the holders or tracks for such T-shaped section.

FIG. 47 shows a transverse section of the flexible, resilient slit T-section blades with a surrounding track for use in arrangements such as shown in FIGS. 44 and 46.

FIG. 48 shows a transverse section of an alternative version of the T-section blade with surrounding track for use in the arrangement shown in FIGS. 44 and 46.

FIG. 49 shows a transverse section of a still further alternative version of the T-section with surrounding track for use in the arrangement shown in FIGS. 44 and 46.

FIG. 59 is a cross-section through an alternative wiper blade having a so-called "beaded" or round-headed design.

FIG. 60 is a cross-section through the beaded design of FIG. 59 mounted in a holder or track.

FIG. 61 is a cross-section through a related design and track for a wiping blade having a teardrop configuration.

FIG. 63 is a longitudinal cross section of beaded wiping blades and tracks as shown in FIGS. 59 and 60 in use wiping a strip surface.

FIG. 63 shows a transverse section of the flexible, resilient beaded blades with a surrounding track for use in arrangements such as shown in FIGS. 44 and 46 as well as FIG. 68.

FIG. 64 shows a transverse section of an alternative version of an L-section blade with further alternative version of the L-section surrounding track for use in the arrangement shown in FIGS. 44 and 46 as well as FIG. 68.

FIG. 65 shows a transverse section of a still further alternative version of a modified brush-type wiping blade.

FIG. 66 is a side elevation of the modified brush-type wiping blade shown in FIG. 65.

FIG. 67 is a bottom view of the modified brush-type wiping blade shown in FIGS. 65 and 66.

FIG. 68 is an isometric view of an anode assembly for supporting a combined upper anode or cathode and wiping blade assembly using any of the wiping blade arrangements shown in FIGS. 59 through 61 or particularly, FIGS. 63 through 67.

FIG. 74 shows a top or plan view of an alternative version of a honeycomb or grid-type wiper having a thickness sufficiently restricted so that the structure is bendable into a curve or a coil.

FIG. 75 is a side section of the coilable grid-type wiper shown in FIG. 73.

FIG. 76 is an isometric view of an electroprocessing line making use of the form of flexible open or grid-type wiper shown in FIGS. 74 and 75, but having a grid pattern similar to that shown in FIG. 76.

FIG. 77 is a cross-section of FIG. 76 along the section line 77—77.

FIG. 78 is an alternative geometrical form of flexible open structural or grid-type wiping blade similar to that shown in FIG. 74, but with a diamond pattern similar to that shown in FIG. 78 rather than the square or oblong pattern shown in FIG. 74.

FIGS. 79 and 80 are two further alternative pattern geometrical forms of flexible open structural wiping blade similar to that shown in FIGS. 74 and 78, but with respectively generally hexagonal and triangular patterns rather than the square or diamond shapes shown in FIGS. 74 and 78, respectively.

FIG. 91 is an isometric view of an electrode and wiping blade assembly for wiping the bottom of a strip.

FIG. 92 is an isometric view of an alternative electrode and wiping assembly for wiping the bottom of a strip passing across it using an open-web, plastic mesh wiper.

FIG. 93 is a transverse cross section through an arrangement such as shown in FIG. 92.

FIG. 94 is a transverse cross section through an alternative arrangement similar to FIG. 93.

FIG. 95 is a plan view of a still further version of an electroprocessing assembly showing a series of independent drop arms and attached electrode assemblies.

FIG. 96 is a diagrammatic transverse section through and arrangement similar to that shown in FIG. 95.

FIGS. 97, 98 and 99 illustrate an improved mounting arrangement for an extended dressable flexible wiping blade.

FIG. 102 is a partially broken-away diagrammatic side view of an electrolytic coating assembly using a soluble anode material for coating the bottom of a strip and having displaceable flexible wiping blades disposed at intervals along the arrangement.

FIG. 103 is an enlarged transverse cross section through one of the wipers shown in FIG. 102.

FIG. 104 is a diagrammatic side view of an alternative coating and wiping system involving the use of rotating segmented electrodes.

FIG. 105 is an enlarged longitudinal cross section through one of the segmented circular electrodes shown in FIG. 104.

FIG. 106 is an enlarged longitudinal cross section through an alternative arrangement of one of the segmented circular electrodes of FIG. 104.

FIG. 107 is a further enlarged longitudinal cross section through a further alternative arrangement of one of the segmented circular electrodes shown in FIG. 104.

FIG. 108 is a diagrammatic side view or elevation of a coating arrangement such as shown in FIG. 104 which is adapted for coating on both sides of the strip.

FIG. 109 is a diagrammatic side view of an alternative rotatable electrode coating arrangement in accordance with the invention using a soluble cylinder of plating metal.

FIG. 110 is a diagrammatic longitudinal cross section through a portion of electroprocessing line making use of both flexible wiping blades and open-web, plastic mesh in combination.

DESCRIPTION OF THE PREFERRED EMBODIMENTS

Figure 1A:
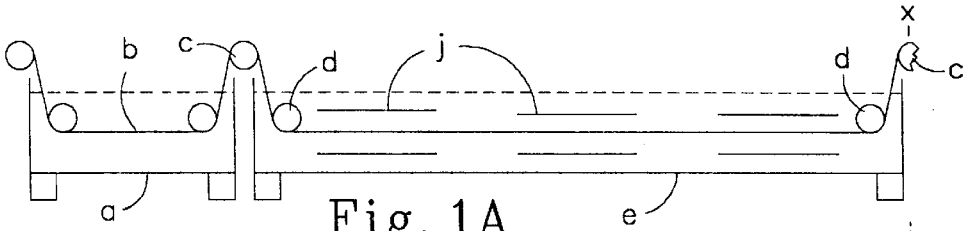
Fig. 1A Prior Art
FIGS. 1A and 1B are diagrammatic elevations of interconnected central portions of a typical electrolytic coating line wherein the improvements of the present invention may be used.

Various ways of removing hydrogen bubbles from the surface of a cathodic workpiece in an electrolytic coating bath or operation have been developed in the past which have in aggregate been effective to a certain limited extent, but which have left room for improvement. Likewise, various expedients to prevent electrolyte solution depletion have been developed to make sure that electrolytic coating solutions remain continuously fresh and ready to be plated from at their design composition. Most of such systems or developments have depended upon frequent changes of the electrolyte, forced circulation by pumps and the like during coating and frequent or continuous analysis of the electrolyte.

Likewise, it has been realized for many years that the rapidity and quality of electrolytic coating could be, at least theoretically, increased by spacing the electrodes as close to the workpiece surface to be coated as possible without breaking down the insulative quality of the intervening electrolytic solution and causing arcing between the electrodes and the workpiece, thereby damaging both the coated surface and the electrode itself. Where both the workpiece and the electrode are rigid pieces, such as in the coating of shafts, rolls, rods and the like that can be stabilized in a predetermined position and then rotated or otherwise moved past the electrode at a uniform distance, the choice of such distance may be determined by the relative concentration of the solution, the current density or amperage between the electrodes and the workpiece, the rapidity of movement between the electrode and the workpiece and other factors, plus the breakdown potential of the electrolytic solution. However, in the continuous coating of long lengths of sheet, strip, wire and the like, a further complication occurs in that the flexible material to be coated tends to oscillate or change its path of travel between supports usually over a period progressing to ever larger oscillations, thus forcing the coating electrodes to be more widely spaced from the workpiece to avoid possible arcing between the electrodes and the workpiece with consequent damage to both.

The present Applicants have discovered through careful experimental development that such previous systems can be considerably improved and, in fact, superseded, at least in those cases where there is a substantial extent of flat workpiece surface to be electrolytically coated, by the use of a novel, basically solid wiping blade section having an extended wiping blade surface which resiliently contacts the coating surface and lightly wipes and supports such surface along a relatively narrow line of contact. The arrangement is in its preferred embodiments not unlike that of a wind shield wiper on a car, but in which the cathodic work surface moves past a stationary wiper blade. The wiping blade is usually and preferably attached to or mounted upon an anode construction closely spaced to the cathodic work surface. The wiper blade, as it passes over the coating surface, is resiliently urged toward and against the work surface at one end or side where it dislodges hydrogen bubbles which have collected upon such surface and lightly guides or supports the coated material. The passage of the blade also causes small hydrogen bubbles to coalesce into larger bubbles which are more easily removed or brushed off by the wiper blade or by their own buoyancy spontaneously detached from the coating surface. It is also believed that the passage of the wiping blade causes the so-called cathodic layer or film, which is, it is frequently assumed, composed of a thin film of a mixture of uncoalesced hydrogen atoms and hydrogen or hydronium ions, to be partially dislodged and caused to also coalesce into small bubbles of hydrogen, whereupon such small bubbles further coalesce under the influence of the wiping blade either during the same passage or a subsequent passage of the wiper blade and are ultimately also displaced by the wiper blade. In those coating processes, furthermore, where the coating tends to send out or develop dendritic tendrils or processes from its surface, the wiping blades very effectively sever such dendritic material which, if not removed, has a preferential tendency to rapidly elongate or grow because it is closer to the anode and thus causes uneven coatings.

The wiper blade also, it has been discovered, very effectively causes rapid change or replacement of electrolytic coating solution next to the coating surface and, therefore, prevents depletion of the electrolyte which interferes with efficient and rapid coating and, in fact, may in many cases, cause not only uneven coating, but also otherwise defective coatings. As a workpiece passes through a coating tank or other solution container, it tends to carry along with it a thin layer of electrolyte which is separated from other electrolyte in the tank by a more or less definite boundary, which, while usually more or less turbulent, may transfer electrolyte across the boundary rather slowly. Since the plating out of the electrolytic coating takes place more or less exclusively from the thin layer adjacent the cathodic work surface and such layer is partially isolated or separated from the remainder of the electrolyte by the boundary established between the moving surface layer and the static main body of electrolyte, such thin layer rapidly becomes partially depleted of coating metal, inherently causing slower plating as well as other difficulties. A continuous coating operation, in fact, may establish an equilibrium in which actual plating is continuously being made from a partially depleted layer of electrolyte in which the concentration of coating metal is significantly less than in the rest of the electrolytic coating bath and not at all what analysis of the bath may indicate. It has been found that the wiper blades of the invention effectively cure this local depletion phenomenon and cause a substantially complete replacement of electrolytic solution next to the coating surface every time it passes a wiper blade. In this way, what may be referred to as the depletion layer, or barrier layer, is periodically and rapidly, depending upon the spacing of the wiper blades and the speed of the underlying cathodic coating surface, completely changed or replaced so that over a period, substantial differences between the analysis of the depletion layer and the analysis of the electrolytic coating bath as a whole does not develop resulting in a considerable increase in coating efficiency.

As the resiliently biased wiping blade passes over the cathodic coating surface, it flexes upwardly or outwardly so that it rides easily over the surface being coated or over increasing coating weights or thicknesses of coating, if there is a recirculation of the coating surface under the same blade. In addition, the flexing or resiliency of the blade, which causes it to basically merely lightly contact the surface, prevents such blade from wearing rapidly. The contact of the dielectric blade with the surface of the material being coated is sufficient, however, to damp out oscillations of the material being coated and since the dielectric blades are preferably extended from the anodes themselves, such blades serve very effectively to prevent the cathodic material being coated from approaching sufficiently close to the anode to cause an arc between them.

In a preferred arrangement of the coating blade, it may be attached to or closely spaced to a significantly locally discontinuous anode, such as an anode with fairly large or many small openings in it, a grid-type anode or other discontinuous anode which allows coating solution to flow through the anode both away from the front of the blade as the surface depletion layer approaches the wiping blade and back behind the blade as such blade passes by. In this way, the solution is always being periodically changed. The wiping blade construction of the invention has been found particularly effective in the deposition of chrome from electrolytic solutions, but may also be used in the electroplating of tin coatings, particularly for tin plate or so-called decorative metal coatings such as, in addition to chrome, nickel, cadmium, nickel and copper. Some potentially electroplated coatings such as zinc and the like can usually be more cheaply coated by so-called hot dip coating processes, if heavier coatings are desired, but the process of the invention is very effective for applying thin zinc or the like coatings.

The amount of pressure exerted upon the surface of the cathodic workpiece by the end or side of the wiper blade, which is bent in the same direction as the passage of the work surface, is related to the thickness of the wiper blade in the section contacting the cathodic work surface. The preferable nominal wiper blade thickness will be about 1/32 to 1/4 inch in thickness with a preferable range of about 1/16 to 1/8 and the distance of the cathode surface from the electrode grid, may be between 1/16 to as much as 2 inches, but more preferably within the range of about 1/16 to 1 inch with a most preferable range of ¼ to ⅜ inch. Consequently, the length or height of the wiper blade should be approximately ½ inch to 1.5 inches or thereabouts, depending upon the support arrangement, or in those cases where the spacing between the cathodic coating surface and the anode surface is greater than ½ inch, may be correspondingly greater. It is preferable, as indicated, to maintain a distance between the cathodic workpiece surface and the anode of not more than one inch, but the invention has been found effective up to as much as 2 inches. However, over 2 or 3 inches the efficiency of the plating operation may decline. The wiper blades may be tapered from top to bottom to increase the flexibility of the blade and in these cases the above thickness dimensions apply basically to the portion of the blade contacting the cathodic work surface. The normal bearing of the wiper blade upon or against the surface of the cathodic work surface will, therefore, be rather light and insufficient to burnish or polish the surface, but sufficient to detach any dendritic material extending upwardly into the bath from the cathodic work surface and to cause evolution of hydrogen bubbles from the surface and also sufficient to effect a significant guidance to the workpiece to prevent or damp out oscillations. It appears that the evolution of the bubbles involves more than mere detachment of bubbles already formed, but also involves a coalescence of very small or minute hydrogen bubbles upon the surface as well as in the form of a thin cathodic film, first into very minute bubbles and then rapidly, under the influence of the repeated contact with the wiper blades as the workpiece passes along the coating line, into larger bubbles which are displaced from the surface of the workpiece and rise through the liquid effectively removing them from the vicinity of the strip surface.

Since the wiper blades are very thin and preferably only the side of the end of the blade contacts the surface, only a minimum contact of the blade with the surface is involved so that a minimum interference with actual coating upon the surface occurs. Furthermore, since the-wiper blades are very thin, in any event, and are made from a dielectric material, such blades have a very minimum interference with the electrical field between the anode and the cathodic work surface and thus minimum interference with the throwing power of the electric field during the coating operation.

The present inventors have also now found that some variations of their flexible wiping blade may be used. For example, it has been found that an open-web, plastic mesh may be used. This plastic mesh construction may be either more or less uniform in cross section through the webs or may be flattened transversely through the webs so as to be more effective as a wiper. In some cases, the plastic mesh may have actual wiping blades extended from the side which are drawn across the surface of the strip. The plastic or dielectric mesh may be from one sixteenth to one-quarter inch in thickness with a less preferable range of from one thirty-second to three-eights of an inch and should, of course, be formed from a plastic that will not be degraded by an electrolytic solution. The relationship between the amount of open area in the mesh and the thickness of the webs is important since there should not be too much area of the strip closed off by the plastic, because this decreases the coating rate, yet there should be sufficient plastic to act as an effective dielectric separator between the strip and the adjacent electrodes to effectively prevent the strip surface from arcing with the electrode. Also in those electrolytic coating processes using soluble electrodes from which insoluble contaminants may be derived, the size of the mesh of the plastic web should be sufficiently restricted to prevent the usual fine filter cloth bag or sock with which the electrodes may be effectively enclosed, extending through the orifices in mesh and possibly catching on small imperfections on the strip and tearing or otherwise being damaged. In general, it is believed the mesh size, which largely determines the open area of the plastic mesh, should preferably constitute from seventy-five to ninety-five percent of the mesh. However, the open area can be as low as fifty percent of the mesh particularly, it is believed, if the plastic mesh is very thin. There is, however, a rather complex relationship between the amount of solid web in the mesh and the web opening area including the cross-sectional dimensions of the plastic mesh material. The aim, however, is to have as much unoccluded area, i.e. open area, as possible in order not to interfere with direct access of the current from the electrode to the coating surface any more than absolutely necessary and at the same time to allow the strip to approach the electrodes as closely as possible in order to increase the efficiency and rapidity of electroplating. At the same time, however, the electrodes and strip should not be so closely spaced as to allow arcing between the two, taking into account the breakdown potential of the particular electrolyte and the likelihood that, if a filter cloth is used about the electrode to filter out or retain insoluble contaminants, that such filter cloth may protrude through the mesh sufficiently to touch inequalities on the strip and be ripped or otherwise damaged.

Figure 1B:
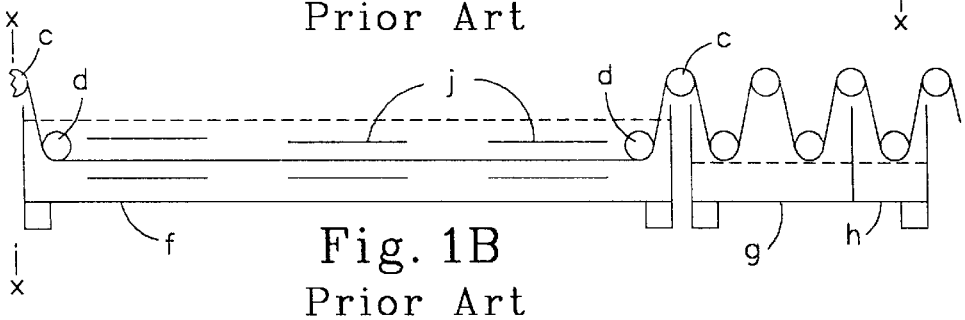
Fig. 1B Prior Art

FIGS. 1A and 1B are diagrammatic elevations of portions of the general arrangement of a typical prior art electroplating line in which the present invention may be used to increase the effectiveness and speed of the coating process as explained hereinafter. Commercial electroplating lines typically include a first payoff reel, or uncoiler, from which strip or sheet to be plated is paid off followed by buffing and cleaning operations plus any necessary or desirable bridles and looping towers, or accumulators to maintain a continuous strip supply plus tension in the strip. This apparatus is followed by rinsing tanks from which the strip or sheet is conducted through one or more plating tanks, through further rinsing operations and any special surface coating or finishing tanks and then recoiled or rewound, aided frequently by additional bridle rolls and looping towers, or accumulators. Plating may be accomplished in a straight through mode or in consecutive vertical runs over closely spaced vertically displaced guide rolls. FIGS. 1A and 1B show the central plating sections of a single dual tank straight through coating operation in which a rinsing tank "a" receives strip "b" to be coated from previous operations, not shown, and from which strip "b" is guided over contact guide rolls "c" through which electrical contact is made with the strip "b" and idler guide rolls "d" which guide the strip "b" into and through dual electrocoating or electroplating tanks "e" and "f" and then is conducted into further combined rinse and antitarnish coating sections "g" and "h" from which the strip "b" is then conducted to subsequent treatment and handling operations, not shown. While passing through the plating tanks "e" and "f" the strip "b" passes adjacent to or between a series of dual top and bottom anodes "j" which may be either consumable or nonconsumable depending upon the coating operation. The electrodes are desirably fairly closely and equally spaced from the strip "b" as shown to increase the plating speed and prevent differential coating, but must be maintained sufficiently spaced from the strip to prevent any chance of arcing between the cathodic strip and the anodes with resultant damage to both the strip and the anode. In general, the longer the unsupported run between guide, or idler, rolls in the plating tank or tanks, the more likely a flutter or deviation in travel of the strip will bring it too close to an anode surface and result in arcing. However, multiplication of guide rolls, while steadying the strip, also interfaces with coating. While two electro coating tanks are shown, any number from one to a substantial number of plating tanks can be used, depending upon construction and design of the line. The improvement of the present invention has to do with the coating apparatus including the anodes submerged within the electrocoating tank or tanks and is particularly directed to the use of resilient plastic wiping blades to periodically wipe the surface of the strip, preferably in combination with the use of perforated anodes mounted adjacent to the strip which is being electrocoated.

As indicated above, the present inventors have also found, that their basic apparatus and method has broader application than just to electrocoating and can, in fact, be applied to other types of electrochemical treating operations and particularly to anodizing. The operation and use of the invention in anodizing is very broadly similar to its use in electroplating except that in anodizing the workpiece is the anode and the adjacent electrodes are cathodes. In addition, the gas which occludes the workpiece surface in anodizing is oxygen rather than hydrogen, although hydrogen may be a problem at the cathode. Also, since an oxide is a dielectric which takes significant energy to drive a current through and the electrolyte is not depleted during anodizing, but instead heated severely at the interface with the anodizing coating, the problem with a layer of electrolyte being pulled along with the strip is that of heating severely the immediate electrolyte rather than depleting the electrolyte. However, the problem is still that a thin layer of electrolyte is being drawn along with the strip or workpiece and the wiping blades of the invention have been found to be eminently effective in deflecting this heated layer away from the strip in the same manner as a depletion layer. Furthermore, in anodizing, just as in electroplating, it is is desirable to space the electrodes as close to the surface of the workpiece as possible and the stabilizing action of the thin plastic wiping blade is equally effective in stabilizing a flexible strip beingnodized as a flexible strip being electroplated and, therefore, in allowing the surrounding electrodes to be brought as close as possible to the strip surface with a very major saving in energy.

Figure 1C:
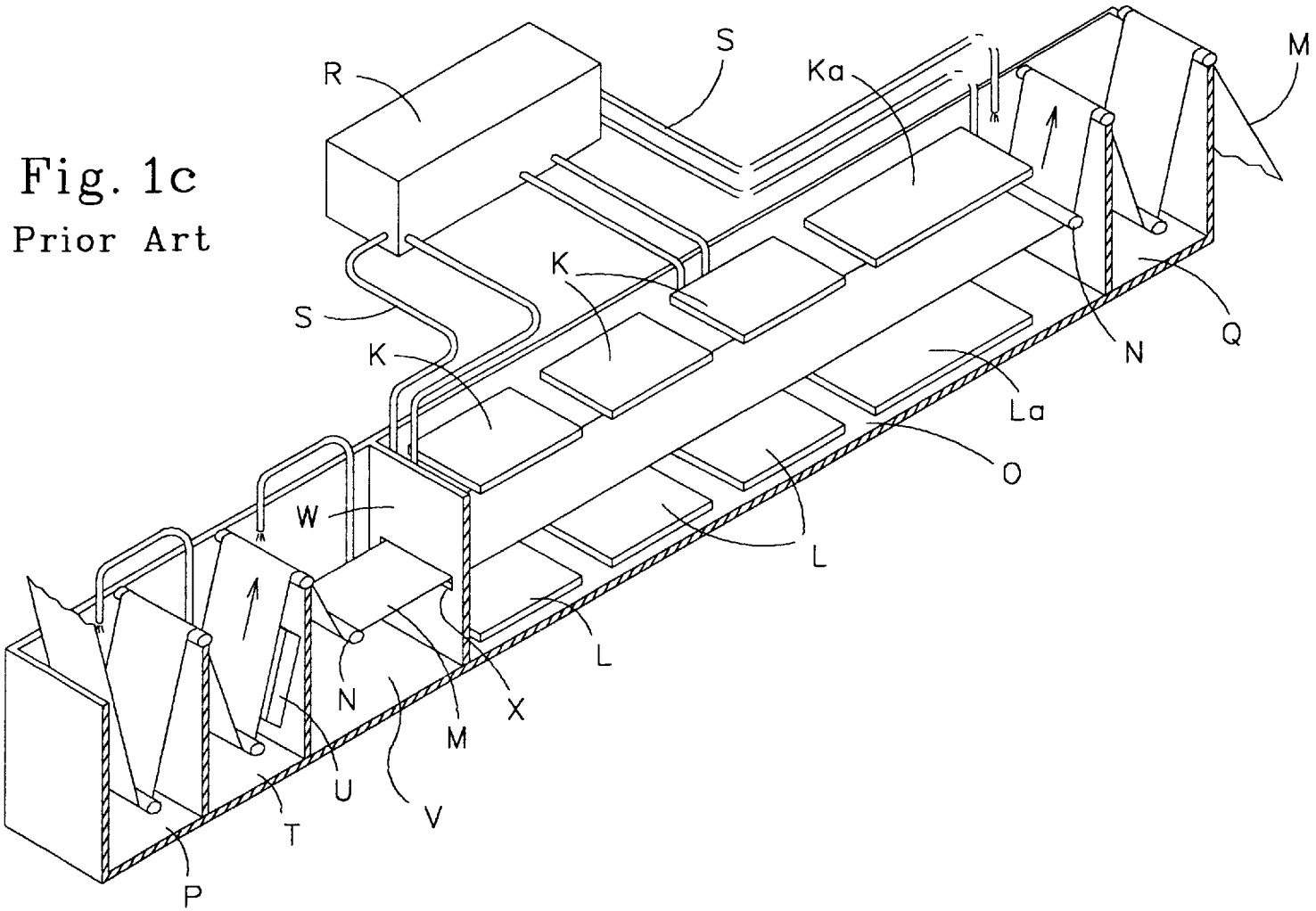
Fig. 1c Prior Art
FIG. 1C is a diagrammatic isometric view of a typical anodizing line wherein the improvements of the present invention may be used.

FIG. 1*c* is a partly broken-away isometric view of a typical prior art continuous anodizing line which includes typically a series of electrodes or cathodes "K" and "L" mounted above and below a strip "M" which passes over guide rolls "N" at both ends of the anodizing tank section "O" of the operation. It is frequently the practice in anodizing lines to have a series of physically separate cathodes mounted at intervals above and below the strip often with decreasing spacing between the adjacent cathodes in a longitudinal direction within the anodizing tank section of the line. In FIG. 1*c*, the last set of cathodes "Ka" and "La" are longer than the preceding electrodes in the anodizing section. The anodizing section of the line is preceded usually by a cleaning section tank "P" and followed by a sealing section "Q" and then a rinse station, not shown. A cooler "R" is attached to the electrolyte tank to continuously cool the electrolyte which is continuously recirculated by a series of conduits indicated generally "S".

A so-called contact cell "T" where the strip or web is initially immersed in electrolyte and rendered anodic by induced current either through a charge on the walls of the tank, by grids, not shown, spaced from the web, or, in the case shown, by a lead or graphite anode "U" which is connected to the positive terminal of a power source, not shown, the negative terminal being connected to the cathodes "K" and "L", such conventional connections also not being shown. In some installations, actual contact rolls are provided to initially render the web anodic. However, contact rolls must contact the strip while dry and tend to arc when the strip separates from the roll with resultant burning of the surfaces of both.

A so-called baffle section "V" of the anodizing tank first introduces the strip or web to the electrolyte in the anodizing section separated by a baffle "W" with a slit "X" for entrance of the web to the main section of the anodizing tank "O" where the cathodes "K" and "L" are adjacent to the strip. A uniform very thin layer of oxide is started on the web in the baffle section "V" before the web is exposed directly to the cathodes in the main anodizing section where the current builds up a heavier oxide coating.

Figure 2:
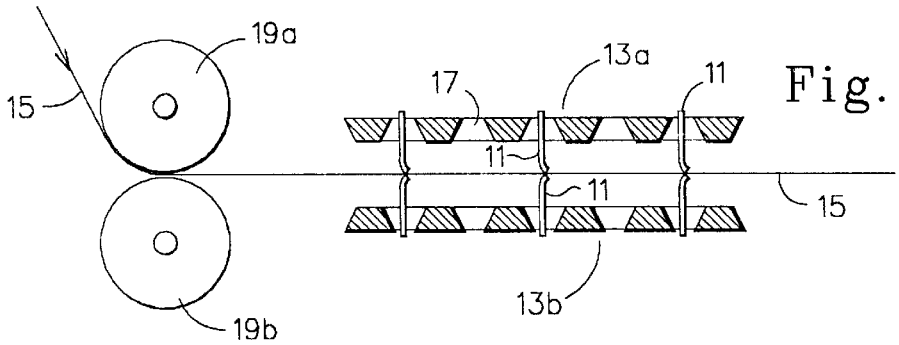
FIG. 2 is a diagrammatic partially sectioned side view of a portion of a continuous plating line showing the use of the dielectric wiping blades of the invention.

FIG. 2 is a diagrammatic side view of a basic embodiment of the invention in which a series of wiping blades 11 are mounted in a pair of grid-type anodes 13*a* and 13*b* positioned on the top and bottom, respectively, of a continuous strip 15 which passes between two pinch-type guide rolls 19*a* and 19*b*. The upper and lower anodes are perforated with openings 17 which allow for passage of electrolytic solution through them to reach the surface of the cathodic strip 15. The strip is guided by the guide rolls 19, only two of which are shown, and it will be understood there will normally be additional guide rolls as well as anodes beyond those shown as illustrated in FIGS. 1A and 1B. The ends of the wiper blades 11 are flexed against the surface of the strip as shown so that a light pressure is exerted against the strip, aiding in guiding it as well as wiping bubbles of hydrogen from the strip surface. The guide rolls 19*a* and 19*b* are customarily mere idler rolls and in many cases the idler roll 19*b* may be dispensed with.

Figure 3:
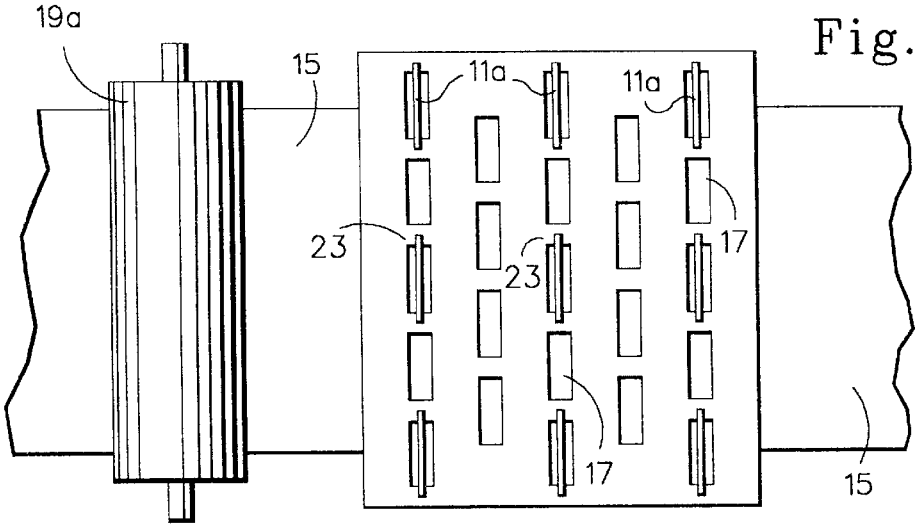
FIG. 3 is a diagrammatic top view of a portion of the continuous plating line shown in FIG. 2.

FIG. 3 is a diagrammatic top view of the arrangement shown in FIG. 2 in which the tops 11*a* of the wiping blades 11 are shown protruding partially through oblong or rectangular openings 17 in the anode 13*a*. The rectangular openings 17 are, as shown, preferably staggered or overlapping so that any given portion of the strip surface will not pass adjacent to a series of openings while adjacent portions pass always adjacent to solid portions of the anode, but will alternate regularly between open and solid sections of the anode.

Figure 4:
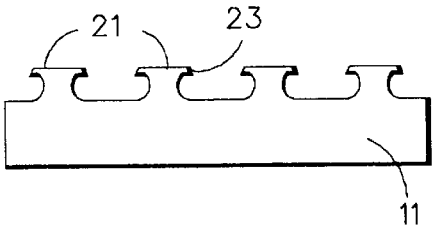
FIG. 4 is a side view of one embodiment of the wiper blades shown in FIGS. 2 and 3.

Preferably the top of the coating blades shown in FIGS. 2 and 3 are made, or formed, as shown more particularly in FIG. 4. It will be seen in FIG. 4 that the upper portion of the wiper blade is formed into a series of expansion-lock or snap sections 21 having outwardly expanded tops 23, which may be jam-fitted into the openings or orifices 17 of the grid-type anodes 13*a* and 13*b*. This construction allows the wiper blades to be quickly interlocked with the anode grid and to be simply and easily removed when the wiper blades 11 become worn and need to be replaced by new wiper blades. Normally the wiper blade 11 will be made by stamping out a series of the blades with the expanded top sections already formed upon them. However, it will be understood that various sections or shapes of the portion of the wiper blade which holds such blade in place may be formed depending upon how it is desired to attach the wiper blade to either the electrode, i.e. the anode, or to some other portion of the apparatus. FIGS. 5 through 11 discussed hereinafter show one very effective alternative arrangement for fastening, and FIGS. 19 through 23 show a very desirable alternative. It has been found, however, that the wiper blades 11, however mounted, tend by their passage to coalesce very small bubbles into relatively larger bubbles which detach from the strip and float upwardly. It will be noted in both FIGS. 2 and 3 that the wiper blades 11 are spaced at fairly small intervals along the strip within the anodes. With the use of a series of blades fairly closely spaced, the first blade of a series contacted by a strip wipes away or dislodges large bubbles and tends to coalesce smaller bubbles into larger, which are then immediately wiped away or dislodged by the second closely following blade. In such case, however, there should be at least one other set of wiper blades. This is desirable because the dielectric wiper blades serve not only to wipe hydrogen bubbles from the coating surface and to interrupt passage of a surface layer of electrolyte about the workpiece but also to aid in centering the workpiece within the anodes to prevent the surface of the anode and the surface of the workpiece from too close approach and arcing with consequent damage to both the workpiece and the anode.

The wiper blades should be spaced so that bubbles of hydrogen, in particular, are wiped from the surface before any significant deposit or collection of such bubbles has been allowed to form. Consequently, the spacing of the wiper blades will be dependent to some extent, upon the line speed or passage of the workpiece and the rate of coating deposition, since a higher rate of coating, occasioned by a high current density between the electrodes will also normally form more hydrogen by electrolysis of the coating solution. Consequently, if the passage of the workpiece is rather slow, more wiper blades may be desirably spaced along the plating cell of the electroplating line. In FIGS. 2 and 3, the grid-type anodes 13*a* and 13*b* are shown with the wiper blades 11 inserted into the anode orifices 17 and bearing lightly upon the surface of the sheet metal substrate or strip 15 to both remove bubbles of hydrogen and also sever and remove any outwardly growing dendritic material extending from the coating surface. Such dendritic material will become a problem, which is neatly eliminated by the wiper blade of the invention, in certain electrolytic coating processes such as the electrolytic coating of chromium and the like on a cathodic work surface, for which the use of the wiper blade of the invention has been found to be particularly applicable, although such wiper blades are clearly applicable to the electrolytic coating of other metals as well.

FIG. 3, as explained above, shows an overlapping lapping or staggered pattern of orifices or openings in the perforated anodes so that instead of such electrodes 13*a* and 13*b* being orientated generally in the direction of the movement of the continuous strip through the apparatus, the openings are displaced transversely of each other. This ensures a continuously changing coating pattern as the cathodic workpiece passes between the grid-type electrode. When using regularly oriented grid-type electrodes, for example, certain parts of the cathodic workpiece being coated tend to remain under portions of the grid for greater periods than other sections, and this may tend to cause differential coating thicknesses across the width of the sheet, possibly requiring additional later treatment to even out the coating thickness. By overlapping the grid orifice pattern, however, the opportunity of the substrate surface to remain under an actual grid portion will, on the average, be evened out from one portion of the surface to another and a more even surface coating deposit will result. Of course, some patterns of grid orifices will be found more efficient than other patterns. For example, if the angle selected of one orifice displacement with respect to a following or adjoining orifice is 45 degrees, there may again be a tendency for certain portions of the cathodic work surface to, on the average, remain under an actual portion of the grid for longer average periods in the aggregate. However, if an exemplary angle between 45 degrees and 90 degrees is selected to provide the maximum similarity and average times of coverage by the electrode sections of any given series of adjacent portions of the work surface, a smooth uniform coating will be attained. The angle should also be arranged so that the jam-type interconnecting portions 21 of the wiper blades 11 can be conveniently forced into an opening between the grid members of the electrode. If a regular sequence of openings which will both hold the jam fittings of the wiper blade and also cause a random coating pattern with respect to any given time that the workpiece passes under any given portion of the coating electrode grid cannot be worked out, an alternative support for the wiper blades can be devised. It is possible, for example, for some of the jam-type interconnections to be removed where they may abut closed portions of the electrode grid rather than open portions, since it has been found that the jam-type interconnections are sufficiently strong so that a maximum number of interconnections between the wiper blade and the grid-type electrode through such jam-time interconnections is not usually necessary. Rather than angling a regular grid-type electrode, as shown in FIG. 2, the electrode itself can be made with random elements, so that there will be no regular pattern of passage of the electrode surface past the rapidly moving cathodic sheet metal substrate surface. Various other arrangements for supporting the wiping blade may also be provided.

The substantially solid wiper blade of the invention is used very effectively with the electrolytic coating of continuous elongated cathodic workpieces such as, for example, so-called continuous strip and sheet wherein the metal substrate is passed through an electrolytic coating bath containing an electrolyte containing dissolved ions of the metal to be plated out on the substrate. Large tonnages are produced, for example, of tin and chromium coated steel sheet and strip referred to respectively as tin plate and tin free steel or TFS, which has a very thin coating of electrolytically applied chromium plus chromium oxide applied to its surface. These coatings are made in either a straight pass through very long plating tanks such as illustrated in FIGS. 1A and 1B or in a multiple vertical pass line over guide rolls within a plating line. The outer oxide surface is applied by varying the coating conditions.

Normally, the cathodic workpiece and the anode are maintained a fair distance apart in such lines depending upon the support of the strip to prevent touching or very close approach of the cathodic workpiece to the anode, which close approach may cause arcing with serious consequences not only to the strip, but also the the anode. The longer an unsupported length of strip that is passed by the anode, the greater chance for substantial deviation of the strip from its pass line and possible impingement upon the anode. A multiple vertical pass line arrangement over support rolls in the coating bath offers more support usually as well as additional pass line compressed into a coating tank of any given length and has been frequently used on this account. However, even a multiple vertical pass line arrangement is subject to possible swaying or vibration of the strip passing between the guide rolls and the distance of the strip from the cathodic work surface is thus seldom maintained less than about one to one and a half inches from the anodes on both sides, although specialized installations having a closer gap have been used. The present inventors have found that by the use of their dielectric material wiping blade, they are able to not only efficiently wipe hydrogen bubbles from the cathodic coating surface as well as effectively sever dendritic material extending from the surface in the case of a thicker coating, but also to very effectively wipe any surface layer of partially depleted coating solution from the coating surface, thus effectively preventing depletion of the coating solution next to the cathodic coating surface, but in addition by the use of their wiping blades, are enabled to steady or guide the strip traveling past the anode and thus prevent too close an approach and arcing between the anode and the strip. By the use of the thin dielectric blade of the invention serving as a guide blade, therefore, closer spacing of the anodes to the continuous strip may be had with a resultant increase in throwing power.

Figures 5A, 5B, 7, 8, 16, 17, 18:
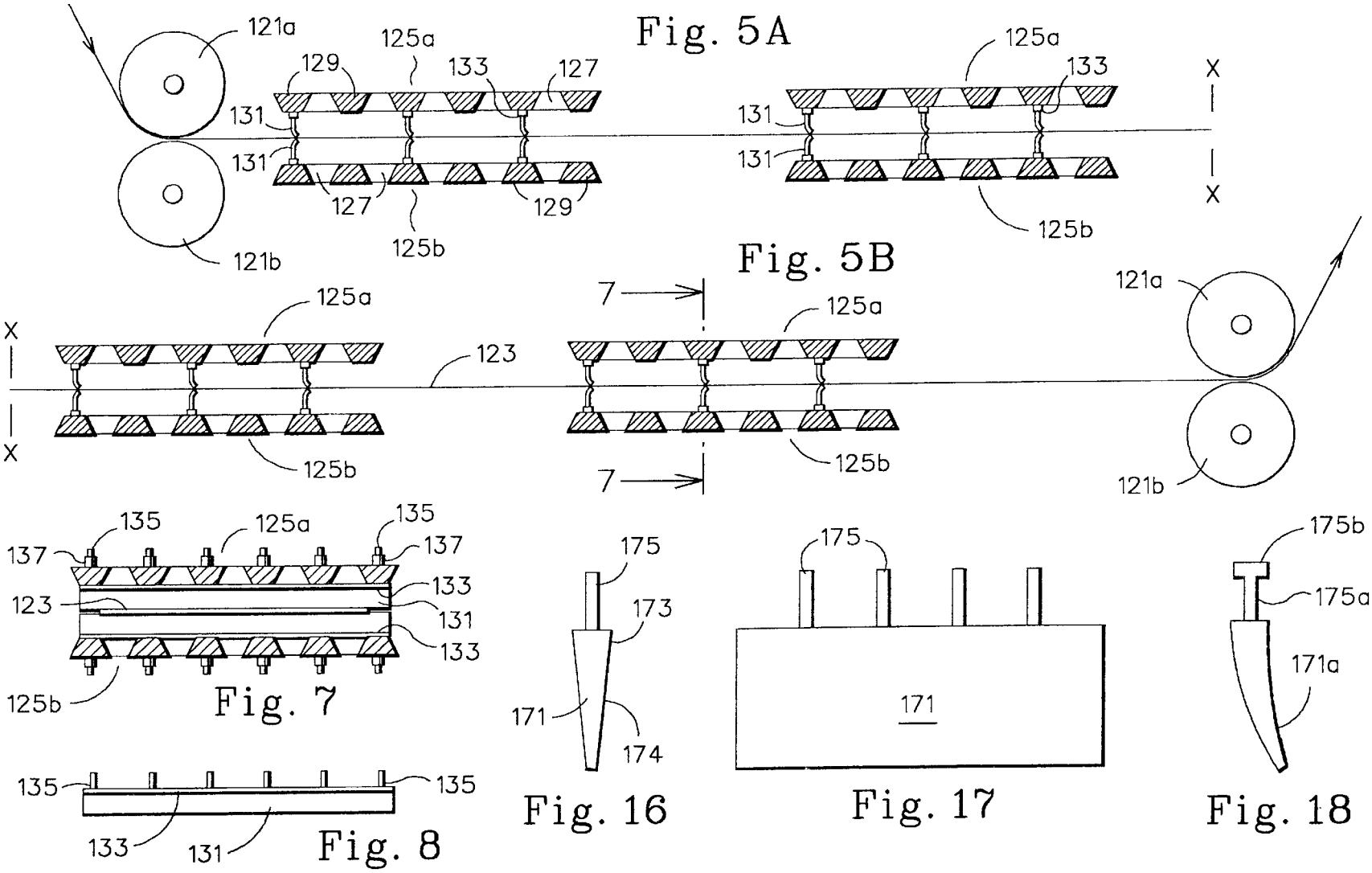
FIGS. 5A and 5B are diagrammatic elevations of a continuous plating line equipped in accordance with the invention with an alternative form of the wiper blade of the invention.
FIG. 7 is a transverse section through the portion of the continuous coating line of FIG. 5B at 7—7.
FIG. 8 is an enlarged view along the length of one of the wiper blades used in the continuous coating line shown in FIGS. 5A through 7.
FIG. 16 is an end view of an alternative tapered wiping blade in accordance with the present invention.
FIG. 17 is a side or longitudinal view or elevation of the tapered wiping blade shown in FIG. 16.
FIG. 18 is an end view of an alternative tapered construction wiping blade in accordance with the invention.

FIGS. 5A and 5B are diagrammatic side elevations of a so-called tin-free steel, or "TFS" line, for coating blackplate with a thin, almost flash coating of chromium plus chromium oxide. The chromium oxide is usually applied in a different cell or tank. Guide rolls 121*a* and 121*b* and 122*a* and 122*b* convey a strip 123 of blackplate, i.e. uncoated steel strip or sheet material, straight through a tank, not shown, in which the coating operation is confined in a body of electrolyte between pairs of anodes 125*a* and 125*b* formed in a grid configuration with longitudinal elements 127 and transverse elements 129 shown in section. As shown, the individual members or elements of the grid-type electrode have a truncated triangular shape slanted toward the strip surface and providing additional surface area to increase the anode surface area exposed to the electrolytic solution particularly in the direction of the workpiece or strip surface, assuring at least a 1.5 to 1.0, or greater, anode to strip surface ratio. The top anodes 125A and bottom anodes 125B are spaced within about one half to three quarters of an inch of each other with the strip 123 passing between them. Alternating transverse elements of the anodes are provided with resilient plastic wiper blades 131 which are attached to or mounted upon such transverse elements as shown, by essentially threaded plastic fittings, but could be mounted in the openings of the grid equally well, as shown in FIGS. 2 and 3. As in the previous views of other embodiments, the wiper blades are slightly longer than the space between the strip surface and the anode surface so that the blade is partially flexed during continuous plating operation. It is believed preferable for the blade to be flexed just sufficiently to enable its end or side to ride upon the surface to be coated along one edge. In other words, the wiper is preferably cut straight across at the bottom so that when flexed, it rides with an edge or corner of one side against the strip surface and wipes off all bubbles of hydrogen as well as any thin cathodic layer which tends to form. The coating in a continuous coating line is not usually sufficiently thick for dendritic material to begin to grow or extend from the surface. However, if the electrolytic coating is one upon which dendritic material tends to grow from the surface, the edges of the blades also very neatly shear off such dendritic material so it does not interfere with the uniformity of coating. However, as noted, in the coating of continuous black plate or strip, the coating usually is not allowed to become thick enough for any dendritic material to form. The principal function of the wiping blade, therefore, in the process shown in FIGS. 5A and 5B is first to detach bubbles of hydrogen from the coating surface, second to divert any thin electrolyte depletion layer or film that may otherwise tend to travel along with the strip and third, to offer resistance to oscillations of the strip or to guide the strip between the coating electrodes. Thus, as a thin surface layer of electrolyte travels through the apparatus with the strip, it contacts the stationary wiper blade which is resiliently held against the strip with sufficient force to prevent it from being displaced or lifted away from the strip by the force of the electrolyte being carried or dragged along with the moving strip, but not with such force that it will not be easily lifted by the coating building up on such strip in order to prevent the coating from being damaged by the wiper blade. The stationary wiper blade thus diverts or displaces away from the surface of the strip the thin layer of electrolyte that is usually carried along with the surface of the moving strip. The displaced layer of coating solution is displaced not only sidewise along the blade, but also partially upwardly through the openings in the anode grid in front of the wiper blade. At the same time, fresh solution enters the space between wiper blades from the sides and also from the top through the openings in the electrode grid behind the blade. If the anode is more than a few inches wide, the entrance of electrolyte from the side would not be sufficient to prevent cavitation or temporary and fluctuating open spaces behind the blade and it is, therefore, important that the wiper blade be used in combination with a perforated anode, particularly as the opening or clearance between the perforated anode and the metal substrate or strip is only on the order preferably of about one quarter to three eighths of an inch in order to attain maximum efficiency. The thin dielectric flexible or resilient blade also very effectively stabilizes the position of the strip with respect to the anodes.

The wiper blades 131 are shown in FIGS. 5A and 5B as having an upper mount 133 into which they extend or which is integral with the blade itself and such upper mount is then attached, preferably directly to the anode, by threaded fasteners which may pass through fastening openings in the anode and may be secured with a threaded nut. It is preferred to have the upper mount 133 made from the same electrolyte-resistant dielectric plastic and to have the threaded fastener 135 in the form of a stud made from the same plastic material or other plastic material which may be threaded into the upper mounting block on one end and have the other end passed through an orifice in the lead or other composition anode and secured by a threaded nut 137 as shown most clearly in FIG. 7.

Other forms of securing mechanism or means for the wiper blades can be used, such as, for example, the interengagement means shown in FIGS. 2 and 3 which comprise partially expanded jam fit means which may be an integral part of the upper section of the blade material itself. The expanded sections 23 shown in FIGS. 3 and 4, of course, operate best if the openings in the grid-type electrode are approximately the same size both longitudinally and transversely as the dimensions of the snap-type jam fittings on the blade itself. Since the material of the blade is desirably rather thin in order to attain satisfactory flexibility in a short length, such as the close spacing of the cathodic workpiece and anode surfaces demands, an orifice in the anode both large enough to provide the necessary electrolyte flow from top to bottom and vice versa, may be difficult to arrange, particularly if it must also be the correct size for maintaining a secure interlock with the upper portions of the blade. The use of the threaded securing means shown broadly in FIGS. 5A and 5B, and more particularly in FIGS. 5 through 12 described below, thus is desirable, so far as preciseness and non-interference with the openings in and flow of electrolyte through the anode is concerned. A combination flanged sectionalized anode-slotted wiping blade assembly, shown more particularly in FIGS. 19 through 23 described hereinafter, is also very desirable.

Figure 6:
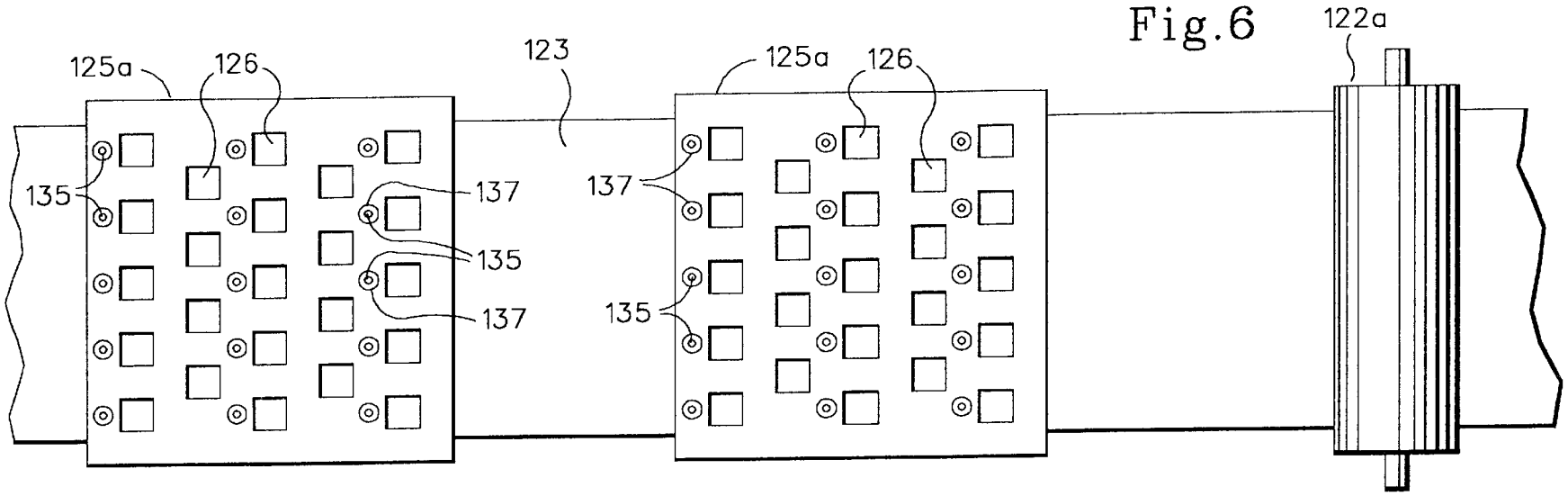
FIG. 6 is a diagrammatic plan view of the portion of the continuous coating line shown in FIG. 4B.

FIG. 6 is a diagrammatic plan view of the arrangement shown in FIG. 5B showing the top of the grid-type electrodes 125*a* positioned over the strip 123 plus one of the guide rolls 122*a* at one end of the plating tank, the tank itself again not being shown. The openings or orifices 126 in the tops of the grid-type anodes are clearly visible as are the tops of threaded fastenings 135 and threaded nuts 137 upon them which hold the upper mounts 133, shown, for example, in FIG. 9, of each of the wiper blades 131 against the lower surface of the upper anode 125*a*. The same arrangement is present upon the upper surface of the lower anode 125*b*, not shown in FIG. 6.

Figure 9:
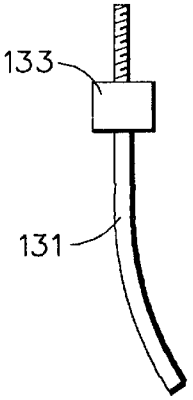
FIG. 9 is an enlarged end view of the wiping blade of FIG. 8.

FIG. 7 is a cross section transversely through upper and lower grid-type electrodes 125*a* and 125*b* as well as the strip 123 along the section 7—7 in FIG. 5B showing the wiping blades of the invention bearing upon the surface of the strip, while FIG. 8 is a side view of one of the wiper blades by itself prior to being affixed in place or secured to one of the anodes as shown in FIG. 7. FIG. 9 is an enlarged end view of the wiper blade 131 and mounting 133 shown in FIG. 8 by itself and shown in FIG. 7 mounted in place in the coating tank, not shown. The coating blade 131 is illustrated in FIG. 9 with the minor flexure which is preferred when the blade is in operative position against the strip, but it should be recognized that the blade will normally, when free standing by itself, as shown in FIG. 9, be straight rather than flexed so that when it is contacted against a surface to be coated, it will exert a small but definite back force against the surface to be coated. Such force should be sufficient, as noted above, to thoroughly remove as well as coalesce hydrogen bubbles clinging to such surface and, it is believed, nucleate into small hydrogen bubbles any cathodic film clinging to or laid down upon such surface. In addition, in the case where there is dendritic material forming upon such surface, the force of the blade should be sufficient to sever, shave off or otherwise remove such dendritic material, while at the same time not bearing upon the surface sufficiently to prevent buildup of the coating and/or to burnish or damage the coating. The degree of force should also be sufficient to prevent the surface layer of liquid electrolyte drawn along with the moving strip from lifting the wiper blade from the surface as the result of the force building up in front of and under the blade, since this would allow the potentially partially depleted surface layer of electrolyte normally drawn along with the strip or other workpiece to pass at least partially under the blade to the opposite side of the wiper blade, rather than being diverted from the surface and replaced by fresh electrolyte flowing in behind the blade as the strip passes under the blade. The wiper blade or dielectric guide blade should also be sufficiently flexible, as explained, to resiliently support the material being coated against transverse oscillations and other movement allowing closer spacing of the anodes to the cathodic workpiece along wider stretches between actual guide or support rolls which otherwise decrease actual electroplating space. The parameters of the resiliency of the blade, therefore, are essentially the generation of sufficient force, due to resiliency either of the plastic itself or of a separate resilient biasing means, to prevent any substantial escape of liquid electrolyte under the blade and to sever thin dendritic processes, if any are present, and to guide and prevent oscillation of the cathodic workpiece, but not sufficient to mar the coated surface or to prevent the necessary buildup of an electrolytic coating of the thickness desired upon the surface. A blade which will resist lifting by the surface layer of fluid will usually also be effective to remove bubbles of hydrogen as well as nucleate smaller quantities of hydrogen into bubbles. An immovable, or non-resilient, blade would simply constrict any upward buildup of coating, a very undesirable situation. An immovable blade would also rapidly wear. The resiliency should also be sufficient to prevent or damp out any substantial oscillation or weaving of the strip between the sets of guide rolls 121 and 122 in a continuous coating line such as shown in FIGS. 5A and 5B and prevent possible touching and arcing of the cathodic workpiece or strip with the anode. Arcing can, of course, also occur if the anodic and cathodic surfaces approach close enough for the potential between the two to break down the natural resistance of the intervening electrolyte except by ion transport of the electric current. It is for this reason also that the wiping blade itself should not be a conductor of electricity or have a low dielectric value and should be sufficiently stiff to provide substantial and effective guidance and directional stability to the workpiece, particularly when in the form of a flexible strip or the like.

While it is preferred to rely upon the resiliency of the narrow, thin wiping blade itself to produce sufficient force to prevent lifting of the blade from the surface of the workpiece by the force of the electrolytic solution upon side of the blade and to maintain the strip centered between the electrodes, other resilient arrangements to accomplish basically the same end may be used. For example, in FIG. 10 there is shown a wiper blade 141 which is maintained straight up and down, or essentially at right angles to the coated surface, while being resiliently biased toward the cathodic surface by resilient means in a mounting 143. In this case the resilient means comprises spring means 147 in a spring chamber 145 within the mounting piece 143 isolated or blocked off from the electrolyte bath by a movable plunger 149 in which or to which the wiper blade 141 is mounted. The plunger 149 is essentially similar in structure, though not in its entire function, to the mounting 133 at the top of the wiping blade 131 as shown, for example, in FIGS. 7, 8 and 9.

Figure 11:
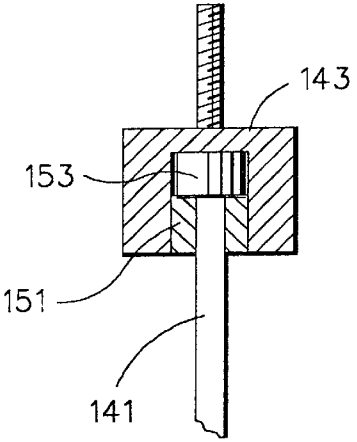
FIG. 11 is a transverse section through a still further alternative wiping blade of the invention.

A third type of resilient construction is shown in FIG. 11. In this arrangement, the wiper blade 141 passes into a slotted member 151 in the mounting 143 and abuts against a resilient plastic material contained in a resiliency chamber 153. The resilient plastic or other resilient material such as rubber or the like may be contained in the resiliency chamber 153. Such material is more resilient than the polymeric dielectric material of the wiping blade itself and is calculated to provide the resilient force necessary as explained above.

Figure 10:
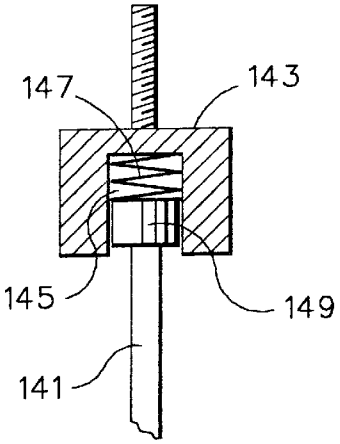
FIG. 10 is a transverse section through an alternative wiping blade.
Figure 12:
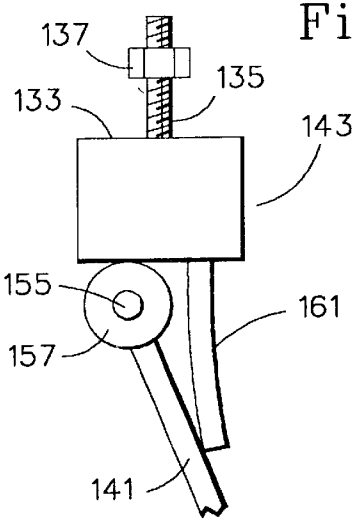
FIG. 12 is an end view of a still further alternative construction of a wiping blade in accordance with the invention.
Figure 13:
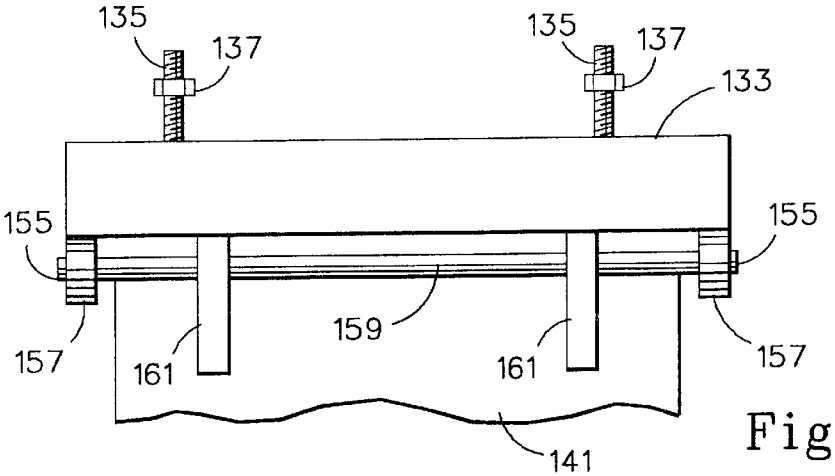
FIG. 13 is a side view of the wiping blade shown in FIG. 12.

A fourth type of resilient construction is shown in FIGS. 12 and 13 which disclose a construction in which a fairly stiff plastic or dielectric blade material comprises the wiping blade 141, as in FIGS. 10 and 11, but in which the wiping blade 141 is hinged to the mounting member 143 by means of two bosses 155 at each end of the top of the blade, which bosses 155 are accommodated in two plastic loops 157 dependent from the mounting member 143. The bosses 155 may, in the construction shown, be continuations or extensions of bar or shaft 159 at the top of the blade 141 as shown, or may be extended directly from the sides of the blade 141 itself. The blade 141 will, in the arrangement shown, merely pivot on the mounting 143, and in order to provide a resilient force of the end of the blade against the strip surface, a further resilient biasing means is necessary. This is shown in FIGS. 12 and 13 as being supplied by two resilient strips of plastic 161 which are securely mounted in or attached to the mounting 143 and bear against the face of the blade 141 to bias it with a resilient pivoting force. In each of these embodiments, threaded fastener means shown as a threaded stud or other threaded fitting 135 together with a threaded nut 137 received upon said stud are used to secure the various resilient wiper blade constructions directly to the anode. See in particular, FIGS. 7 and 8. However, in each case, the blades could be secured to a separate mounting or the like rather than directly to the anode.

Figure 14:
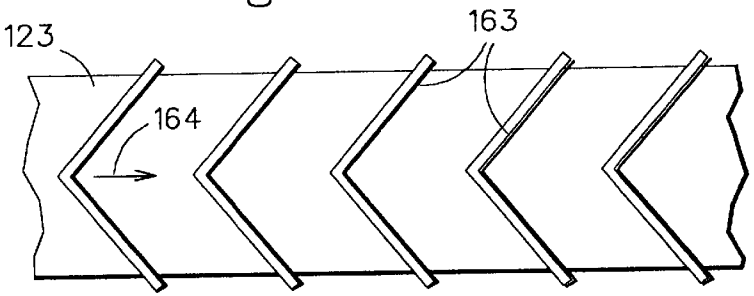
FIG. 14 is a diagrammatic plan view of an alternative form of wiping blade superimposed upon a strip being coated.

FIG. 14 shows a further design for a wiping blade in which a series of blades 163 are arranged in a chevron or triangular overall shape along a coating substrate 123 such as, for example, black plate or the like, which will be drawn past the chevron shaped blades in the direction of the arrow 164. The blades 163 will be either self resilient or may be biased toward the strip by a spring or other arrangement, not shown, but essentially as explained above. The individual chevrons may be either separately mounted or supported or may be mounted or supported in a single frame, not shown, which is resiliently pressed against the strip surface in any suitable manner. The mounting or attachment of ganged or individual chevrons, as in the other embodiments of the wiping blades, can be either directly to the closely spaced anodes, not shown, or to separate mounting means so long as the mounting is secure and, as explained above, properly resilient.

Figure 15:
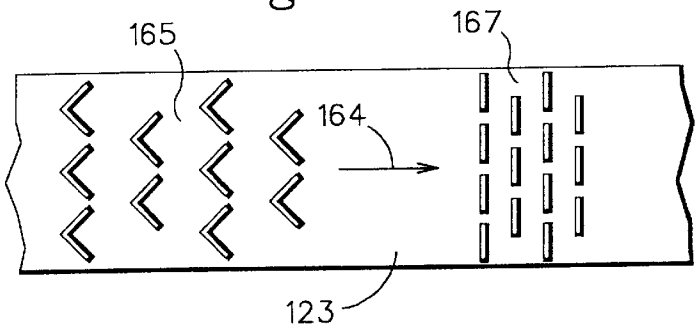
FIG. 15 is a still further diagrammatic plan view of two alternative configurations of wiping blades in accordance with the invention superimposed upon a strip being coated.

FIG. 15 is a diagrammatic plan view of a strip of black plate 123 as shown in FIG. 13, with two further possible arrangements of solid wiper blades applied to the surface of the strip as shown. As in FIG. 14, the movement of the strip 123 is in the direction of the arrow 164. In the first of these arrangements, a group or collection of chevron-shaped blades 165 extend across the strip to wipe the surface, removing hydrogen bubbles and also renewing the surface layer of electrolytic solution primarily by breaking up such surface layer. In the alternative arrangement 167 of straight, but relatively short wiper blades, the strip face is again wiped by a series of individual blades. In both arrangements, the blades, both chevron and straight, are staggered so that electrolytic solution is directed essentially from one blade to another thoroughly mixing it and essentially causing turbulence, but not necessarily stripping the entire coating surface at one time of its associated electrolytic solution. The arrangement is particularly useful where perforated, or grossly perforated, anodes may not be readily available for use with the blades or where it is desired to have a more gradual replacement of the surface layer of electrolytes. No mounting structures are illustrated for the blades shown in FIGS. 14 and 15, but it will be understood that suitable mountings or hangers would be present.

When chevron-shaped wiping blades are used, the angled blade tends more forcefully to force the electrolytic solution to the side, somewhat in the manner of a snowplow. This is somewhat more effective in immediately removing any dendritic material from the coating surface, but probably does not interchange electrolytic solution any faster, since there must be sufficient openings in the anode to allow ready back flow of solution behind the wiper blade to avoid cavitation, which openings are then also adequate to allow flow from in front of the blade. However, several improved embodiments allowing faster replacement or interchange of electrolytic solution are described hereinafter. Despite the angle of the blade in the snowplow arrangement, movement of the work surface past the blade can still be properly considered to be substantially transverse with respect to the blade.

FIGS. 16 and 17 are end and side views, respectively, of an improved tapered wiping blade 171 in which the top portion 173 of the blade is expanded in size and preferably has a series of thin pins 175 extending from it. This blade can be attached to an anode by inserting the pins 175 into pre-drilled holes in adjoining anodes and when it is desired to replace a blade, such blade can be easily pried out of its mounting with a prying tool of proper design and a new blade popped into place. The lower portion 174 of the blade 171 is tapered so that it is properly flexible or resilient to bear against the surface of the coating substrate or strip and may be pre-flexed, if desired, in the proper direction.

FIG. 18 is a side view of a further wiping blade 171*a* also having a tapered and pre-flexed contour and having, in addition, a pin 175*a* having a slight expansion 175*b* at the top so that when popped into place in pre-drilled holes in the anode or other mounting, it will be held securely in place until pried out after wear of the end of the blade is detected. Alternatively, if the enlarged top is made larger together usually with the pin itself, the enlarged pins may be jammed into the flow orifices in the anode to hold the blade somewhat as shown in FIGS. 2 and 3. However, this ''◂ has the disadvantage of blocking the flow orifices in the area in which flow may be most desirable to renew the electrolytic solution.

As has been explained above, the resilient plastic or dielectric wiper blades of the invention very effectively wipe the surface of a cathodic workpiece while electrolytic coating is taking place by relative movement with respect to the surface of the coating piece. Normally, the wiping blade will be held stationary, but resiliently biased against the workpiece, as shown in the various appended drawings, but it will be understood that the wiper blade can be designed to move across the work surface also. Usually in such case there would be a reciprocating motion of the wiper blade or blades somewhat in the manner of a windshield wiper on a car. In most such instances, a fairly stiff blade may be used and depended directly against the coating surface by a resilient means.

In FIGS. 19 and 20 respectively, there are shown a diagrammatic side elevation and a diagrammatic plan view of a perforated anode and plastic wiping blade combination construction for use in the continuous plating of strip or sheet. As shown, a single anode 195 may be divided or sectionalized, for example, into four more or less equal sized sections 195*a*, 195*b* and so forth with upstanding flanges 197 between the sections between which dielectric wiper blades 199 are mounted and secured by the same fastenings as secure together the flanges. Such flanges 197 and wiper blades 199 are thus connected or secured together by means of fastenings 201, which may be threaded or other suitable fastening. Additional anode sections may extend on either side of those shown in the figures to form whatever sectionalized anode length is convenient or desirable. The lengths of the anode sections 195*a*, 195*b* and so forth are preferably equal and are arranged so that the wiper blades 199 are positioned opposite to each other along the strip 123. The sectionalized arrangement not only provides an integrated structure, but a stronger structure overall, and if the wiping blades are slotted, allows such blades also to be adjusted periodically for wear, although as noted, wear is generally not very rapid because of the flexibility of the blades. The wiping blades can also be reconditioned by use of a special reconditioning tool which can shave off worn or contaminated surfaces of the wiping surface of the blade. Each anode section is provided with a plurality of more or less randomly, but closely spaced orifices 203, best shown in FIG. 20, through which coating solution may have free passage, particularly, as explained above, as the wiper blades 199 force a surface layer of solution away from the surfaces of the traveling strip 123. As explained previously, such solution will be forced by the movement of the strip past the wiping blade out the sides of the spaces between the anodes and the workpiece between the blades, but also up through the anode orifices in front of the blade, while other solution passes through the orifices at the back of the wiping blade as well as in from the sides to take the place of the previous solution, thus ensuring a periodic renewal of the electrolytic solution next to the surface of the workpieces.

As in earlier figures, the wiper blades are shown inclined slightly in the direction the workpiece surface is moving. Preferably one edge of the end or side of the wiper blade contacts the surface of the workpiece. This very effectively strips the barrier layer of solution and hydrogen bubbles away from the surface of the moving substrate.

As indicated above, the arrangement shown in FIGS. 19 and 20 is a convenient way to allow adjustment of the wiper blades as wiping proceeds. In FIG. 21 there is shown a longitudinal view of one of the wiper blades 199. In FIG. 21 the wiper blade 199 has round orifices 191 in it through which the fastenings 201, shown in FIG. 19, may be passed to hold the wiping blades tightly between the flanges 197 of the anode sections 195. The wiper blade is not adjustable, but is strongly and securely held in place. On the other hand, in FIG. 22 there is shown a variation of the wiper blade designated in FIG. 22 as 199 having oblong orifices or slots 193 through it for receipt of the fastenings 201. The slots 193 are preferably spaced several inches apart. The slotted arrangement of FIG. 22 enables the blade to be adjusted vertically between the flanges 197 as the wiping blade wears. It will usually be the case that the anode will be withdrawn from the coating solution for adjustment of the wiper blade, but in some cases a suitable mechanism, not shown, for periodic adjustment of the wiping blade may be mounted upon or adjacent to the top of the blade to make an automatic adjustment or even a manual adjustment of the wiper blade without removing the entire structure from the coating solution.

As will be understood, the combined anode-wiper blade structures shown in FIGS. 19 through 22 provides a strong convenient and highly practical arrangement which has several advantages over the wiper blade construction shown in previous views. The arrangement is particularly sturdy and effective in securely holding the wiper blades in position. Its main disadvantage is that the blades are not readily replaceable without disassembling the entire structure, although, as indicated, arrangements can be made for moving slotted or otherwise appropriately constructed wiping blades to adjust them automatically or at least manually without removal of the anode from the coating solution. Such arrangements, however, create additional complexity and the more conveniently replaced snap-in-type wiping blades shown in some previous views may be, therefore, more desirable in some operations.

FIG. 23 is a diagrammatic isometric view of an anode suitable for use with the present invention in which a flanged anode 225 which may be constructed out of lead, lead-tin alloy or the like is secured to two copper supporting structures or hangers 227 composed of horizontal sections 229 and vertical sections 231 which serve to connect the flanged anode 225 to the supporting and electrical structure of the coating line. Only the back vertical sections 231 of the hangers are shown on the right. Normally, however, there would be similar vertical sections on the left side of the hanger. The perforated anode 225 has orifices or perforations 233 across its entire surface which orifices extend completely through the anode as explained previously. This enables electrolytic solution to pass freely through the anode and allows not only better solution of the anode where the anode is a sacrificial anode, but also better circulation of the electrolytic solution. The orifices 233 shown in FIG. 23 may be of various shapes and sizes, depending on the particular circumstances or requirements. Previously shown orifices in earlier figures have been mostly either square, round or oblong in a transverse direction. Such orifices may also be oblong in a longitudinal direction with respect to the passage of linear materials such as strip, past the anode. Since it is advantageous for the openings or orifices 233 to be placed in an overlapping pattern, however, it will usually be more convenient to have oblong orifices extending in a transverse direction, since it is with respect to the transverse movement of the strip that it is desirable to have the orifices aligned in an overlapping pattern. This prevents any given portion of the strip from tending to spend more time than other portions under or immediately adjacent to a solid portion of the anode rather than a perforated portion of the anode.

Since it is not desirable to have the electrolytic solution dissolve the copper hangers, such hangers should be coated with lead, lead-tin or other suitable resistant material to prevent dissolution. The exact composition of the anode and the covering for the copper anode hangers will depend on the particular electrolytic bath which is being used.

FIG. 24 is a diagrammatic isometric view of one side of a single hanger 228 provided with two crosspieces or cross members 229*a* and 229*b* which serve to support both the top and bottom lead anodes adjacent to the strip surface as the strip passes between the two cross members as shown. In this case, there are, of course, two perforated anodes 225*a* and 225*b* attached to the two cross pieces and it will be understood that the opposite end of such anodes would be attached to a second copper hanger or support as shown in FIG. 23 for a hanger provided with a single crosspiece. Likewise, in FIG. 24 the usual left-hand vertical section 231 has been omitted from the drawing for clarity. It will be seen that the strip 235 passes directly between the two horizontal sections 229*a* and 229*b* and since the lead anodes are placed or attached to the crosspieces 229*a* and 229*b* with their flanges, not shown, faced away from the strip, the two anodes are also held equidistant from the strip surface. This is shown in more detail in FIG. 25, which is a side or transverse view of one of the hanger arrangements shown in FIG. 24. FIGS. 23 and 24 for clarity and simplicity, do not show the dielectric wiper blade of the invention extending downwardly and upwardly from the crosspieces 229*a* and 229*b*. However, as noted below, such dielectric wiper blades are shown in FIG. 25.

As indicated, FIG. 25 is a side view of the hanger or support 227 of FIGS. 24 showing the flanges 225*c* and 225*d* of the anodes 225*a* and 225*b* extending up and down the sides of the cross sections or cross pieces 229*a* and 229*b* which are in turn attached to the vertical hanger sections 231. Also shown are two elongated dielectric wiping blades 237 which have been designated as upper blade 237*a* and lower blade 237*b*. These two wiping blades 237*a* and 237*b* are held between the flanges 225*c* and 225*d* of the anode 225 and the horizontal supporting sections 229*a* and 229*b* by pins or bolts 239 as best shown in FIG. 26. As will be seen, each of the hangers or support pieces 227, either alone or adjacent to a cooperating hanger, serve to support two plating electrodes or anodes 225 through their flanges 225*c* and 225*d* plus one dielectric wiping blade 237 mounted between the flanges 225*c* or 225*d*. Preferably, the hanger or support will be provided with a U-shaped lower section, as shown in FIG. 27, which shows a vertical hanger or vertical support 231 having a bent lower portion 241 between which the horizontal sections 229*a* and 229*b* for adjacent electrode sections 225 may be mounted with an insulating block 243 mounted between them as a spacer or for insulating purposes. The flanges of the anodes in the construction shown can be mounted or held either on the inside or outside of the cross pieces for the hanger section for that particular anode section, or, alternatively, can be made integral with the hangers.

In FIG. 26, two separate hangers or support pieces 227 cooperate to support adjacent sections of sectionalized anodes. This provides a balanced structure with, as shown, each cross piece 229 of the hangers 227 having a flange of the anodes 225 passed upwardly along the inside of the cross piece 229 and directly contacting the top of the wiping blade 237 between the two flanges. Alternatively, the flanges of the anodes 225 may be turned up and secured to the outside of the cross pieces 229. However, this, in effect, slightly reduces the length of the anode section, which is undesirable. Only one hanger can also be used at each intersection and in this case it will be desirable to bring the flange of one anode section under the hanger and secure it to the opposite side, secure the wiping blade against this flange of the anode and secure the flange of the adjoining anode against the opposite side of the wiping blade, thus gaining maximum length of the anode sections, but a somewhat less secure mounting for the wiping blade, particularly when consumable electrodes are being used. In FIG. 26, the vertical portion 231*a* of the hangers 228 passing between the two crosspieces 229*a* and 229*b* are shown in dotted outline.

FIG. 28 shows a further embodiment of a flanged anode 245 in which one flange 245*b* of the two flanges 245*a* and 245*b* incorporates or is molded about a copper strip 247 which is or constitutes the horizontal portion of a supporting structure or hanger 251, the vertical sections 253 and 254 of which extend upwardly from the end to support the entire unit as shown in FIG. 28A. The vertical section 254 does not contain the copper conductor 247 which is contained in vertical section 253. It will be recognized that in this structure or embodiment, the hanger structure and flanged anodes are, in effect, integral with each other.

The embodiments of the invention shown in FIGS. 23 through 28 will be recognized to provide a very practical and effective embodiment or embodiments of the invention which are easily supported in position in an electroplating bath at the proper distances from a strip passing through the bath. Furthermore, as will be recognized, the dielectric spacing blades or wiping blades 237 effectively guide the strip 235 between the electrodes 225 or 245 and maintain the strip spaced at the correct distance from the electrodes. The fairly close spacing of the multiple wiper blades 237 along the length of the anodes effectively guides the strip between the electrodes 225 or 245 preventing deviation of the strip and damping out oscillations in such strip which might cause it to approach closely enough to the anodes 225 or 245 to strike, or otherwise induce, an arc between the anodes and the strip. However, because of the very thin structure of the wiper blades, such blades do not interfere significantly or at all with the coating of the strip either in the vicinity of the blade or even underneath the blade, while the flexibility or resilience of the blade prevents such blade from wearing, except rather slowly. The blades 237 moreover very effectively immediately dislodge bubbles of hydrogen from the cathodic film which tends to build up on the surface of the cathodic workpiece 235.

FIG. 29 is an oblique view of a preferred chevron-type flanged anode arrangement in which the hangers 247, as a whole, and including particularly the horizontal support section 249, take the chevron shape shown diagrammatically in FIGS. 14 and 15 previously described. A vertical support 251 is provided on one side of each one of the chevron-shaped hangers 247. Each perforated anode 259 has a shape essentially of a rather fat arrow having a pointed leading end 253 pointed in the direction from which the strip approaches and a rear end having a V-section 255 pointing likewise in the direction from which the strip approaches and open toward the direction in which the strip moves away from the anode. The direction of movement of the strip is indicated by arrow 252. Flanges 257 on the perforated anodes 259 serve to provide a structure by which the perforated anode sections are secured to the horizontal supports 249 of the hangers 247. Flexible resilient wiping blades 261 are held rigidly in place upon the cross-pieces or horizontal supports 249 or against the flanges 257 to provide a light brushing action upon the surface of the strip in essentially the same arrangement as shown in FIGS. 23 through 25, except for the chevron or V-shape of both the perforated anode 259 and the horizontal support sections 249 of the hangers 247 and the wiping blades themselves 261. As explained previously, orifices 263 are provided in the perforated anode. It has been found that the wiping blades 261 having the chevron shape are particularly effective at sweeping the thin layer of electrolyte which is normally carried along with the strip 235 and removing or urging such electrolyte towards the sides of the strip allowing new electrolyte to flow in through the perforations 263 in the perforated anode 259. In this way, fresh electrolyte is at all times being fed to the surface of the strip. In addition, it has been found that the chevron or V-shaped wiping blades are particularly effective in preventing oscillations of the strip surface which might cause the strip to approach the closely spaced anode such that arcing between the anode and the cathodic strip surface may take place, damaging both structures. As may be seen in FIG. 29, for example, the leading section or point 253 of a following flanged anode may approach rather closely or even overlap an imaginary line connecting the ends of the V-section of an earlier or preceding anode in the direction in which the strip is passing so that the strip surface is supported against substantial oscillations, not only longitudinally, but also transversely of the strip. Stated otherwise, the strip may be stabilized by the following wiping blades 261 not only at spaced points transverse of the strip, but also at longitudinally and transversely displaced points extending over a substantial portion or area of the strip. See, in particular, FIG. 30 which is a plan view of one of the chevron-type perforated anodes 259. The flanges 257 are secured in any suitable manner to the horizontal portions 249 of the hangers 247, which horizontal or cross-support sections preferably continue or extend out from the side of the actual anodes at an angle providing further movement or agitation of the electrolytic liquid within the area of but extending to the side of the anode. As shown best in FIG. 30, the perforations 263 in the surface of the anode 259 preferably have an overlapping or staggered pattern. A very preferred staggered pattern may be referred to as a "bowling pin" hole pattern which is illustrated diagrammatically in FIG. 30A. As explained above, this overlapping pattern subjects any longitudinally moving portion of the strip to first an open or porous section of the anode and then to a solid section of the anode, then again to open or porous section, then to a solid section, and so forth such that no portion of the strip tends to remain under either a solid portion or open portion on the average more than any other section. This aids in preventing the development of transverse gradations of coating thickness across the finally coated strip surface forming longitudinal lines of differential coating thickness extending along the length of the strip. Two adjacent anode sections 259 are shown in FIG. 29. However, it will be understood that additional anode sections may be used on either end of the two illustrated sections.

A further embodiment of a chevron-type arrangement is shown in plane view in FIG. 31 in which a series of flanged chevron sections are bolted together as in previous embodiments or, as an alternative, may be otherwise secured together to form a unit. In FIG. 31, the leading chevron 265 is cut away in the center portion 265*a* so that a flow of electrolyte moving along with the strip passes through the center of the blade, under the flange with its adjacent blades and is directed against the second chevron 267, which is also provided with a cutaway section 267*a* in the center, but which cutaway section 267*a* is smaller than the cutaway section 265*a* in the first chevron 265. Again, the third chevron 269, is provided with a still smaller opening 269*a* in the center so that proportionately less of the electrolyte dragged along with the surface of the strip is directed to the sides and flows out of the sides between adjacent chevrons. The last chevron 273 in the group has no opening at all in the center so that all of the flow through the center of the other chevrons is directed to the sides in front of the chevron 273. As in the previous views, the orifices or perforations 263 in the surface of the anode itself, are staggered to prevent a continuous alignment of the orifices with the surface of the strip. The arrangement of the chevron wipers shown may provide a more vigorous flow of electrolyte over the surface of the strip and a better exchange of fluid with the surrounding electrolytic bath material. It will be understood that while the arrangement has been described as used with flanged anodes between which dielectric wiper blades may be held, that in fact, particularly since the chevrons are arranged in a particular order, holders or supports for the dielectric wiping blades may be fabricated as a unit with respect to the perforated portion of the flanged anodes such that a full anode section, which may even have a shape other than the triangular shape of the chevron hangers and wiper blades, is formed as a unit and may be mounted as a unit within the coating bath. However, it will also be understood that the most convenient construction is again to provide the chevron configuration or structure to the hangers plus flanges on the perforated anode sections and to have sections of wiping blades extended between the flanges on the anode sections and/or the lower portions of the hangers. In this manner, a very strong construction is formed when the various sections of the flanged anodes are bolted together. In FIG. 31 an arrow 272 indicates the direction of movement of the strip.

FIG. 31A is a diagrammatic illustration of design parameters for the open-ended chevron sections shown in FIG. 31 wherein it will be seen that a series of chevron-type constructions 274*a*, 274*b*, 274*c*, 274*d* and 274*e*, i.e. five in number, are set at about one-foot intervals over a nominal five-foot section of perforated anode with chevron support sections. Since the end of the sides of each chevron is preferably approximately positioned on the same line along the strip as the center of the following chevron, the total length of a section of five chevron wipers one foot about apart will be five feet in length. Other lengths may, of course, be used such as 10 total feet using 10 individual chevrons, particularly in large industrial installations and in such installations there may well be several separate units of the chevron-type installations. Other distances between the individual chevrons may also be used. As shown in diagrammatic FIG. 31A, the forward portion 274*aa* of the first chevron 274*a* is cut out to a maximum width of about one half the dimension of the distance between adjacent chevrons, or in the case illustrated, about one-half foot. From the sides of this cutout portion, two dotted lines 276*a* and 276*b* are projected rearwardly to the forward edge of the last chevron 274*e*, which is not cut out, and the intervening three chevrons 274*b*,274*c* and 274*d* have sections removed to a width which is encompassed between the dotted lines 276*a* and 276*b* which, as indicated above, are merely imaginary projections of a reversed triangle or triangular section 278. The triangle 278 is, therefore, an imaginary isosceles triangle having two sides 276*a* and 276*b* plus a base 276*c*, which define within them the proper openings in progressively less cut out adjacent chevron sections. The progressively narrower openings within the chevrons are very effective to create additional turbulence and flow of surface electrolyte within the chevron section or assembly, which may be referred to as a "chevron cell". It may be desirable to have the initial opening in the first chevron up to as much as the actual distance between chevron, or in for example a ten foot cell or unit of chevron wiping blades mounted upon a perforated anode construction at one foot intervals an initial opening up to one foot across.

FIG. 32 is a side view or elevation of an extended length of T-shaped resilient wiper blade in accordance with the invention, which, as will be explained, may be fed across an electrolytic coating line continuously or discontinuously as such wiper blade wears so that the electroplating line will not have to be stopped in case of wear of the various wiper blades to secure or mount new blades between the flanged sections of the anode. An end cross section of the T-blade is shown in FIG. 33 and a cross section of a flanged blade securing holder or T-section holder is shown in FIG. 34. In FIGS. 32 and 33, a T-shaped blade 275 is shown having an upper section 277 which constitutes the crosspiece of the "T" and a lower section 279 which constitutes the flexible blade itself. The crosspiece 277 provides a structural portion of the blade.

In FIG. 34, a combined holder and T-flange channel 281 is shown which takes the shape generally of the T-blade 275 itself with sufficient inner-dimensions to allow the T-blade to pass within and through it. The track or holder 281, like the T-blade itself, has an upper cross-T section 281*a* and lower section 281*b*.

FIG. 35 shows a series of T-blade holders or tracks 281 mounted between flanged anodes 283*a* and 283*b* at the top and the bottom of a strip 285, respectively. It will be seen that the three T-blades 275 have been slipped into upper and lower T-blade holders 281 from the side and such T-blade holders 281 have been used as flange supports to which the flanges 283*c* of the upper and lower flanged anodes 283*a* and 283*b* have been attached by any suitable securing arrangement. Such attachment may be by welding, brazing or other suitable securing means which is effective to provide a permanent attachment of the flanges to the T-section supports. It is not so important in this embodiment for the flanged anodes to be disassembled to allow new wiping blades to be inserted between the flanged anodes as in the previously illustrated embodiments. Consequently, permanent attachment of the flanges of the anodes can be made to the T-blade support means. However, where sufficient room is available, it may be more efficient to secure the flanges of the anodes to the T-blade holders by means of temporary securing means such as bolts or the like so that the entire construction may be disassembled, particularly where sacrificial anodes are being used which will eventually dissolve in the electrolytic bath and must be replaced. Suitable hangers, not shown, will be attached usually to the T-blade holders to support the anodes 283*a* and 283*b* plus the T-blades 275 and tracks 281. However, such hangers may also be attached directly to flanged anodes in any suitable manner.

Figure 36:
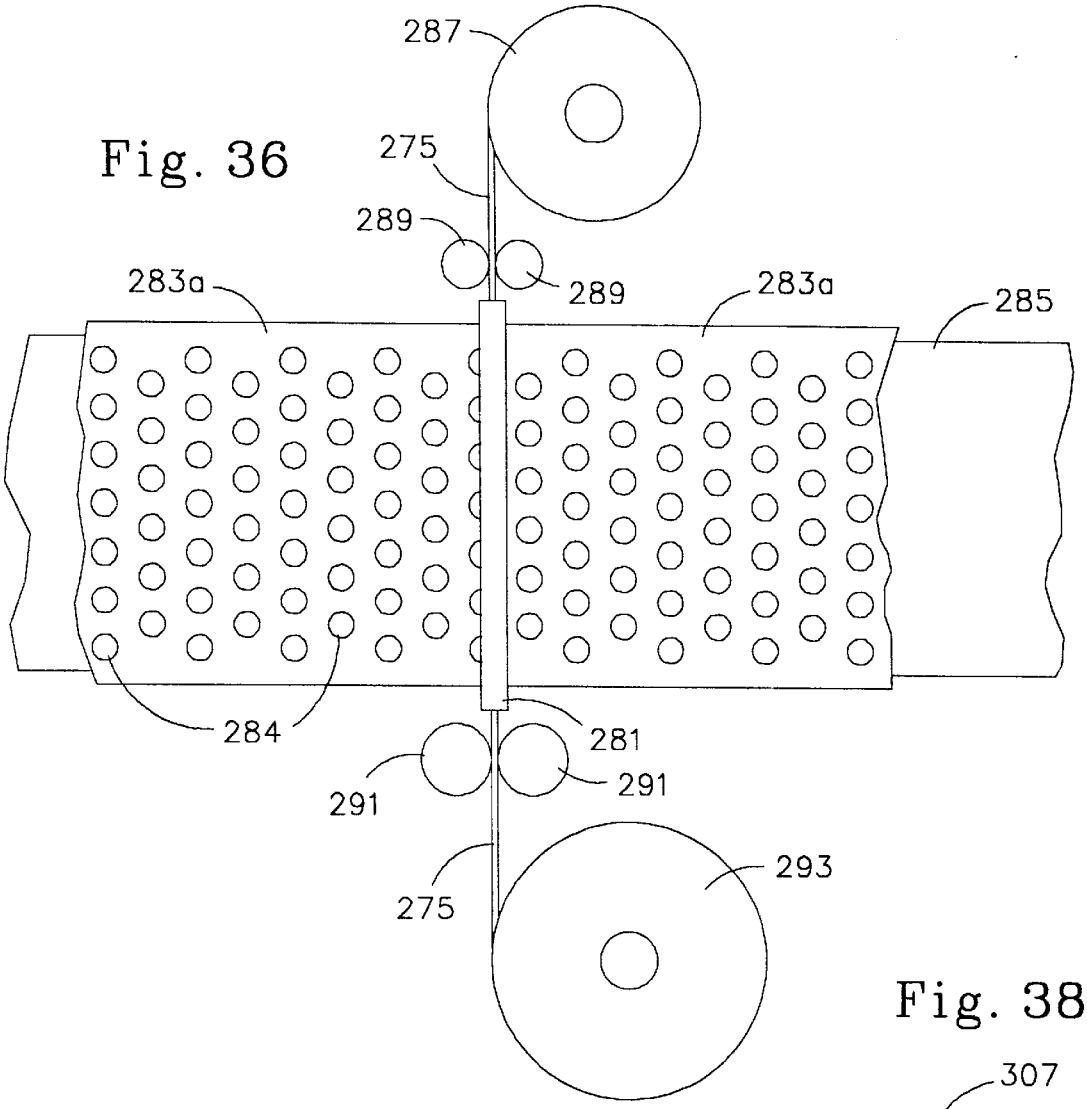
FIG. 36 is a partially sectioned diagrammatic top view of a T-shaped blade as shown in FIGS. 32 to 35 mounted on a continuous coating line with reel-to-reel feed.

FIG. 36 is a top, partially broken-away view of the T-section-type wiping blade 275 being fed at a controlled rate across the strip 285 in the holder 281 between adjoining perforated anodes 283*a*. It will be understood that a similar perforated anode 283*b*, not shown, will be directly below the upper anode 283*a*. The anodes 283*a* and 283*b* have perforations 284, preferably staggered or overlapping perforations as in the other illustrations. The coil 287 of T-strip which is able to coil into a fairly tight roll or coil due to the small size or transverse dimensions of the T-strip, is held in coil form on a reel and guided as it unwinds by the guide rolls 289, which are shown located at the entrance to the holder or track 281. The guide rolls 289 are positioned between the coil 287 and the T-section guide or T-blade holder 281 directly in line with the opening in the T-blade holder so that as powered drive rolls 291 are turned, the T-section is pulled into the end of the T-blade holder 281 where it is held loosely so that it can be passed through the holder and out the other side between two guide-drive rolls 291 also in line with the end of the T-blade holder 281. The drive rolls 291 feed the T-blade 275 onto a take-up reel 293 which may itself also be powered.

The T-blade holder 281 may be provided with resilient material, not shown, which may take the form of either a resilient plastic material or a series of spring-loaded guide plates, not shown, along the inside top of the T-blade holder 281 which bear against the upper flange 277 of the T-blade such that the T-blade is stabilized within the holder and bears against the strip 285 passing between the two perforated anodes 283*a* and 283*b*. As shown in FIGS. 33 and 35, the lower portion or principal blade portion 279 of the T-blade 275 is preferably flexed as in previous embodiments of the wiping blade against the strip 285 to provide a very light wiping pressure against the strip and also to stabilize the position of the strip between the two anodes. As will be understood, while the strip is only very lightly touched or "kissed" by the tips of the blades as the strip 285 passes between the flexed portion 279 of the blades 275, if the strip is displaced either up or down, it will immediately place additional pressure against the flexible or resilient blade 279 causing such blade to flex more strongly and place a higher pressure against the side of the strip, thus tending to force the strip back into the central position between the two blades. In this way, the strip is very effectively stabilized between the blades, even though the blades do not press upon the strip with any great pressure and the blades do not interfere with the coating of the strip from the electrolyte adjacent the surface of the strip. As explained previously, the wiping blade, which preferably contacts the strip only against one edge of the extreme end of the blade, causes small bubbles of hydrogen to detach from the surface of the strip while encouraging the cathodic layer or film to agglomerate into other small bubbles which will be dislodged from the strip by the next blade, or even possibly after several blades have passed across that section of the strip. The pressure of the wiping blade upon the strip surface is also sufficient to prevent the thin barrier layer of electrolytic liquid or solution, which tends to be drawn along through the bath with the movement of the strip itself and which becomes quickly depleted of coating material, if not removed, from passing the wiping blade and to wipe said thin barrier layer to the side or force it upwardly through the perforations in the anode while fresh solution is drawn into contact with the strip behind the wiping blade.

Figure 37:
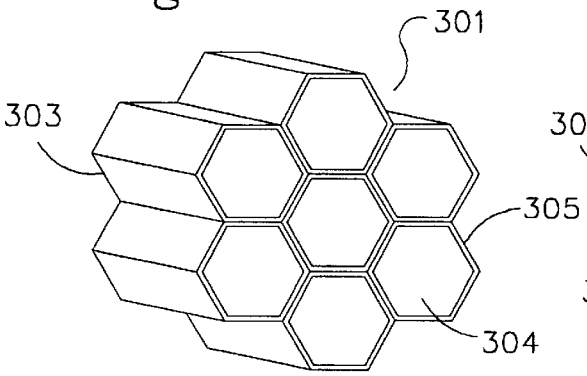
FIG. 37 is an isometric view of a portion of a less preferred alternative type of wiping blade.

FIG. 37 is a diagrammatic isometric view of an alternative less preferred form of wiping blade 301, referred to generally as a honeycomb-type wiping blade. Such honeycomb-type wiping blade 301, as shown, comprises a series of plastic hexagonal membranes which form a series of interlocking walls or blades having generalized outer and inner ends 303 and 305. Such two ends or sides may be referred to as outside and inside. Conventionally, the inside will be considered to be the wiping side and the outside to be the external side away from the strip. The openings through the honeycombs are designated as 304 and serve as passageways for hydrogen bubbles and spent electrolyte to pass through the honeycomb.

Figure 38:
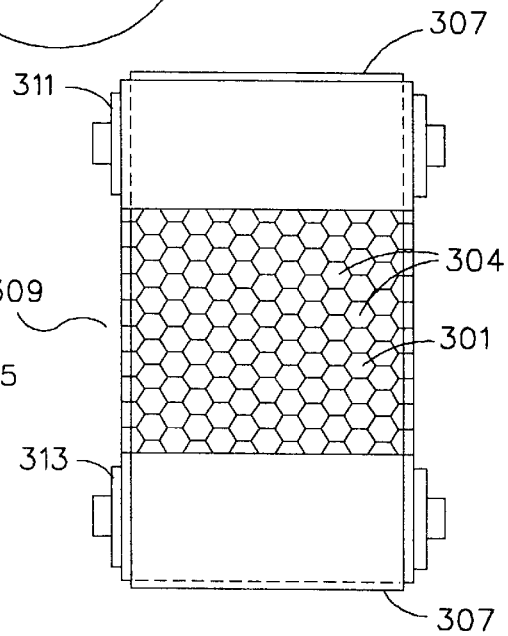
FIG. 38 is a diagrammatic transverse view of partially shown in FIG. 37.
Figure 39:
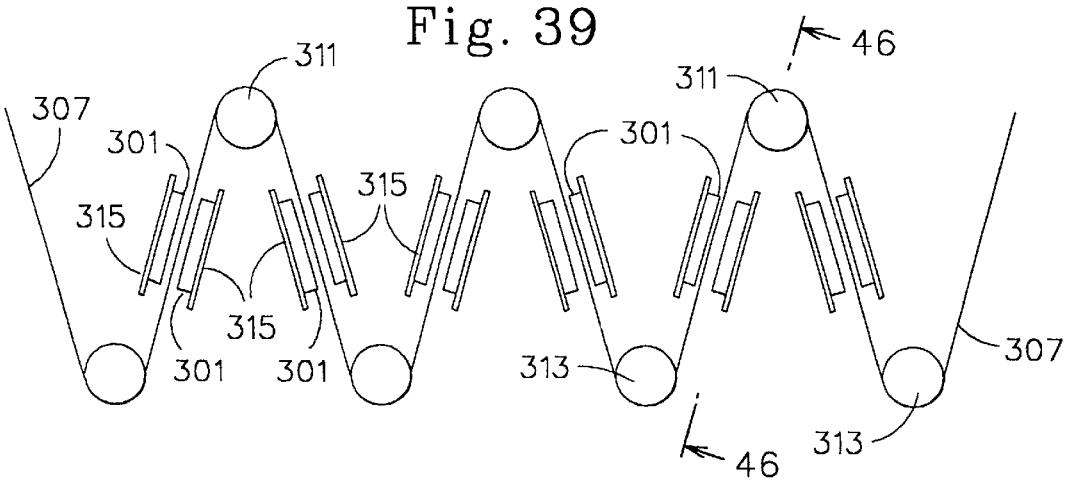
FIG. 39 is a diagrammatic longitudinal elevation of the alternative type of wiping blade shown in FIGS. 37 and 38 mounted or in use on a coating line.

An assembly of honeycomb-type wiping blades 301 are shown mounted adjacent alternating upward and downward runs or legs 309 of the strip 307 in FIGS. 38 and 39. FIG. 38 is an enlarged section taken along line 38—38 in FIG. 39, but additionally showing the guide rolls at the end of the leg of the strip. The upward and downward legs of the strip 307 are maintained in place by a series of upper guide rolls 311 and lower guide rolls 313. These guide rolls 311 and 313 effectively direct or turn the strip 307 within a coating tank, not shown, into a more or less vertical runs which are shown slightly slanted in FIG. 39, which as indicated is a diagrammatic illustration of the same overall coating line assembly, but, it will be understood, could be completely vertical in orientation and arranged such that the honeycomb wiping blades 301 when placed against the sides of the strips are oriented in such a position that when bubbles of hydrogen are wiped from the surface of the strip, such bubbles and depleted electrolyte can pass through the openings 304 and the honeycomb structure as a whole and escape into the coating bath where they float upwardly to the surface of the bath, not shown. In the embodiment of the invention shown in FIGS. 38 and 39, each of the honeycomb sections 301 are in fixed position, close to the sides of the strip and as the strip passes upwardly, it will tend, by shifting from side to side, to contact first one section of the honeycomb on one side and then another section of the other honeycomb on the other side. In this manner, the strip is continuously being wiped in some sector of the strip against one of the honeycombs and in most cases will be continuously wiped at several sectors between each honeycomb as it deviates from side to side. While this arrangement is not as satisfactory as having actually flexed blades continuously biased or resiliently forced into the side of the strip at all times, it does serve to prevent the strip from touching the electrodes 315 which are positioned outboard of each of the honeycomb sections 301. In this way, arcing between the strip and the anodes is prevented and the surface of the strip is continuously wiped to remove bubbles of hydrogen and depleted electrolyte which thereby activates the cathodic layer to cause the formation of new bubbles which then float upwardly in the bath. A fairly effective continuous wiping of the surface of the strip is thereby effected. In FIG. 38, the outer of two honeycomb wipers 301 is shown with the strip 307 passing under such honeycomb wiper and the outer perforated anode removed or not visible. It should be understood that a further honeycomb wiper not shown is under the strip 307. In other words, the view in FIG. 38 is, as indicated above, of the assembly taken along section 38—38 in FIG. 39 described hereinafter.

FIG. 39 shows the honeycomb section 301 in a partially broken-away side view of one of the legs or runs of the strip 307 about the guide rolls 311 and 313. It will be seen with reference to FIGS. 38 and 39 that the honeycomb section extends completely across the surface of the strip 307 and on a statistical basis, continuously wipes the strip in the various consecutive sectors of each run or up and down leg so that after the strip gets through a series of runs, it has been rather thoroughly wiped at various places as it passes between the honeycomb sections.

Figure 40:
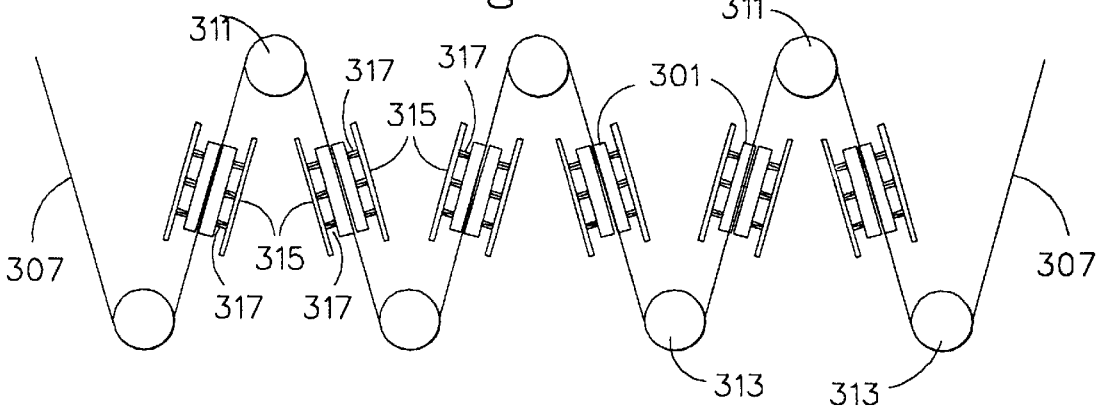
FIG. 40 is a diagrammatic side or longitudinal view of an improved embodiment of the invention shown in FIGS. 37 and 39.

FIG. 40 is a further side illustration of an embodiment of the invention in which honeycomb sections 301 are provided along the vertical or angled runs of a strip 307 being passed over the upper guide rolls 311 and lower guide rolls 313 as in FIG. 39. In FIG. 40, however, the honeycomb sections are resiliently mounted against the bottom of perforated anode sections 315 by resilient means 317 which may take the form of a resilient plastic construction or in some cases, polymeric spring-type structures which are resistant to the electrolytic coating bath. The arrangement shown in FIG. 40 will be recognized to provide a more positive wiping action of the honeycomb sections upon the surface of the strip 307, but also to provide a more complicated arrangement having in addition, increased likelihood of actual failure of the resilient means to keep the honeycomb sections positioned against the strip surface. However, it will be recognized that even if the resilient means should fail, the honeycomb sections are still held in position essentially in the same positioning as shown in FIG. 39 where such honeycomb sections are in permanent placement adjacent to the strip. Consequently, even if the resilient means 317 in FIG. 40 should fail, the arrangement will still remain operative.

It will be recognized that the honeycomb arrangement for wiping blades with its possible wiping action, may be offset by the detriment of greater wear, if the honeycomb sections are actually forced against the side of the strip surface. However, because such strip surface tends to have a greater wearing effect upon the relatively solid structure of the honeycomb sections, rather than dissipating the force by the actual resiliency of a flexed blade or a thin flexed blade as shown in previous figures, there may be limited disadvantages in the arrangement shown in FIG. 40. However, to some extent the multiple walls of the honeycomb construction provides more polymeric material to wear so that the life of such wiper may not be actually that much diminished from the wear which is experienced by flexed blades.

Figure 41:
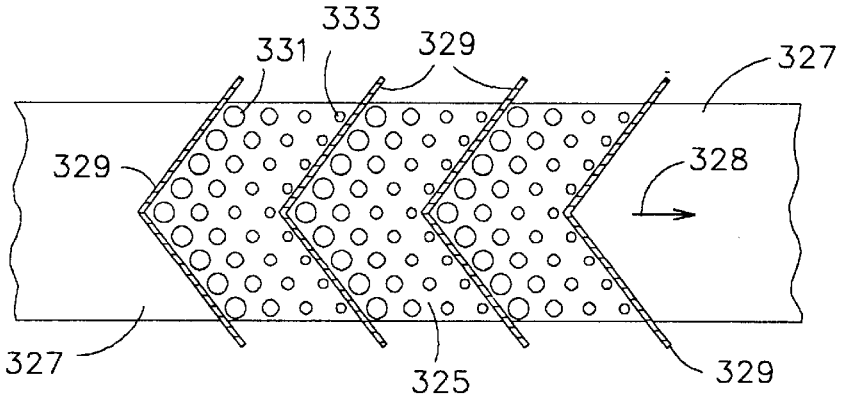
FIGS. 41 is a diagrammatic plan view of an improved embodiment of the invention, shown in FIGS. 29 and 30.

FIG. 41 is a diagrammatic illustration of an embodiment of the invention using chevron-type wipers in which orifices 331 in the perforated electrode 325 located at the rear end of the chevrons 329 are larger than orifices 333 located near the front of the adjoining chevrons. This allows more electrolytic solution from the open portion of the plating tank to be fed through the openings in the perforated anode 325 directly behind the chevron wiping blades 329, where cavitation may other-wise prove to be a problem, than through the orifices at the beginning of or adjacent to the next chevron configured blade 329 where it is hoped that the electrolytic solution will be forced mostly from the sides of the chevrons in any event rather than up through the openings in the perforated anode 325 within the space between consecutive chevrons. Since a fast moving strip 327 moving in the direction indicated by the arrow 328 may otherwise carry a considerable barrier layer of electrolytic solution along with its surface, absent the wiping blades, and particularly the chevron-type wiping blades 329, such blades may force substantially all of such electrolytic liquid from the space or volume between the blades. Thus, cavitation may become a problem directly behind the triangles or triangular configuration of the wiping blades. However, such cavitation can be alleviated by placing larger openings in the perforated anode directly behind the wiping blade to facilitate flow of electrolytic fluid through this portion of the anode and smaller openings in the perforated anode directly in front of the following wiping blade to somewhat restrict flow of solution from some such openings within the anode and force most of the fluid out the sides between the strip and the anode while encouraging flow of electrolytic solution through the larger orifices behind the chevron sections. In this manner, fresh electrolytic solution is maintained across the surface of the strip at all times within the area encompassed by the wiping blades so that efficient plating may also take place across the surface of the strip at all times.

FIG. 42 is a top diagrammatic view of an arrangement of the invention in which the sides of a chevron wiping blade arrangement are closed in by walls 324*a*, 324*b* and 324*c* plus a top and bottom, not shown on both sides and a pump, shown as a centrifugal pump or pumps 323, are attached to the closed-in sections so that not only is the spent electrolytic solution encompassed within the barrier layer drawn along with the surface of the strip 327 discharged from the side of the chevron arrangement by the wiping effect of the resilient dielectric blades upon the surface of the strip, but the material or electrolytic solution between the perforated electrodes or anodes 325 and the surface of the strip 327 is actually drawn away from the sides of the chevron sections by the fluid current in the electrolytic solution generated by the suction of the centrifugal pumps 323 and such solution drawn away from the ends of the chevrons 329 is then deposited within the body of the electrolytic coating tank, not shown, in which the entire arrangement is submerged, or alternatively discharged to a suitable heat exchanger back to the "mother" solution handling and feeding tank, also not shown, where solution temperature and solution concentration are tightly controlled to assure proper plating conditions, meanwhile allowing fresh solution from the body of the coating tank, to be drawn into the orifices 331 of the perforated electrodes 325.

FIG. 43 is a further diagrammatic view of an electrolytic coating line showing chevron-type wiping blades similar to the arrangement shown in FIGS. 41, and 42 but wherein the centrifugal pumps 323 rather than being attached to an open collection main superimposed over the ends of the chevron wiping blades, i.e. within the volume encompassed by the walls 324*a*, 324*b* and 324*c* in FIG. 42, are instead attached to a multiple manifold arrangement. A series of separate manifolds 335, 337 and 339 disposed on both sides of the line, extend up to or slightly between the chevron wiping blades 329, essentially right up to the edge of the strip 327 and the perforated anodes 325 respectively on the top and below the strip 327. Electrolytic solution is drawn by the manifolds 335, 337 and 339 from between the upper and lower strip surface and the upper and lower perforated anodes 325 while the thin depletion layer, or barrier layer, of depleted electrolytic solution and hydrogen bubbles are, in effect, ploughed from the surface of the strip by the resilient wiper blades and urged outwardly by the wiper blades as fresh electrolytic solution from the main body of plating solution passes or is drawn through the orifices 331 and 333 in the perforated anodes 325 to replace the electrolytic solution directed to the sides by the wiper blades and actively drawn away from the sides into the manifolds 335, 337 and 339. The electrolytic solution passes from the separate manifolds 335, 337 and 339 into common header 326 through which it is drawn to the centrifugal pumps 323. The arrangement shown in FIG. 43 is somewhat more complicated than that shown in FIG. 42, but provides a more positive force, or actually negative force, tending to draw all electrolytic solution, including solution from the depleted surface layer, or barrier layer, plus the hydrogen bubbles, from between the chevron-shaped blades. This provides further assurance that the electrolytic solution is rapidly and regularly changed or replaced, preventing the development of any significant depletion or depleted layer of electrolytic solution adjacent the surface of the strip being electroplated. The orifices in the perforated anode 325 in FIG. 43 are, as in FIGS. 41 and 42, larger behind the chevron wiper sections 329 and smaller along the front of the chevron sections to counteract possible cavitation due to inability of the space between the strip and the perforated anode 325 to fill as quickly as the liquid is swept or displaced from behind the chevron-shaped wiper blades. The larger anode orifices are designated by the reference numerals 331, while the smaller are designated as 333.

FIG. 44 shows the use of a T-section-type wiper blade used against the strip surface of a strip 327 in a modified chevron arrangement. As explained above in connection with FIGS. 32 through 35, the use of a T-shaped wiper blade has certain advantages, the principal one being that it can be used in long lengths and moved progressively, either continuously or discontinuously, across the strip surface as the blade wears so that a fresh blade surface, or at least not a worn down or damaged blade, is presented to the metal substrate or strip surface at all times.

The use of a chevron-shaped wiper blade is also advantageous as the construction not only does a very efficient job of directing both any debris detached from the surface of the strip to the sides, but also of sweeping out to the sides depleted electrolytic solution plus hydrogen bubbles that are removed by the wiping blade from the surface of the strip while fresh electrolytic solution flows into the area between the strip and the anode through perforations in the anode. In the usual chevron wiper arrangement, the wiper blade sections in the two halves of the chevron are comprised of two separate blades even when the two blades as a unit extend entirely across the strip. This allows such blades to readily flex, which flexing is quite important to prevent the blades from wearing severely and also to provide the most effective wiping of the strip surface. If the wiping blade was, on the other hand, a solid bent blade, the shape of the blade would cause it to become essentially inflexible at and in the vicinity of the intersection of the two sections of the blade causing this section and adjoining sections to rapidly wear and interfering with the efficiency of wiping. In view of this relationship between continuous blades and a chevron configuration, it is not practical to have a continuously renewable blade such as shown in FIGS. 32 through 36 with a strict chevron-shaped blade. However, the present inventors have developed a modified chevron configuration in which the center of the blade configuration is curved rather than intersecting at a definite angle. Such a curved configuration at the apex of the blade is shown in FIG. 44 described in further detail below.

In addition to being arranged in curved configuration, the lower portion of the blade itself is slit at intervals as shown in FIG. 45. This allows the flexing portion of the blade to flex independently of adjoining portions of the blade. In FIG. 45 the upper crosspiece of the T-section is designated as 277, as before, and the lower wiping section is designated as 279*a*, while the separate elements between slits 278 in the blade are designated as 279*b*. Such slits enable the lower portion of the blade 279*a* to flex easily, even though the blade is bent transversely. Preferably, the slits in the lower blade 279*a* are indexed at predetermined distances so that when a new section of blade is moved into position, the portion extending over or under the strip has a slit more or less exactly in the center. This allows sufficient resilience or flexibility of the blade to prevent severe wear and to effectively wipe the surface of the strip. This is shown diagrammatically in FIG. 46 where a T-shaped blade 276 without the accompanying or guiding track or guide is shown with a top or crosspiece 277 and the bottom flexible blade 279*a* with indexed slits 278 between discrete blade portions 279*b*. This entire blade is shown bent or curved into the shape it would assume within a blade holder designated for retention between two flanges of adjacent perforated anodes, not shown. At the ends of the blade 276 are two capstans or reels 341 and 343, the first of which is a payoff reel and the second of which is a capstan for drawing the blade off the payoff real. This arrangement is shown from above in FIG. 44 where a series of four payoff reels 341 are disposed next to four blade holders or guides 345 which extend across the strip similar to the blade holder 281 shown in FIGS. 34 and 35. Paired guide rolls 347 are disposed at the entrance to the holders or guides 345 to guide T-section blades into the holders and the blades extend from the bottom of the holders 345 essentially as shown in FIG. 35 to bear against the strip surface. At the opposite ends of the blade holders or guides 345 are four capstans 343 again with paired guide rollers 349 between the capstan and the end of the blade holders 345. As the capstans 343 rotate, the flexible blades 276 are drawn onto the capstans 343. As in FIGS. 42 and 43, the orifices in the perforated anodes are larger behind the blades and holders, i.e. in the curve provided, and smaller in front of the curve of each to counteract possible cavitation behind the blades.

FIGS. 47, 48 and 49 show in three separate but related figures, embodiments of the blade holders 345 in which FIG. 47 shows a T-shape blade holder with a blade encompassed therein similar to the blade holder shown in FIG. 34 without the blade. FIG. 48 shows a cross section of a variation of a T-section blade which is more in the form of an abbreviated cross with an enlarged cross bar together with the holder for such section. The arms of the cross are designated as 353, while the upper portion is designated as 355. The holder 357 has a conforming shape. FIG. 49 shows a cross section of a still further alternative embodiment of a blade section having the configuration essentially of a double cross or double crosspiece telephone pole in which the two arms are designated as 359 and 361. The holder 363 has a single central expansion on both sides in the center of which are two guide vanes 367 which serve to guide or stabilize the elongated blade as it is passed through the holder 363.

The arrangements shown in FIGS. 32 through 35 and in FIGS. 44 through 49 are desirable, but relatively more costly designs in which the flexible wiping blades of the invention can be continuously or intermittently changed or renewed as the blade wears without stopping or interfering with the plating line operation. In arrangements such as shown in FIGS. 19 through 27, on the other hand, the basic hanger and electrode arrangement may make it relatively inconvenient to change the wiping blades of the invention or to rethread a new strip between the blades. A cheaper but relatively less sophisticated arrangement for changing blades and rethreading strip through the line using the basic hanger system shown in FIGS. 19 through 27 is shown in FIGS. 50 through 55 in several alternative embodiments.

Figure 50:
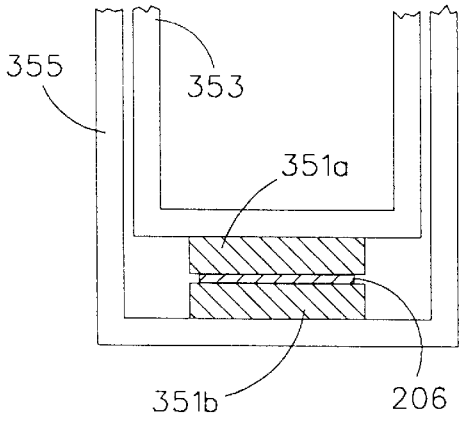
FIG. 50 is a diagrammatic transverse cross section of an arrangement for removing wiping blade anode assemblies shown in FIGS. 23, 25 and 26 from the strip by movement of the hangers in order to thread the strip through the line or replace the wiper blades.
Figure 51:
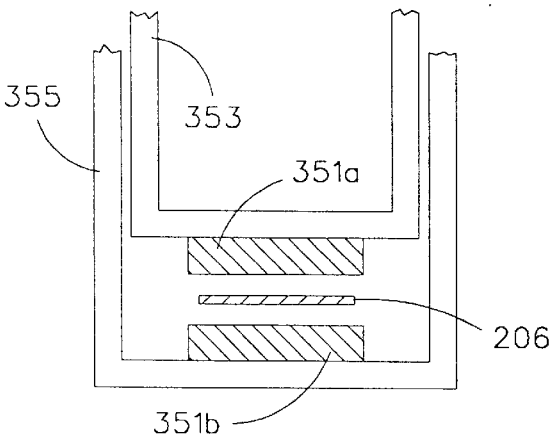
FIG. 51 is a diagrammatic view similar to FIG. 50 showing the hangers and wiping blade anode assemblies in open position.

FIGS. 50 through 55 show diagrammatically alternative arrangements for removing the anodes and flexible wiping blades conveniently from adjacent the surface of the strip both to allow the strip to be conveniently threaded through the otherwise closely spaced wiper blades and perforated anodes and to replace the wiper blades themselves when replacement becomes necessary. In FIGS. 50 and 51 there are shown transverse, or down the line, views of wiping blade anode assemblies 351a and 351b as previously disclosed mounted upon adjacent hangers 353 and 355, which may be independently raised, in the case of hangers 353, and lowered, in the case of hangers 355, as shown in FIG. 51 to open a distance between the wiping blade anode assemblies 351*a* and 351*b* on both sides of the strip 206. The flexible wiper blade and strip are shown diagrammatically in cross section. It will be understood that the hangers 353 and 355 may be supported above the plating tank in any suitable manner, not shown, and can be vertically moved independently in various ways, including manually or by any suitable power and control system, also not shown, when necessary. The hangers 353 and 355 may be separate as shown with the hangers 355 for the lower wiper-anode assembly outwardly displaced with respect to the hangers 353 for support of the upper wiper-anode assembly. Alternatively, the hangers may be slideably interengaged with each other allowing independent up and down movement to displace the wiper-anode assemblies away from the surface of the strip 206 when necessary as shown in FIG. 51.

Figure 52:
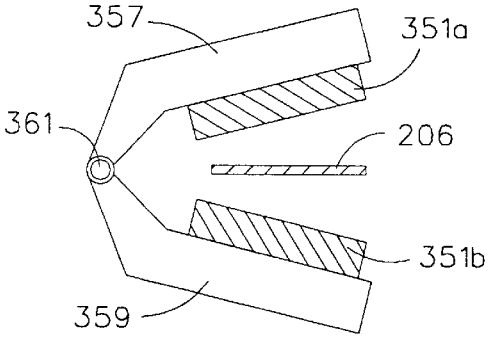
FIG. 52 is a diagrammatic transverse view of an alternative embodiment for opening wiping blade anode assemblies.
Figure 53:
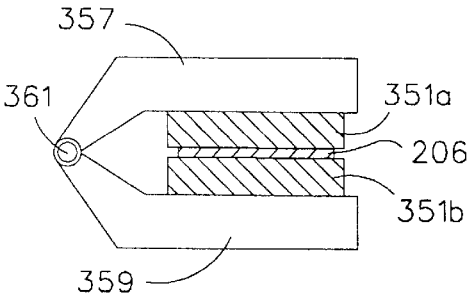
FIG. 53 is a diagrammatic transverse view of the arrangement in FIG. 52 in closed position.

In FIGS. 52 and 53 there is shown an alternative embodiment of a support arrangement for upper and lower wiper-anode assemblies 351*a* and 351*b* in which such assemblies are supported upon scissors-type arms 357 and 359 which may be rotated about an axis 361 by any suitable mechanical means such as interengaged gearing to open the wiper-anode assemblies away from the strip 206 as shown in FIG. 52 or position them against the strip as shown in FIG. 53.

Figure 54:
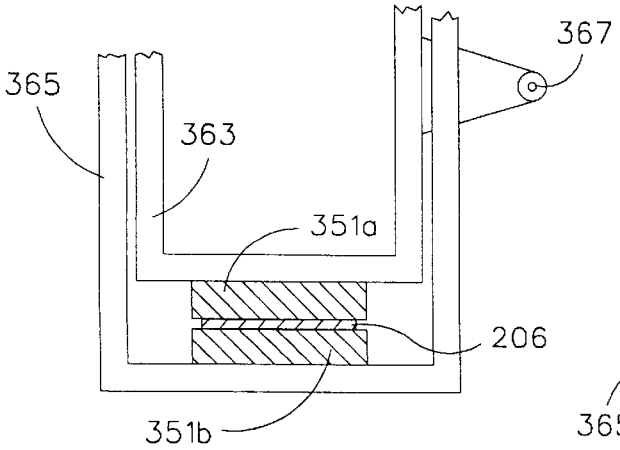
FIG. 54 is a diagrammatic transverse view of a further alternative embodiment of openable wiping blade anode assemblies.
Figure 55:
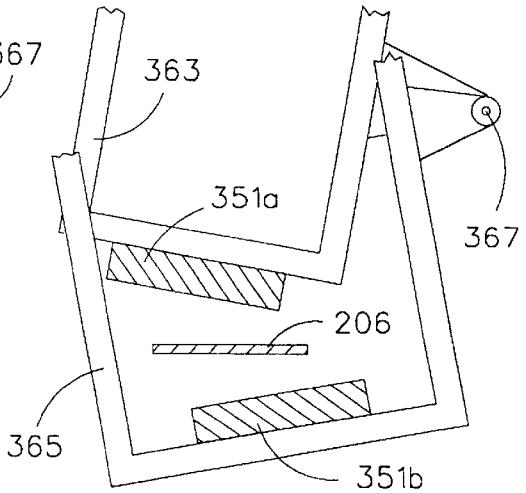
FIG. 55 is a diagrammatic transverse view of the embodiment of FIG. 54 in open position.

The arrangement shown in FIGS. 52 and 53 is very effective in moving the wiper-anode assemblies 351*a* and 351*b* away from and toward or against the strip 206. However, it has the disadvantage of having its working or movable interengaging parts exposed to the electrolytic solution. In FIGS. 54 and 55 there is shown a third embodiment of the invention which avoids this disadvantage by pivoting two more conventional hangers 363 and 365 near the top as shown in FIG. 54 at pivot point 367 allowing such hangers to be pivoted in opposite directions to swing their lower portions away from the strip 206 as shown in FIG. 55. The hangers 363 and 365 are displaced from each other not only transversely as viewed in FIGS. 54 and 55, but also longitudinally with respect to each other, i.e. at right angles to the plane of the paper as viewed in FIGS. 54 and 55. Alternatively, the hangers could be merely displaced longitudinally with a slight extension of the lower portion of the hangers to bring the wiping blades, in particular, into their preferable opposed positions, although it is also possible to have the wiping blades displaced from each other along the strip. However, it is preferable for the wiper blades and the anodes to be substantially opposed to each other in order to maximize the guiding or stabilizing effect of the dielectric flexible blades upon the strip as well as to increase the uniformity of application of the electrolytic coating. By having an offset pivot 367 located above the surface of the electroplating bath, the hangers 363 and 365 can be conveniently swung to either side to remove the wiper anode assemblies from the surface of the strip or sheet in order to allow the strip to be threaded through the apparatus or to replace worn flexible wiper blades.

Figure 56A:
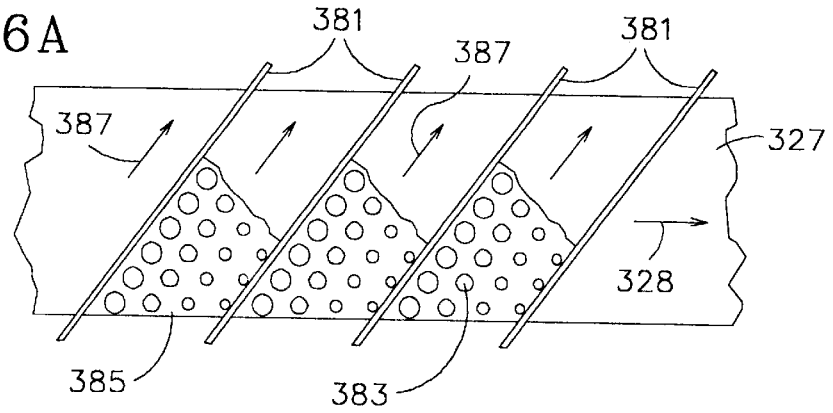
FIG. 56A, 56B and 56C are diagrammatic plan views of alternative arrangements of straight wiping blade assemblies angularly extended across a moving strip.
Figure 56B:
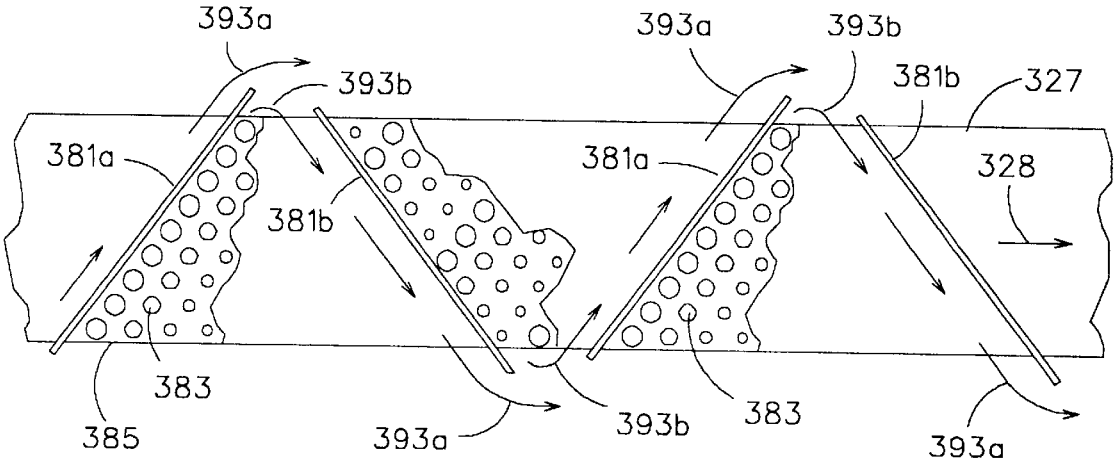
Figure 56C:
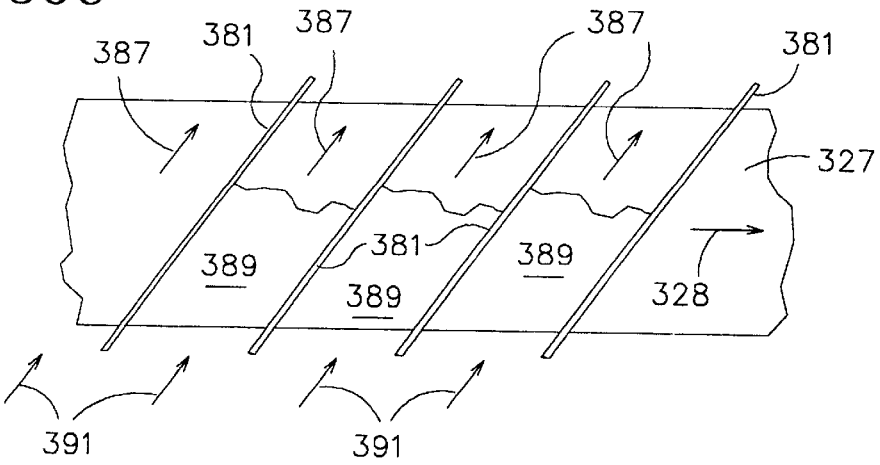
Figure 57:
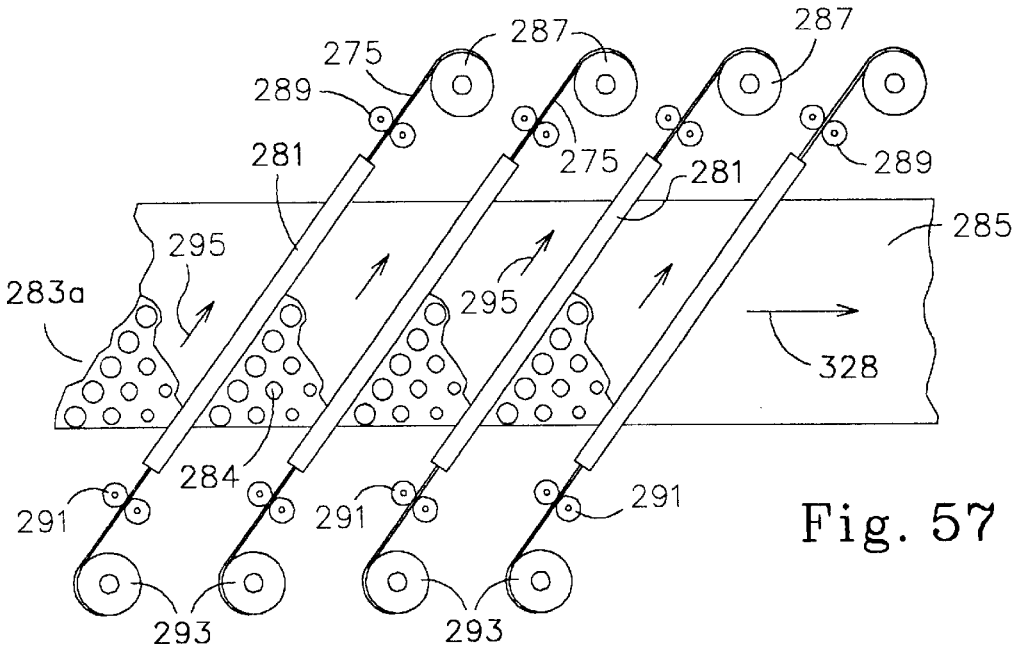
FIG. 57 is a diagrammatic plan view of an assembly of replenishable T-blade-type wiping blades extending angularly across a moving strip.
Figure 58:
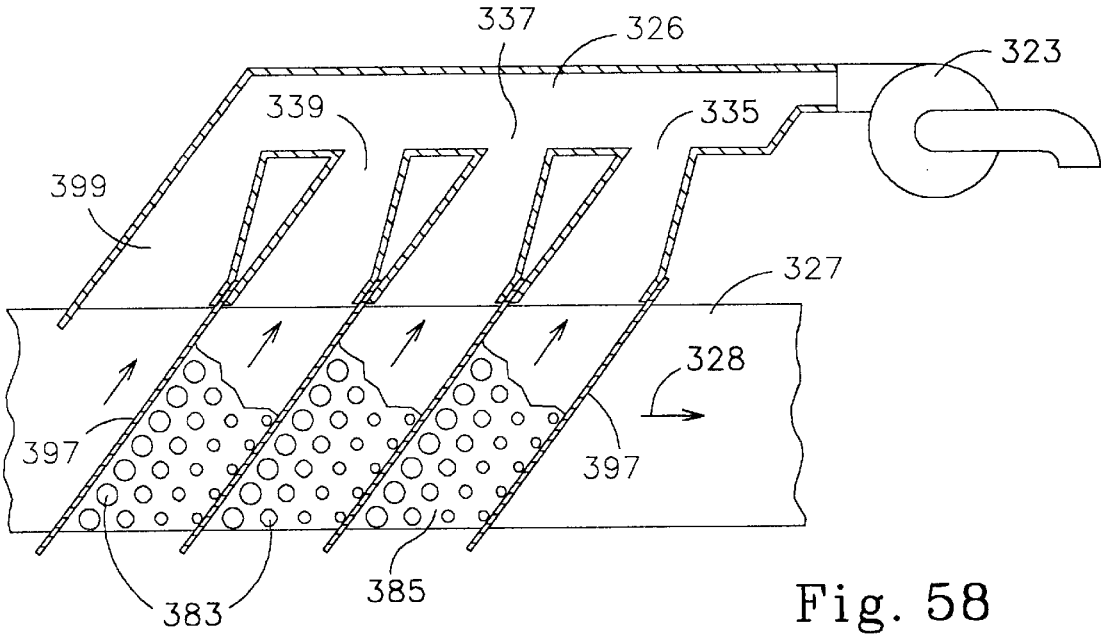
FIG. 58 is a diagrammatic plan view of an arrangement of angled wiping blades extending across a moving strip with a solution exhaust pump arrangement on the downstream side.
Figure 62:
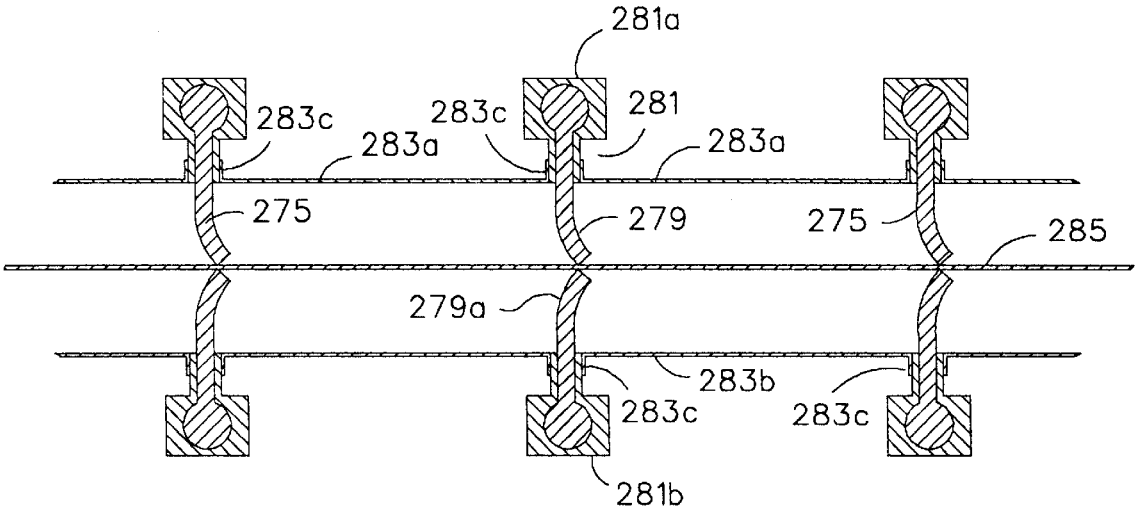

In FIGS. 56, 57 and 58 there are illustrated still further arrangements of the resilient wiper blades of the invention in which the blades, instead of being positioned at right angles with respect to the movement of the strip, are instead extended at an angle across the strip or cathodic workpiece. Such arrangement has the advantage of encouraging a liquid electrolyte or fluid current to flow across the strip or cathodic workpiece, which fluid current can be made to flow in any direction depending upon the angle across the strip assumed by the wiping blade. The arrangement is thus similar to the chevron-type wipers shown in previous figures, see for example, FIGS. 14, 29, 41, 42 and 43, except the flow created is directed to one side only rather than toward both sides of the strip. Liquid flow toward only one side has several significant advantages over splitting the fluid flow and directing such flow toward both sides of the strip as shown in previous figures. Having a more or less uniformly angled blade extending across the strip has the significant advantage, first, of creating a stronger fluid current or flow overall, which increased fluid flow more vigorously removes the electrolytic solution from in front of the wiping blades and sweeps it to the side. Secondly, the advantage of an angled blade is also attained without the principal disadvantage of a chevron-type blade arrangement, which may require a split in the center of the blade to allow the requisite flexibility or resilience of said blade.

In FIG. 56A, 56B and 56C, three possible arrangements of substantially straight, but angled, wiping blades are shown. In the first of these shown in FIG. 56A, a series of resilient wiper blades 381 are shown diagrammatically angled across the strip 327 which moves in the direction indicated by the arrow 328. A series of perforations 383 are provided in perforated anodes 385 which bridge the area between the wiping blades. Such perforated anodes are shown partially broken away to reveal the underlying surface of the strip 327 as well as arrows 387 which indicate the fluid current established in the electrolytic fluid between the perforated anodes 385 and the surface of the strip 327. In fact, with the vigorous fluid current established along the face of the strip by the angled blades, perforations in the anode may not even be necessary, as shown in FIG. 56C where, the same series of angled resilient wiping blades 381 are shown, but have associated with them a series of unperforated anodes 389. It will be understood that in eliminating the perforations in the anodes, as shown in FIG. 56C, the required anode-to-cathode ratio for the best plating using a particular electrolyte will be maintained by the use of indentations, corrugation or other surface area increasing configurations upon the surface of the anode. This expedient is necessary, because, the perforations when used, will be configured and sized so that in combination with the relative thickness of the anode, the overall surface area of the anode compared to the cathodic work surface will usually be increased to meet the particular anode-to-cathode ratio best suited for the particular electrolyte and other coating parameters necessary in the particular coating operation involved. See, for example, FIGS. 2, 5A, 5B and 7, which illustrate diagrammatically a typical dimensional arrangement of an anode having an electrolytically active surface area greater than one. It will be recognized that the other figures herein showing anodes are generally diagrammatic only to illustrate the relative disposition of the anodes and wiping blades with respect to each other and not the relative configurations of the openings in the anodes or the configuration of the total active surface of the anodes. Conventionally, the anode surface is frequently grooved to increase its relative surface area. Combinations of grooves or other surface increasing expedients plus particularly shaped orifices may be used.

The anodes 389 in FIG. 56C are also partially broken away in their top portions to reveal arrows 387 which indicate the direction of flow of current established between the surface of the anode and the surface of the moving strip, between which surfaces the electrolytic solution flows toward the section of the strip shown at the top. The flow of the current is all in one direction, as shown at the top of the figure by the arrows 387 where the anodes 389 have, as indicated, been partially broken away. Likewise, the flow into the space between the anodes 389 and the surface of the strip is completely from one side, as shown by arrows 391. Such flow from the side is usually sufficient to completely flush away depleted electrolytic solution which is physically forced away from the strip surface by the resilient wiper blades and is immediately caught up and mixed with the flow of electrolytic solution flowing through the space between the anode and strip surfaces and thoroughly flushed from between the strip surface and the electrode by the fluid current induced. Such depleted solution is then replaced by fresh solution flowing in from the opposite side of the strip.

FIG. 56B shows an alternative arrangement of slanted or angled wiper blades in which alternate blades are angled in opposite directions, or at opposite angles. In this arrangement, the liquid flow is first across the moving strip from one side and then across the strip from the other side. This arrangement provides a more even mixing in the bath on both sides, but has the drawback of inducing a flow into the small end of the space between two angled wiper blades and out of the larger end resulting in a definite tendency to have a progressively lessening flow across the strip, somewhat counterbalanced by the use of perforations in the anodes. In FIG. 56B, there are shown a series of four angled wiper blades 381*a* and 381*b*, the blades 381*a* being inclined downstream of the moving strip to the left as viewed from above and the blades 381*b* being inclined downstream to the right. Both sets of blades 381*a* and 381*b* have their trailing ends extended farther to the side of the strip than the leading ends of the adjacent blades. This serves to at least partially direct the current of electrolyte solution about the longer trailing end of the resilient wiper blades in a transversely displaced path such that it more or less completely bypasses the adjacent leading end of the next adjacent wiper blade as shown by the arrows 393*a*. The flow along the adjacent wiper blade therefore tends to be derived from above and below the strip, as shown by the rear curved portion of the arrows 393b. Perforated anodes 385 in FIG. 56B allow additional electrolytic solution to be drawn in through orifices 383 in the anodes from the top and bottom areas of the bath next to the strip to compensate for the gradually increasing size of the opening between the wiper blades and to secure a more constant flow across the strip surface which aids in flushing away the depleted electrolytic solution physically scraped or diverted by the wiping blades 381*a* and 381*b* from the depletion layer next to the strip and normally carried along with the strip surface.

In FIG. 57 there are shown a series of slanted or angled replaceable wiper blades such as shown in FIGS. 32 and 36, the difference from the previous figures being that the blade is drawn across the strip surface at an acute angle, as shown in FIG. 57, rather than at a right angle to the strip, as shown in FIG. 36. This has the advantage over the arrangement shown in FIGS. 44 and 46 that the continuous wiping blade does not need to be slit to maintain its flexibility or resilience in the vicinity of the intersection of the chevron-shaped blade or in the arcuate section of a generally chevron shaped blade having a curved apex, thus eliminating any leakage through the slits, or discontinuities, in the blades, while still maintaining a snowplow-like action on the surface of the strip. Such snowplow-like action aids in establishing a transverse movement of electrolytic solution across the strip, thus aiding in flushing away the depleted electrolytic solution removed from adjacent the surface of the moving strip by the action of the resilient wiping blade. The various parts shown in FIG. 57 use the same reference numerals as in FIG. 36 in which the continuous resilient wiper blade 275 passes from a reel 287, between a pair of guide rolls 289 and into a blade holder or retainer guide 281 mounted preferably between perforated top anodes 283*a* and bottom anodes 283*b*, not shown, anodes 283*a* being partially broken away to reveal arrows 295 indicating the general flow of electrolytic solution between perforated anode 283*a* and the surface of the strip 285. Each of the anodes 283*a* and 283*b* are provided with perforation or orifices 284, which are shown as differentially sized orifices such as disclosed in FIG. 41. Such differentially sized perforations may be advantageous because the movement of the strip tends to urge the electrolytic solution more toward the downstream wiper blade. However, more or less uniform sized orifices can also be used. From the holder or retainer guide 281, the continuous flexible blade 275 passes between two further guide rolls 291 and then onto a reel 293.

While the angle of the wiper blades 275, for convenience, are shown in FIG. 57, as well as in FIGS. 56 and 58, as being approximately 45 degrees with respect to the strip in the direction of movement of the strip, the greater the angle the faster the flow induced across the strip. An angle of approximately 45 degrees will usually be found very satisfactory to obtain an effective flow. The actual preferred angle is that angle which will result in sufficient flow to quickly flush out or away from the vicinity of the wiping blades all depleted electrolyte and hydrogen bubbles which might otherwise tend to slow down plating action. It may be undesirable to have too acute an angle between the strip and the wiping blade because the depleted electrolytic solution, although rapidly diluted with flowing electrolytic solution, is maintained longer on or between the strip and electrode surfaces. However, a fairly steep angle of the blade with the strip is usually desirable.

FIG. 58 shows a still further embodiment of angled resilient wiper blades in which the flow of the electrolytic solution in one direction toward one side of the strip is taken advantage of by using a forced solution removal pumping arrangement such as shown in FIG. 43, for example, but only on the one side of the strip. Thus, by angling the wiping blades across the strip as shown, only as little as one half the capital cost for a pumping system may be required. Merely taking the same amount of electrolytic solution from one side of a strip as taken in the original arrangement would not ordinarily cut capital expenditure by a major amount, since the same pump volume and power might still be required, even though handled in a more restricted area. However, it must be recognized that angling the resilient wiping blade more efficiently converts the movement of the strip itself into energy available to create a movement of electrolytic solution more efficiently to one side and thus, in effect, decrease the energy input required for the pump to remove, or draw the same volume of solution into the pumping system. Thus the simpler exhaust or pumping system saves energy and capital cost overall. In FIG. 58 the straight angled wiper blades are indicated by reference numerals 397, while the partially broken-away perforated anodes 385 allow additional flow of electrolytic solution from the top and bottom. As in FIG. 56C, the anodes could, if desired, be unperforated, so long as a proper anode-to-cathode ratio is maintained for the particular coating involved, since the flow of electrolytic solution will be established from the side and will be continuously maintained by the combination of the angle and the movement of the strip transverse to said angle tending to move the solution to the side. This results from the induced component of motion of the electrolyte to the side as its continued movement along with the strip is blocked by the dam interposed by the wiping blade. Because of the rapid induced flow to the side, the electrolytic solution is completely changed in a very short period, maintaining fresh solution next to the strip surface and rapidly flushing away depleted solution and hydrogen bubbles diverted by the wiping blade from adjacent to the surface of the strip very rapidly. At one side of the strip is a pump 323, preferably a centrifugal pump as shown in FIG. 43, having an inlet leading to a main manifold 326 with a plurality of separate individual manifolds 335, 337 and 339 connected with one side of the spaces between the wiping blades. In addition, there is shown in FIG. 58 an improvement comprising an additional separate manifold 399 arranged in front of the series of blades 397, which separate manifold 399 also aids in drawing away electrolytic solution which is deflected to the side of the initial slanted or angled resilient wiping blades 397, thus aiding in directing said electrolytic solution to the side and out into the body of the coating bath, rather than over the tops of the perforated anodes where it might be drawn in again to the surface of the strip before being thoroughly diluted by the fresh bath solution.

In FIG. 28, there is shown an end section or cross section of a modification 275*a* of the T-section blade shown in FIGS. 25 and 26 in which the upper portion of the blade takes the form of a round or "beaded" section 277*a*. Such a preferred blade construction has much greater transverse flexibility so it can be reeled or coiled and the like, which flexibility the T-blade lacks.

FIG. 29 shows an end or cross section of the beaded blade 275*a* shown in FIG. 28 with a track or holder 281*a* which holds the blade 275*a* and through which it may be. pulled or pushed longitudinally. The holder or track 281*a* may be conveniently formed of a plastic material such as polypropylene.

FIG. 30 is an end or cross section of a tear drop blade section 275*b* in a holder or track 281*b*. The teardrop blade, which it will be recognized is similar to the tapered blades shown in FIGS. 13 through 15, also has superior transverse flexibility and thus reliability and is, therefore, also a preferred construction, although not as preferred as the beaded construction shown in FIGS. 28 and 29. Both can be used when it is desired to reel or coil continuous wiper blades.

FIG. 31 shows a series of beaded blade holders or tracks 281*a* mounted between flanged anodes 283*a* and 283*b* at the top and the bottom of a strip 285, respectively. It will be seen that the beaded blades 275*a* have been slipped into upper and lower beaded blade holders 281*a* and 281*b* from the side and such beaded blade holders 281*a* and 281*b* have been used as flange supports to which the flanges 283*c* of the upper and lower flanged anodes 283*a* and 283*b* have been attached by any suitable securing arrangement. Such attachment may be by welding, brazing or other suitable securing means including mechanical securing which is effective to provide a permanent attachment of the flanges to the T-section supports. Welding or brazing might be used if the metallic track for the T-section shown in FIG. 27 is used, but a mechanical connection such as threaded fastening or even a clip arrangement will be more appropriate in use of the plastic tracks shown in FIGS. 29 and 30. It is not so important in this embodiment for the flanged anodes to be disassembled to allow new wiping blades to be inserted between the flanged anodes as in the previously illustrated embodiments, since the blades can be inserted into the tracks from the side. Consequently, permanent attachment of the flanges of the anodes can be made to the T-blade, beaded blade, tear-drop blade or other like potentially continuous blade support means.

FIG. 32 is a top, partially broken-away view of the beaded section-type wiping blade 275*a*, designated here for convenience as 275, being fed at a controlled rate across the strip 285 in the holder 281 between adjoining perforated anodes 283*a*. It will be understood that a similar perforated anode 283*b*, not shown, will be directly below the upper anode 283*a*. The anodes 283*a* and 283*b* have perforations 284, preferably staggered or overlapping perforations as in the other illustrations. The coil 287 of beaded wiping blade which is able to coil into a fairly tight roll or coil due to the small size or transverse dimensions of the beaded portion of said beaded blade is held in coil form on a reel and guided as it unwinds by the guide rolls 289, which are shown located at the entrance to the holder or track 281. The guide rolls 289 are positioned between the coil 287 and the beaded section guide or beaded blade holder 281*a* directly in line with the opening in the beaded blade holder so that as powered drive rolls 291 are turned, the beaded section is pulled into the end of the beaded blade holder 281 where it is held loosely so that it can be passed through the holder and out the other side between two guide-drive rolls 291 also in line with the end of the beaded blade holder 281. The drive rolls 291 feed the beaded blade 275 onto a take-up reel 293 which may itself also be powered.

The beaded blade holder 281 may be provided with resilient material, not shown, which may take the form of either a resilient plastic material or a series of spring-loaded guide plates, not shown, along the inside top of the beaded blade holder 281 which bear against the upper flange bead of the beaded blade such that the beaded blade is stabilized within the holder and bears against the strip 285 passing between the two perforated anodes 283a and 283*b*. As shown in FIGS. 28, 29 and 31, the lower portion or principal blade portion 279*a* of the beaded-blade 275*a* is preferably flexed as in previous embodiments of the wiping blade against the strip 285 to provide a very light wiping pressure against the strip and also to stabilize the position of the strip between the two anodes. As will be understood, while the strip is only very lightly touched or "kissed" by the tips of the blades as the strip 285 passes between the flexed portions 279a of the blades 275, if the strip is displaced either up or down, it will immediately place additional pressure against the flexible or resilient blade 279*a* causing such blade to flex more strongly and place a higher pressure against the side of the strip, thus tending to force the strip back into the central position between the two blades. In this way, the strip is very effectively stabilized between the blades, even though the blades do not press upon the strip with any great pressure and the blades do not interfere with the coating of the strip from the electrolyte adjacent the surface of the strip.

FIG. 44 shows the use of either a T-blade or a beaded section-type wiper blade used against the strip surface of a strip 327 in a modified chevron arrangement. As explained above in connection with FIGS. 59, 60 and 63, the use of a beaded shaped wiper blade has certain advantages, the principal one being that it can be used in long lengths and moved progressively, either continuously or discontinuously, across the strip surface as the blade wears so that a fresh blade surface, or at least not a worn down or damaged blade, is presented to the metal substrate or strip surface at all times.

The use of a chevron-shaped wiper blade, as disclosed in FIGS. 44, 45 and 46, is also advantageous with continuous blades such as shown in FIGS. 59 through 62 as the construction not only does a very efficient job of directing both any debris detached from the surface of the strip to the sides, thus avoiding scratches, but also of sweeping out to the sides depleted electrolytic solution plus hydrogen bubbles that are removed by the wiping blade from the surface of the strip while fresh electrolytic solution flows into the area between the strip and the anode through perforations in the anode.

In addition to being arranged in curved configuration, the lower portion of the blade itself is slit at intervals as shown in FIG. 34. This allows the flexing portion of the blade to flex independently of adjoining portions of the blade. In FIG. 34 the upper crosspiece of the beaded section is designated as 277*a*, as before.

FIGS. 63, 64, 65, 66 and 67 show in three separate, but related constructions, embodiments of the blade holders 345 in which FIG. 63 shows a beaded shape blade holder with a blade encompassed therein similar to the blade holder shown in FIG. 60 but with a somewhat different lower section on the blade holder 345 adapted for a somewhat different electrode and hanger system. FIG. 64 shows a cross section of a variation of a T-section blade which is more in the form of an L-section 355 with a short flange 357 on the top with the holder 359 for such section. The holder 359 has a conforming shape. FIG. 65 shows a cross section of a still further alternative embodiment of a blade section having the configuration essentially of a thin flat blade but formed from a series of short closely spaced or packed bristles 363 in a plastic holder 365. The holder 365 has a generally rectangular shape similar to that of holders 345 and 359. FIGS. 66 and 67 show respectively a side elevation and a bottom view the wiping blade section 361 shown in FIG. 65. The upper portions 367 of the individual bristles 363 are bound together into a unitary structure that acts as a single wiping blade which can be in some cases drawn separately through the holder 365 as a unitary element. FIG. 68 is an isometric view of a hanger and anode assembly in which the embodiments of wiping blades shown in FIGS. 63 through 67 can be accommodated between unitary sectionalized sections of perforated electrode sections. In FIG. 68 hangers 367 support individual flanged perforated anodes 369 having rectangular openings 371 between them into which the various plastic tracks 345,359 or 365 of FIGS. 63, 64 or 65 fit to accommodate the flexible wiping blades.

The arrangements shown in FIGS. 59 through 62 and in FIGS. 63 through 68 are desirable, but relatively more costly designs in which the flexible wiping blades of the invention can be continuously or intermittently changed or renewed as the blade wears without stopping or interfering with the plating line operation merely by sliding the blade into and out of its track from the side. In arrangements such as shown in FIGS. 19 through 25, on the other hand, the basic hanger and electrode arrangement may make it relatively inconvenient to change the wiping blades of the invention or to rethread a new strip between the blades.

Figure 69:
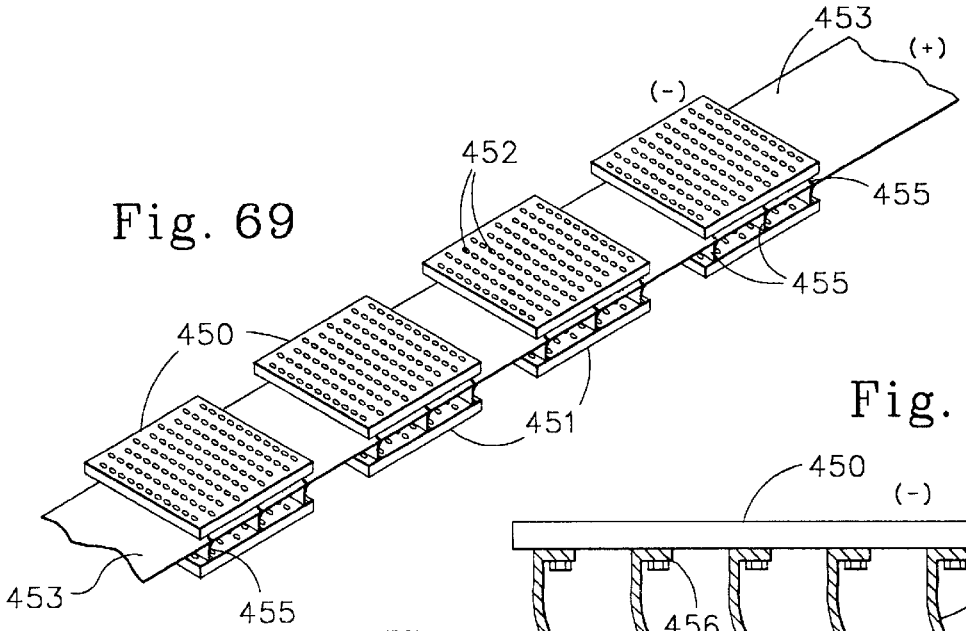
FIG. 69 is a diagrammatic partial cross section across a continuous anodizing line similar to the electroprocessing lines shown in prior views.

FIG. 69 is a diagrammatic isometric view of a typical anodizing section of an anodizing line showing a series of upper cathodes 450 and opposed lower cathodes 451 between which passes an aluminum or other anodizable extended metal section, or workpiece, frequently referred to in the anodizing art as the "web", which may be sheet or strip material, foil or other gauges of aluminum material. It will be understood that the "web" material will be passing through a electrolyte typically held in a tank, not shown. The electrolyte may be a 10 or 15 percent solution of a strongly ionized acid such as sulfuric acid, chromic acid or dibasic or organic acids such as oxalic acid or the like, or mixtures of various acids. The electrodes may be any metal not readily dissolved by the electrolyte. The electrodes are made cathodic by being included in a suitable circuit, usually, but not necessarily, a direct current circuit and the web material is rendered anodic either by contact rolls at another portion of the line or by passage through so-called contact cells where electrons are removed from the web through an electrolyte to leave the web effectively anodic. Appropriately charged electrodes which may be of various kinds such as grids and solid electrode members positioned adjacent the web just before the actual anodizing section are conventionally used for this purpose.

Figure 70:
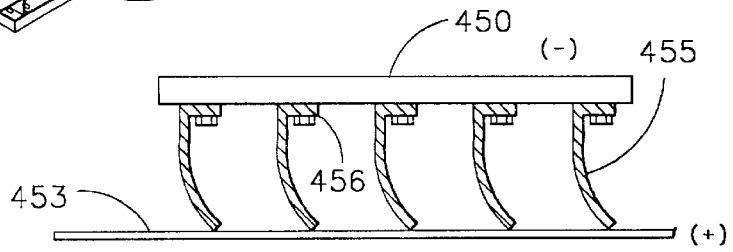
FIG. 70 is an enlarged side view of an arrangement of flexible wiping blades in accordance with the invention in use in an anodizing operation.
Figure 71:
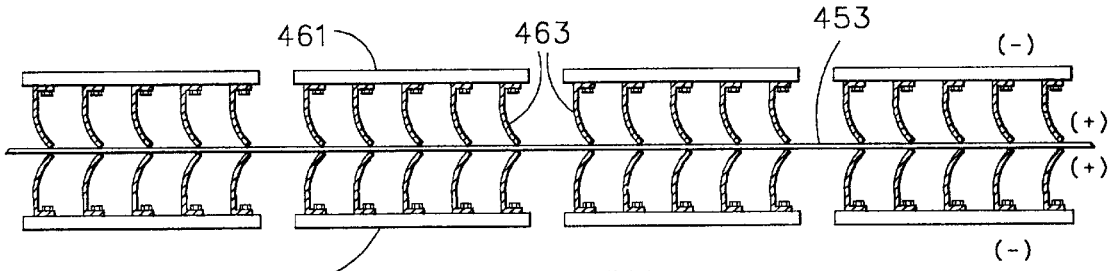
FIG. 71 is a diagrammatic side view of a series of the wiping blades of the invention in use on an anodizing line.

Mounted upon the electrodes or cathodes 450 and 451 in the anodizing section of the anodizing line shown in FIG. 69 are flexible wiper blades 455 which may be any of the flexible wiper blades disclosed in previous figures for use in electroplating operations or may very practically be of the type shown in FIG. 70 which comprises a series of L-type blades such as disclosed in FIG. 64 secured to the surface of the electrode by suitable screw-type or other fastenings. Another similar arrangement using T-shaped flexible wiping blades is shown in FIG. 71.

Figure 72:
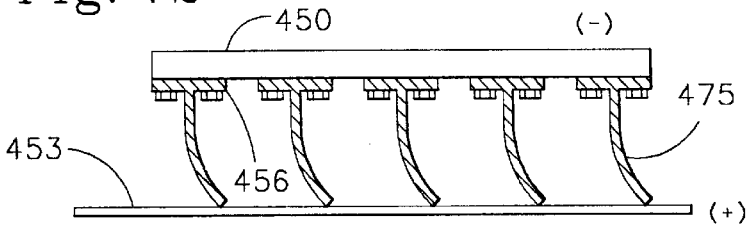
FIG. 72 is an enlarged side view of a series of T-blades in accordance with the invention in use on an anodizing line.

FIG. 72 is a side view of the anodizing section of an anodizing line such as shown in FIG. 69 showing a series of upper and lower cathodes 461 with flexible wiper blades 463 secured to their surfaces and contacting an anodic strip 453. It will be noted that the cathodes shown in FIG. 69 are perforated with orifices 452 to allow the heated electrolyte wiped from the surface of the anodic web 453 to be freely expelled not only from the open sides of the electrodes, but also through such orifices 452 to be replaced by cooler electrolyte from other sections of the electrolytic bath. Anodizing cathodes do not normally use the additional ratio of surface area of electrode over area of strip to be treated, however, and the orifices can less preferably be dispensed with, as shown in FIG. 72. If the same construction is used for electroplating the perforations will normally or preferably be used.

Figure 73:
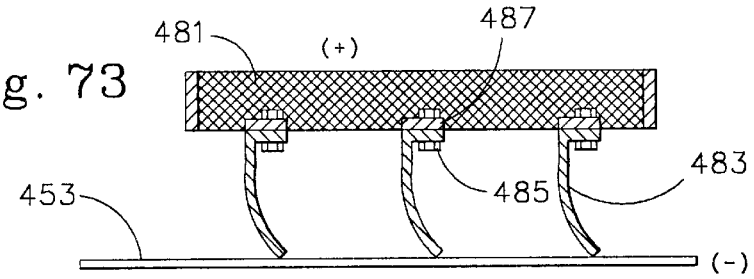
FIG. 73 is a diagrammatic side view of a series of L-shaped flexible wiping blades as shown in FIG. 70 applied to the lower portion of an electroplating basket used on an electroplating arrangement.

FIG. 73 shows a further arrangement of a soluble electrode arrangement using the flexible wiping blades of the invention in an electroplating operation. In FIG. 73, an electrode basket 481 made from an insoluble material such as titanium is provided to hold soluble electrode material and the flexible wiping blades 485 of the invention are secured to reinforcing bars 487 in the lower portion of the basket by fastenings 485. Frequently, there will be a plastic net filter (not shown) with relatively fine pores over the basket 481 to prevent inclusions in the soluble electrode material from contaminating the electroplating bath and possibly causing defects upon the surface of the finished plated product.

FIGS. 74 and 75 are a top view and a cross section through a somewhat different form of flexible plastic wiping strip related to the honeycomb-type wipers shown in FIGS. 37 through 40. In FIGS. 74 and 75, a flexible plastic mesh 401 of transversely flattened members 403 and 404 arranged in an intersecting grid arrangement and having a mesh or membrane thickness typically of about ⅛ to ¼ inches is used as a wiper. The plastic mesh member may be either held against the surface of the strip being anodized or electroplated as it passes the plastic mesh membrane in a manner similar to the manner in which the honeycomb wipers of FIGS. 37 through 40 are held against the strip or may be preferably continuously drawn across the strip to be coated or anodized from one side to the other to wipe the strip, removing hydrogen or oxygen bubbles as the case may be, wiping or sweeping away any excessively depleted or heated layer of electrolyte on the strip as the case may be and also preventing the strip from touching the adjacent electrodes and arcing. The mesh membrane may have relatively flat interconnecting members as shown in FIGS. 74 and 75, for example, substantially flat longitudinal mesh sections 401 intersect at right angles with vertical, or transverse, mesh members or sections 403 as seen in FIG. 74. However, the mesh sections could also less desirably be rounded or arcuate in cross section.

The advantage of the relatively thin plastic mesh shown in FIGS. 74 and 75 is that it can be bent, allowing it to be held upon or reeled upon a reel or the like or passed about guide or coating rollers. FIG. 76 shows such an arrangement in which pairs of power-driven upper reels 405 and 407 and lower reels 409 and 411, respectively, unreel and reel thin, flexible mesh or grid-type wiper material in the form of strips or belts 413 and 415 which pass between the two reels 405 and 407 and 409 and 411 between a moving anodic workpiece 417 and adjacent upper and lower perforated cathodes 419 and 421, see in particular FIG. 77 which is a cross section of FIG. 75 along section line 77—77 with the mesh-type belts 413 and 415 closely spaced and preferably touching the strip 417 as it passes across the strip surface from side to side.

For convenience in illustration, the payoff reel or roll 409 and take-up reel or roll 411 of mesh-type wiper material is shown at the bottom of the view rather than being shown directly below the payoff reel or roll 405 and take-up reel or roll 407 where it would normally be situated so the reels or rolls would be outside the anodizing or plating tank, not shown, the level of electrolyte in the tank being at all times over the cathode or anode 419.

It will be seen in FIG. 77 that the plastic mesh belts 413 and 415, while closely adjacent to the surface of the cathodic or anodic strip, are spaced from the perforated anodes or cathodes 419 and 421. Such arrangement is necessary, as is the space between the strip and the cathode in FIG. 77, to prevent uneven camber anodic or cathodic strip from becoming, so to speak, stuck between the belts if they were touching the surface of the cathodes or anodes which are relatively immovable. Even large burrs on the edge of the strip or wavy strip edges might tend to jam the strip between the cathodes. While the flexing blades shown in previous figures, for example, in FIGS. 5, 19, and 26 and the like, all by their normal flexure can relieve force exerted by out-of-camber strip passing between the blades, if the mesh-type wipers shown in FIGS. 74 through 80 were entered into a close tolerance space between immovable anodes and a variation in the effective strip thickness caused by camber or the like or torn edges on the strip occurred, such variation in effective thickness could readily jam the strip between the mesh-type wipers and the cathodes causing tearing, or worse, of the mesh and quite likely also damage to the strip itself. Consequently, in FIGS. 76 and 77, the mesh material 413 and 415 is shown held against the strip 417, but not against the cathodes 419 and 421 as the case my be. While the movement of the mesh material is thus not as effective to strip away or remove heated or depleted electrolyte from between the anodes and the strip, a fairly effective removal of heated or depleted electrolyte and replacement with fresh cooler electrolyte brought in from the side takes place.

FIGS. 78, 79 and 80 are plan views of additional patterns of mesh-type wiping materials that may be drawn across the strip in the same manner as shown in FIGS. 76 and 77 to remove oxygen, or hydrogen bubbles, strip away excessively heated or depleted electrolyte from the surface of the strip and prevent too close approach of the workpiece to the electrodes, thus preventing arcing between the workpiece and the electrodes. The thickness of about one eighth to one quarter inch of the mesh material plus its dielectric composition is sufficient to prevent arcing due to too close approach of the strip and electrodes.

Figure 81:
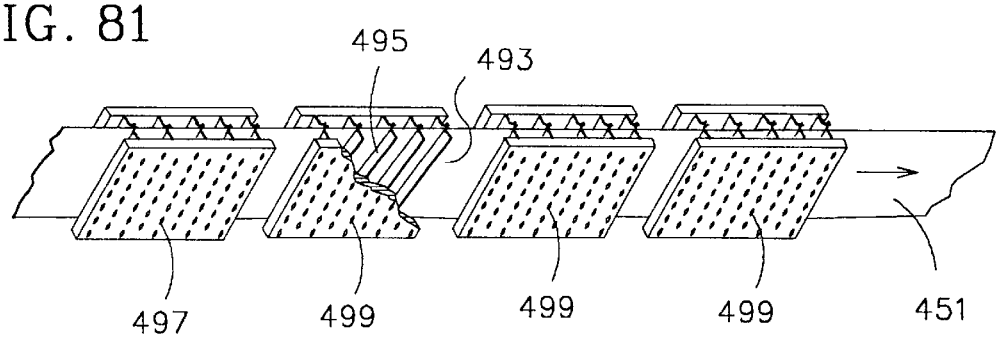
FIG. 81 is an isometric view of a strip oriented vertically in an anodizing operation using the flexible wiping blades of the invention.

It is not unusual in the anodizing of metal substrates to run a strip or sheet of aluminum or other light metal, or light metal coated base metal, through the bath on one edge, or vertically oriented, instead of horizontally oriented. Such disposition allows the troublesome oxygen bubbles to be displaced from both surfaces by their own buoyancy, particularly on what might otherwise be the underside of the sheet or strip where the buildup of bubbles of oxygen is particularly troublesome. The strip can, of course, also be run consecutively over guide rolls into a series of vertical loops having vertical runs between them. This is effective to eliminate large bubbles, but is relatively ineffective against small oxygen bubbles that can cling to the sheet or strip by normal adhesion or capillary attraction and in the case of vertical loops or runs of strip, the guide rolls occlude significant amounts of strip surface. In addition, while the vertical orientation of the strip also tends to encourage the migration upwardly of an excessively heated electrolytic layer next to the strip, such tendency to rise is relatively minor. Consequently, the use of the present invention in the form of flexible plastic wiping blades is very beneficial for use with vertically oriented strip as well as horizontally oriented strip. Such use is shown in FIG. 81 where a vertically oriented strip 491 positioned in an electrolytic anodizing bath, not shown, on one edge is provided with a series of flexible plastic wiping blades 495 also disposed with a vertical orientation preferably somewhat slanted so the movement of the electrolyte is encouraged to be upwardly. In other words, the lower portion of wiping blade will be somewhat advanced on the sheet surface counter to the movement of the strip encouraging the buoyancy of detached bubbles and heated electrolytic solution to aid the wiping blade in moving such bubbles and solution upwardly. Thus, in FIG. 81, the strip 451 passes an upwardly slanted wiper blade 493 which wipes the oxygen bubbles and hot solution in a generally upwardly direction from the surface of the strip as shown by arrows 495, some of the solution and bubbles passing through the orifices in the 497 in cathodes 499. This wiping action strips the surface of the sheet being anodized periodically of both oxygen bubbles and also excessively heated surface electrolyte as well as serving to stabilize the position of the strip between the wiping blades, allowing the cathodes to be more closely spaced to the anodic strip and allowing a greater current or current density to be attained with lower total power.

While the collection of bubbles of oxygen at the anodic surface is the principal difficulty with gas bubbles in anodizing, the hydrogen bubbles that gather upon the cathode also tend to insulate the cathode from the electrolyte, thus interfering with the achievement of high current densities at economical power factors. Consequently, it will be beneficial in some cases to wipe the cathode surface as well as the anodic strip surface. This can be conveniently done in an anodizing operation by passing a series of thin loops of the geometric plastic mesh shown in FIGS. 74 and 75, 78, 79 or 80 past the surfaces of both the anodic strip and the cathodic electrodes. In such case, since it is desired to contact both the surface of the strip and the surface of the cathode at the same time, usually with opposite sides of the plastic mesh, an arrangement for allowing the electrodes or cathodes to move outwardly to relive pressure against the strip, if an out-of-camber strip or strip with uneven edges passes between opposed moving geometrical mesh, is necessary. Such relief can be attained with an arrangement somewhat as shown in FIG. 40 where the cathodes are mounted on resilient means such as springs or the like to keep the honeycomb wiper section always resiliently against the strip surface.

Figure 82:
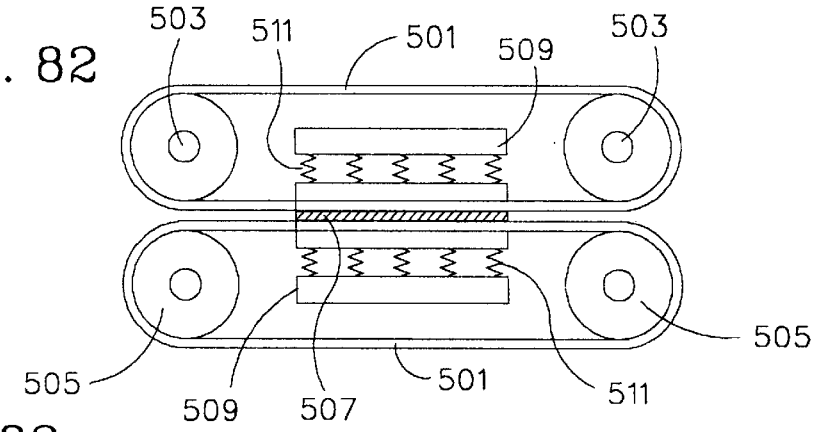
FIG. 82 is a transverse section of an anodizing line incorporating an endless mesh-type belt embodiment of the invention.

In FIG. 82, a pair of continuous belts 501 of plastic mesh such as shown in FIGS. 74, 75, 77, 79 or 80 are passed about two pairs of guide rolls 503 and 505 with one reach of each continuous loop passing between the surface of the anodic strip 507 and the cathodes 509 on both sides as shown. The cathodes 509 are biased toward the belt 501 by resilient spring means 511 bearing against any suitable support which spring means not only keep the cathode against the strip, but also allow the cathodes to move away from the strip 507 and the belt 501 if the effective transverse dimensions or thickness of the strip varies so the strip is continuously subjected to a light contact pressure only sufficient to keep the wiping elements, i.e. the mesh pattern belt 501, against the strip.

A further possibility would be to provide extensions of the grid pattern in a transverse direction to form thin resilient extensions in the form of transverse blades on both sides of the mesh belts which flexibly contact the surface of both the strip on one side and the cathode surface on the other. The belt may have an outer section on both sides lacking the thin flexible blades and around which the belt is journalled on suitable rotatable support rolls or the like to maintain rotatability of the mesh belt without bearing upon the thin flexible wiping sections extending from both sides of the belt. The belt is continuously rotated in these arrangements to continuously wipe the surface of both the anodic or cathodic strip and the nearby cathodic or anodic electrode. A belt arrangement having thin wiping blades extending from both surfaces is shown in FIG. 83 in which the reference numeral 521 designates a continuous flexible geometric mesh belt having flexible blade portions 523 on the outside and 525 on the inside journalled about rotatable guide wheels or rolls 527 on both sides so the flexible blades are continuously moved transversely across and against both the anodic strip 507 and the cathodes 511.

Figure 83:
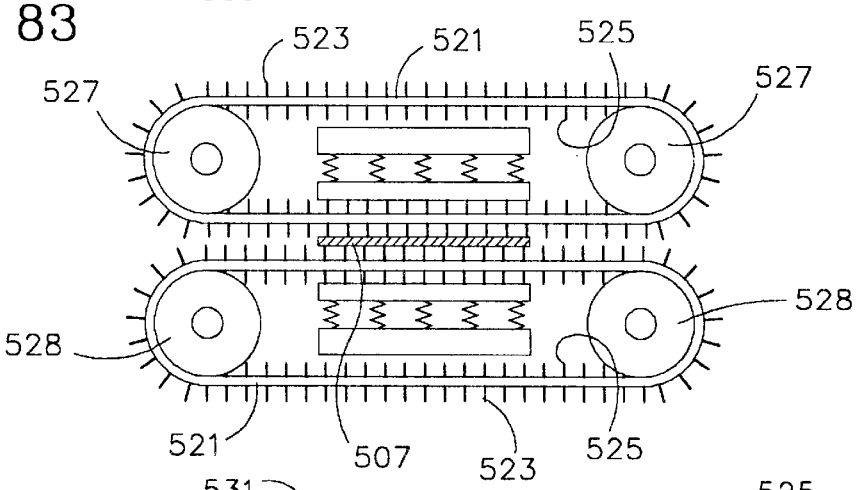
FIG. 83 is a transverse section of an anodizing line using an endless mesh-type belt embodiment of the invention having flexible wiping extensions transversely across the belt.
Figure 84:
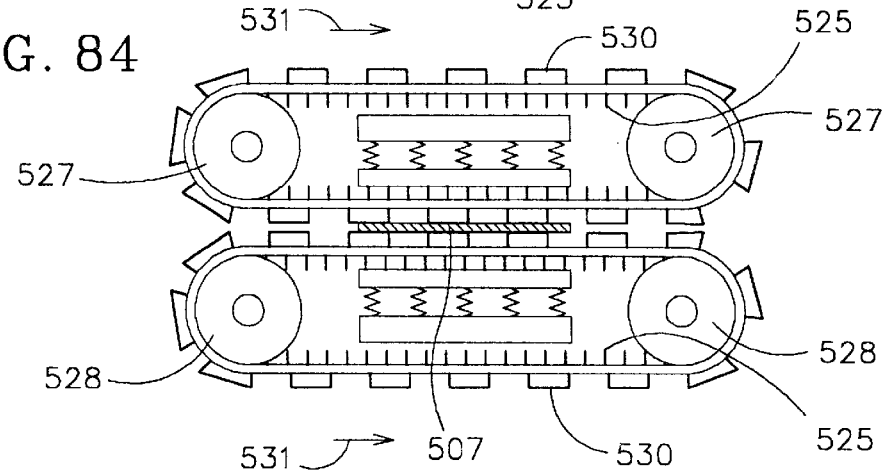
FIG. 84 is a transverse section of an anodizing line using an endless mesh-type belt embodiment of the invention having flexible wiping extensions transversely across the belt as in FIG. 54, but in which the flexible wiping extensions or blades on the exterior of the belt are disposed at an angle with respect to the belt as well as the strip or web.
Figure 85:
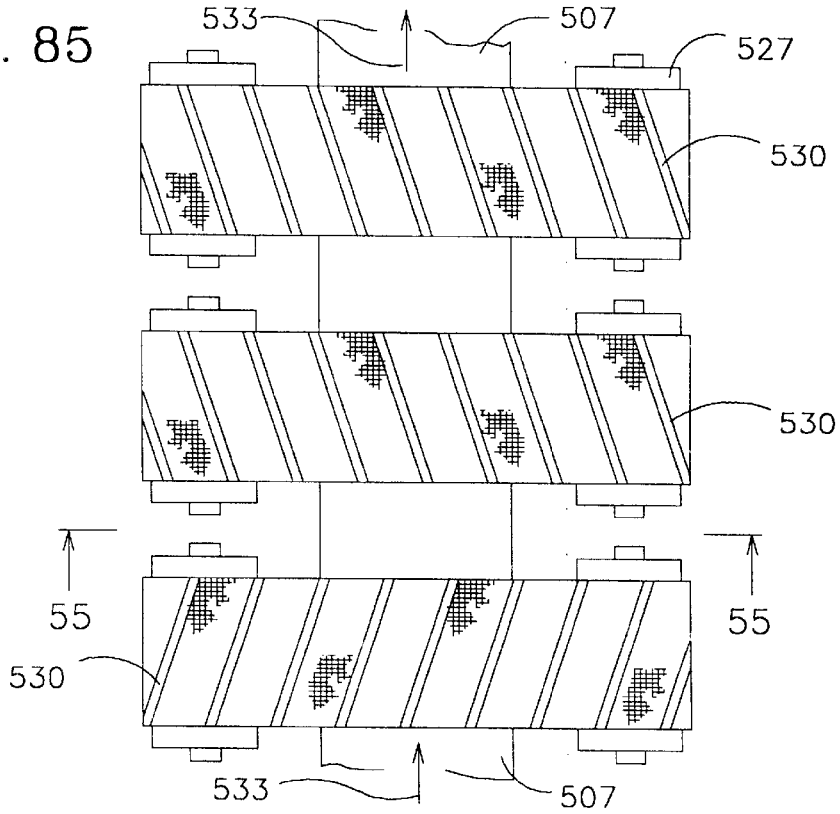
FIG. 85 is a plan or top view of the transverse section shown in FIG. 84.

In FIG. 83, because the thin flexible blades 523 and 525 extending from the mesh-type belt 521 are positioned transverse to the mesh belt, when such belt is drawn across the surface of the strip, bubbles of gas and excessively heated or depleted electrolyte are wiped from the anodic or cathodic strip surface toward one side of the strip. This provides a thorough wiping of the strip as it passes the mesh-type belt, the openings in which allow free passage of bubbles of both oxygen and hydrogen, plus electrolyte. Since the blades bearing against the strip surface in FIG. 83 are, however, disposed lengthwise of the strip, the movement of the strip itself along the processing line has little effect upon the removal of bubbles of oxygen and excessively heated electrolyte from the strip surface, although the movement of the strip along the length of the blades does induce some additional turbulence that has some beneficial effect upon the bubble situation and the temperature or depletion as the case may be of the electrolyte next to the strip surface. However, any effect is not great. On the other hand, if the thin flexible blades on the outside of the flexible mesh belt are angled, the movement of the strip past the continuous belt may be taken advantage of to wipe the surface of the strip as well. Such an arrangement is shown in FIGS. 84 and 85 wherein it may be seen that the outside wiper blades 530 are angled so that movement of the strip against the blade will, as in other embodiments of the invention, wipe the surface of the strip against the blade, sweeping the electrolyte and bubbles from the surface. At the same time, the transverse movement of the flexible belt upon which the blades are angled also in itself sweeps electrolyte and bubbles from the surface. Preferably the direction of rotation of the continuous belt is such that the movement of the strip and the movement of the belt complement each other and increase the velocity at which the electrolyte is moved toward the edge of the belt. Thus, the electrolyte should be urged from the side of the belt facing in the direction of movement of the web or strip. With this direction of movement, the electrolyte first strikes the back of the blades due to the strip motion, which is usually faster than the motion of the belt in a high speed line and is propelled off the side of the strip in the same direction as that of the strip as well as through the orifices in the mesh of the belt. At the same time, the movement of the blades along with the belt picks up the electrolyte on the front of the blade and propels it in the same direction. If the belt moves in the opposite direction, however, the movement of the belt will tend to propel the electrolyte counter to the movement induced by the movement of the strip with a general decrease in overall velocity of the electrolyte off the edge of the strip. However, in some cases, adjacent belts may have their blades inclined in opposite directions to increase the turbulence and mixing between the belts. Such an arrangement is shown between the two belts at the bottom in FIG. 85, which shows a top or plan view of the embodiment of FIG. 84 showing wiping blades 530 upon the upper two belts 501 angled in one direction which will add to the velocity at which the electrolyte is propelled off the belt in the direction of movement of the strip and the angle of the blades on the lower belt angled so the movement of the belt counteracts the movement of the strip causing additional turbulence.

It will be understood that the blades could also be arranged longitudinally of the belt so that the blades are exactly transverse of the strip and completely block longitudinal motion of the electrolyte along the strip. However, because the blades must bend around the curvature of the belt as the belt passes at the ends around the supporting rolls 527 and 528, stress is placed on such blades unless they are pre-split to go around the radius over the support rolls, which splits may not completely close upon straightening out the belt again. Discontinuous staggered transverse blades may also be used, but have the disadvantage of not as quickly flushing the electrolyte to the side, although again, increased turbulence is attained, which, in itself, is advantageous. In FIG. 84, the angled blades 530 can be seen from the side, while FIG. 85 shows a plan view of the same arrangement having three separate, but connected, continuous mesh-type belts spaced along the coating or anodizing line. FIG. 84, which is comparable to FIGS. 82 and 83, is a cross section along section line 533 in FIG. 84. The electrodes 509 visible in FIGS. 82 through 85 are not visible in FIG. 85 because such electrodes are under the belts 501.

Figure 87:
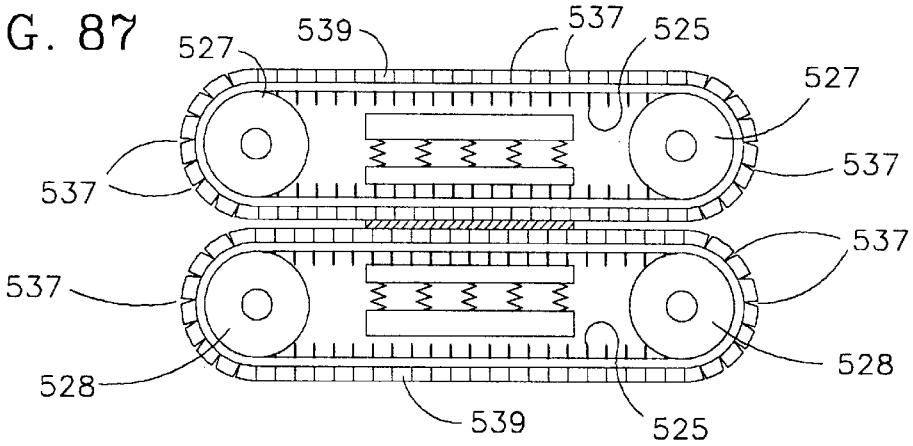
FIG. 87 is a transverse section of the arrangement shown in FIG. 86.
Figure 86:
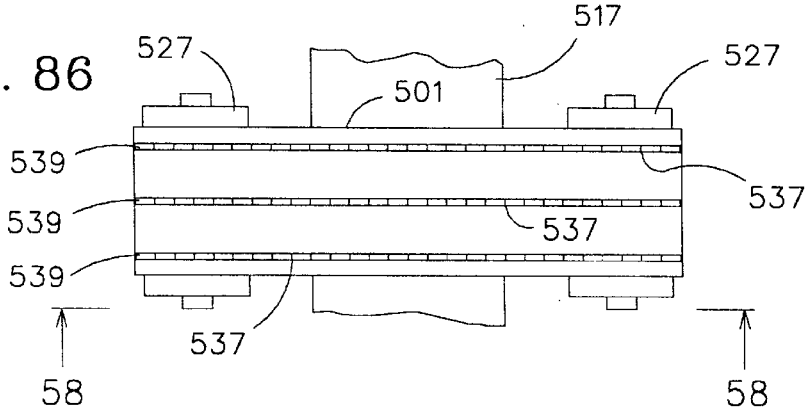
FIG. 86 is a top or plan view of an alternative embodiment of the invention in which the blades on the exterior of the endless mesh-type belt are positioned longitudinally of the mesh-type belt and transversely of the strip or web constituting the workpiece.

FIG. 86 is a further plan view and FIG. 87 is a cross section of an embodiment of the invention having straight transverse slitted blades on the outside of the rotating belt to continuously oppose passage of an excessively heated or depleted surface layer of electrolyte along the surface of the strip similar to the stationary blades or longitudinally moveable blades disclosed in prior embodiments. The splits 537 in transverse blades 539 can be clearly seen in FIG. 87.

Figures 88, 89, 89A, 90:
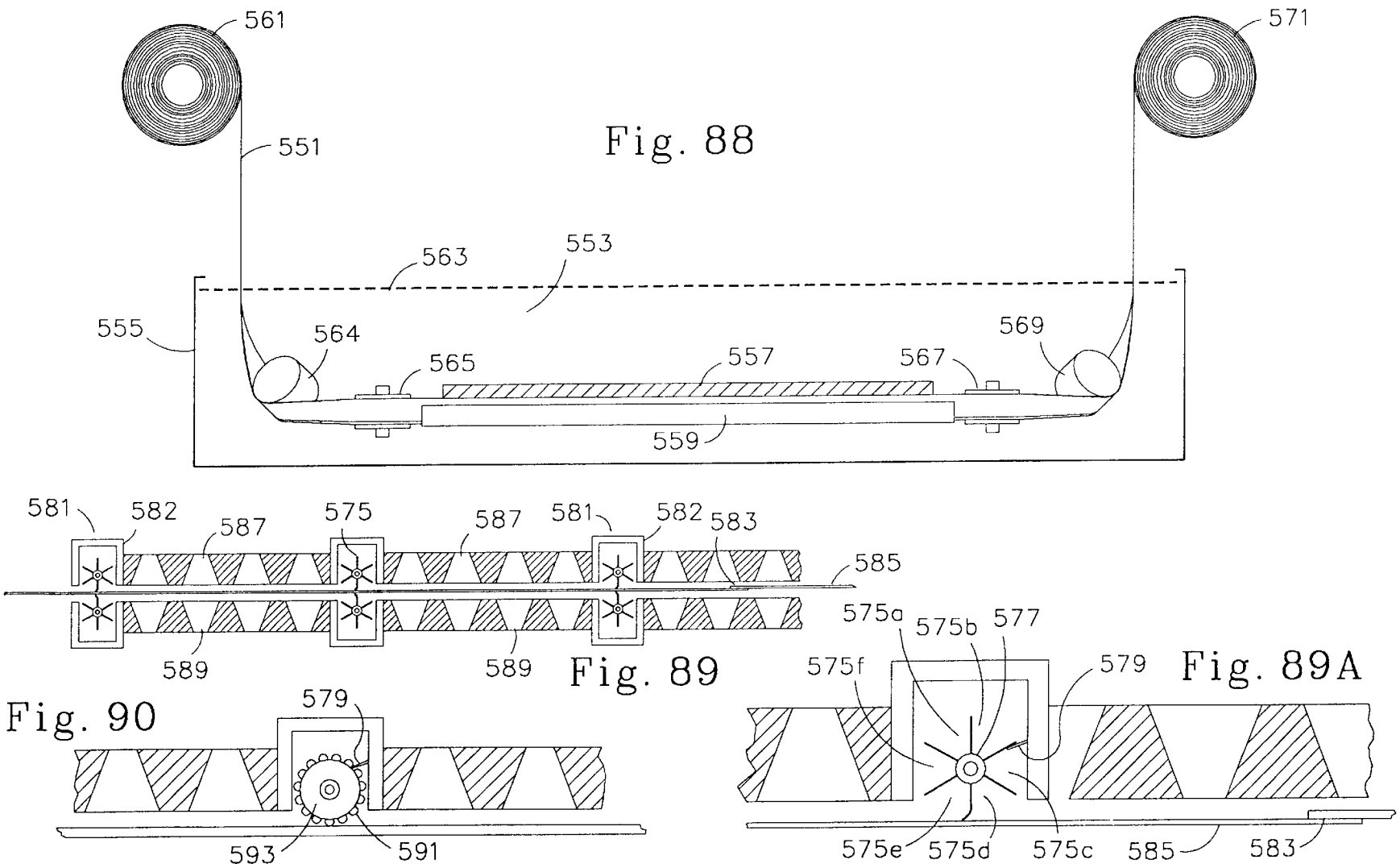
FIG. 88 is a diagrammatic transverse section through a electrolytic processing tank showing an improved arrangement for passing a flexible wiping blade through the tank in contact with a strip.
FIGS. 89 and 89A are longitudinal sections in different scale through a rotatable multi-blade flexible wiping blade assembly.
FIG. 90 is a longitudinal section through an alternative multi-blade flexible wiping blade assembly.

One significant advantage of the flexible mesh-type wipers shown, for example, in FIG. 76 is that because such flexible mesh contacts the strip on its side, it is readily passed into and out of an electrolytic bath through the surface over guide rolls so that only the portion that is actually contacting the strip needs be submerged in the electrolytic bath. On the other hand, in the use of coiled teardrop or beaded wiper blades, such as shown in FIGS. 36 and 44, it is more difficult to direct the blade into the bath, across the strip and out again unless the blade passes through a seal in the side of the plating or anodizing tank. It is impractical to pass the blade through side of the tank, however, because it is extremely difficult, if not impossible, to obtain a good seal and it is obviously unsatisfactory to have a leaking or dripping electrolyte tank. While it is possible to submerge the entire coils in the tank and operate or rotate such coils from the surface, this is also usually unsatisfactory. One practical solution to these problems is shown in FIG. 88. FIG. 88 is a transverse partially broken away side view of a portion of a coilable flexible wiping blade such as beaded blade 551 such as shown in FIGS. 59, 60, 62, and 63 which passes through an electrolyte bath 553 in an electrolytic processing tank 555 through which a continuous strip 557 passes at right angles to the flexible blade 551. The strip 557 is underlain with perforated or other electrodes, not shown, on either side of the flexible wiping blade 551 and its track or holder 559. A payoff coil or reel 561 on the left-hand side of FIG. 88 provides a supply of the flexible wiping blade such as shown in FIGS. 59 through 67. The payoff reel is above the bath surface 563 in the tank 555. The flexible wiping blade 551 passes downwardly and over angled guide roll 564 which reorients the blade from the downward direction to horizontal and from parallel with the side of the coating tank to vertical in its track 559 with its top edge flexed against the strip 557. A further guide roll 565 serves to guide the wiping blade into the track 559. Similarly oriented guide rolls 567 and 569 at the other side of the tank 555 serve to guide the wiping blade 551 out of the track 559 and reorient it to pass upwardly to a take-up coil or reel 571. Any suitable device for driving the take-up and payoff reels and for reeling the flexible wiper blade may be provided such as pressure drive rolls contacting the strip above the bath surface, axial drive of the take-up reel and preferably also the pay-off reel and the like. One possibility is to provide a sprocket drive of the wiping blade in which the lower edge of the blade would have a series of consecutive orifices in it similar to the openings in photographic film for drive of such film. While not shown in FIG. 88 for clarity it will be understood that the guide rolls 563, 565, 567 and 569 will in most instances be backed up with comparable opposed guide rolls, on the opposite sides of the moving or movable wiping blade which may be moved continuously or periodically across the strip to renew the wiping edge of the blade as wear occurs. It will be understood that such tracks 559 could be disposed at an angle with respect to the direction of travel of the strip 557 rather than straight across as shown in FIG. 88. Only a bottom wiping blade arrangement for processing the lower side of the strip 557 is shown in FIG. 88, but it will be understood that a similar arrangement may be used to wipe the top of the strip if the strip 557 is to be coated or otherwise processed on both sides. Single side electrolytic processing is quite frequent in the electrolytic processing industry.

FIG. 89 is a diagrammatic longitudinal section along an electroprocessing line in which instead of there being a series of single flexible wiping blades extending upwardly and downwardly to contact a continuous strip, there are instead a series of multiple rotating blades and, in the case shown, six separate blades 575 on a rotatable hub 577. The usual single wiping blade in accordance with the invention is effective to wipe bubbles away from the strip surface, if any are present, and also wipe away any either chemically or physically depleted electrolyte, i.e. in which the surface layer of electrolyte is either depleted by the removal of essential chemical elements or depleted by being brought to an unfavorable temperature or, in other words, physical depletion. Physical depletion is usually an over heating of a layer of electrolytes which tends to be carried along with the strip. Such heating occurs in all electrolyte processes depending upon the amount of energy passing into the electrolytic's processing step at the surface of the strip and is particularly dramatic in anodizing processes, where the electrolyte may be quickly brought to a boil along the interface with the strip if special cooling precautions are not undertaken, but also occurs in electrolytic coating. The overheated "barrier layer" at the surface of the strip interferes with and in extreme cases may effectively halt electrolytic processing. Thus in anodizing the barrier layer that interferes with the process comprises mostly overheated electrolyte drawn along with the strip, while in electrolytic plating the "barrier layer" is not only overheated, but also actually becomes depleted of the metal ions being plated from the electrolytic solution onto the base metal of the strip. In either case the flexible wiping blades of the invention effectively wipe such barrier layer from the strip surface allowing undepleted electrolyte, either physically undepleted, i.e. having a more suitable temperature, or both physically and chemically undepleted, to flow back onto the strip. There is thus an unfavorable concentration gradient, both with respect to chemistry and temperature along the moving strip surface. The wiping blades of the present invention very effectively redress such unfavorable concentration gradient. In addition, as explained above, the flexible blades also serve to retain the strip in a central position between the electrodes and thus enable the electrodes to be spaced much closer to the strip being treated with a very significant enhancement of the treatment efficiency of electroprocessing such as for example, electroplating, because of the closer spacing allowing significantly faster electroprocessing or plating. The same is true for one side coating. However, if, as is frequently the case, lap welded strip is run through the processing apparatus or electrolytic line, the lap welded seams frequently will catch on the flexible wiping blades tearing or otherwise damaging such blades. Other types of uneven strip may also catch on the blade destroying or damaging the blades or otherwise damaging and negating their effectiveness. FIG. 89 shows an arrangement for preventing damage to the blades by lap welds and other defects in the sheet or strip. In FIG. 89 there is shown diagrammatically a longitudinal section of a coating line including three pairs of multiple rotatable flexible wiping blades 575. Each of these "starwheel" or multiple-blade rotating assemblies is comprised, for example, of five-to-eight blades arranged about a common rotatable shaft or journaled on a common axis. The assembly 581 of rotatable blades is positioned such that the blades will rotate as a unit within a housing 582 mounted between perforated anodes 587 and 589 on each side of the strip 585 when transverse force is applied to any of such blades until one is extended downwardly against the strip, at which point rotation ceases until a greater force is applied to any of the blades. This can be accomplished, for example, by the simple arrangement shown in FIGS. 89 and 90 where, as seen particularly in FIG. 89A, the individual blades are contacted by a spring detent or release in the form of a spring arm 579 which prevents the blade assembly from rotating until sufficient rotational force is applied to flex the spring detent 579 sufficiently to allow the adjacent flexible wiping blade of the rotatable flexible blade assembly to slip by the detent. The detent 579 then contacts and retains the next flexible blade 575*a*, 575*b*, 575*c*, 575*d*, 575*e* or 575*f* of the entire rotatable blade assembly 581 from passing by the detent 579 until a further force is applied. For example, in FIGS. 89 and 89A, a lap welded joint 583 in the strip 585 is shown passing through the apparatus. As the lap weld 583 reaches the rotatable flexible wiping wheel assembly 581, it forceably contacts the side of the downwardly extending blade 575*e*, as shown in FIG. 89A, which is already partially flexed against the upward resistance of the strip 585. The passage of the lap welded joint 583 places additional force against the side of the blade 575*e* and the entire wheel assembly will rotate until the next blade 575*d* is positioned against the strip. The rotation of the rotatable wiper blade assembly 581 from one blade position to the next not only relieves the force against the blade in use so it is not torn or otherwise damaged, enabling it to be used again when the rotatable assembly turns one complete turn, but also in effect automatically changes the blade in use to a new blade. Consequently, if the blade assemblies are replaced after the rotation of the rotatable unit is complete, a new blade surface will be provided each time the blade assembly is rotated to make certain that a fresh edge surface of the blade is always against the surface of the strip. Even though the blade assembly is rotatable to relieve extreme pressure on the side of the blade, the blade still tends to center the strip between the perforated electrodes 587 and 589, since the movement of the strip past the assembly keeps the flexible blade flexed and if the strip deviates more toward an upper or lower blade than toward the opposite blade, the bending force of the blade tends to force the strip back into line. If a strong transverse force such as the passage of a lap welded joint in the strip causes the blade assembly 601 to rotate, the next blade will, when reaching downward orientation, also immediately be bent or flexed against the resistance of the strip tending to recenter the strip, if off center.

FIG. 90 is a longitudinal side sectional view of an alternative type of rotational blade assembly or wiping blade wheel where there are, rather than a few wider blades as shown in FIGS. 89 and 89A, instead a series of very short somewhat stubby blades 591 upon a rotatable wheel 593. Again the passage of a lap weld or the like will serve to rotate the wheel to cause a fresh blade to come into position and avoid tearing or other damage to the blades by the passage of such lap weld or the like past the blade assembly. The short stubby blades 591 should be formed of some acid-resistant flexible polymeric material such as Mylar or Hypalon or the like polymeric resin, but are generally inherently less flexible than the wiping blades shown in FIGS. 89 and 89A.

FIG. 91 is an isometric view of a perforated electrode assembly 611 having a series of flexible wiping blade assemblies 613 spaced along it for use in wiping the bottom of a strip which is being coated. This assembly is basically designed to be used with a top side electrode assembly such as shown in FIG. 68 in which case a strip will run between the two electrode assemblies. Alternatively, either of the assemblies can be used alone for coating only one side of the strip, i.e. in the case of the assembly shown in FIG. 91, only the bottom side. A series of titanium hangers or drop arms 615 serve to support the assembly and a series of longitudinal titanium stringers 617 passing transversely of the lower arm of the hangers support the perforated electrodes 619. The flexible wiping blades are shown as a series of beaded or tapered blades 621 similar to any of those shown in FIGS. 59 through 63. Each is held in a blade track 622. However, various other flexible-blade types can be used in the assembly for example, the T-blades and holders such as shown in FIG. 47, an L-blade and track and holder such as shown in FIG. 64, and a brush-type blade and holder or track such as shown in FIGS. 65 through 67. It will be recognized that in each case the flexible blade not only wipes bubbles and either chemically or physically depleted electrolyte, i.e. either electrolyte with a deficient amount of coating metal material in it or a deficient temperature (largely a too hot temperature for effective processing) from the surface of the strip, but, in addition, by providing a varying resistance against the strip derived from the bending of the flexible blade or blade elements, and depending upon how much bending is experienced, the strip is stabilized with respect to deviations from straight passage past the electrodes, thus allowing the electrodes to be more closely spaced to the strip without damage or touching or arcing between the strip and the electrodes. If the electrodes are soluble electrodes, they can be individually covered with a fine polypropylene filter bag or cloth to prevent escape of insoluble contaminants into the bath. The blade tracks 622 and flexible wiping blades held in them fit down into the grooves between the electrodes 619 and are also supported on the longitudinal stringers 617.

FIG. 92 is an isometric partially broken away view of a lower electrode assembly similar to that shown in FIG. 91 including perforated electrodes 619, titanium hangers or drop arms 615 and titanium stringers 617 seen at the far left of the figure which support the perforated electrodes 619 and are covered or encased in a polypropylene filter bag or sock 631 seen also at the left in FIG. 91. Over the filter sock 631 there is laid an open web, polymeric resin or plastic mesh sheet 633 such as polypropylene, high density polyethylene or the like having a mesh arrangement as shown, for example, in FIGS. 74 through 80. Instead of such plastic mesh wiper 633 being actively moved across the moving strip, however, a long length of about one-sixteenth inch thick to about one quarter inch thick mesh 633 has been merely laid down along the top of the polypropylene filter material 631 and temporarily secured and the strip material 635 is passed along the electroprocessing line on top of the open-web, plastic mesh 633. The mesh serves as a wiper against the strip surface, but even more importantly as a spacer or stabilizer which prevents the strip from closely approaching or touching the electrode surface or cutting or otherwise damaging the polypropylene filter material no matter how the strip may tend to deviate from a straight run across the perforated electrode or filter covered perforated electrode. The thickness of the open-web, plastic mesh is selected to be the minimum necessary to prevent arcing between the strip and the electrodes, while also having the requisite materials engineering characteristics to prevent tearing by the metal being processed, but to otherwise allow the strip to approach the electrodes as closely as possible and, therefore, to allow the strip to have the maximum electrolytic chemical reaction with the electrolyte. The plastic mesh may, for example, extend down the line for 20 feet or more. The open-web plastic mesh may be secured to the perforated electrodes in any convenient manner or may be wrapped about them, but not so as to insulate the electrodes from the conducting arms carrying electrical current to the electrodes. The perforations in the anodes not only provide an access for the electrolyte to the strip surface, but also increase the surface area of the electrodes to increase the reaction with the electrolyte. FIG. 93 is a cross-section through a broadly similar arrangement such as shown in FIG. 92 showing the strip 635 passing across the layer of plastic mesh 633 which is underlain by the plastic filter bag or wrapping 631 about the soluble perforated electrode 619. The sides of the open web, plastic mesh 633 are attached to longitudinally extending weights 634 which weight the sides and aid in maintaining the open-web plastic mesh upon the top of the filter bag surrounded electrode 619. The filter bag 631 may be conveniently tied off around the lower section 615*a* of the drop arm 615. As will be seen, the open-web plastic mesh wiper and spacer 633 effectively spaces the strip 635 from the electrode 619. Such open-web, plastic mesh can be from about one sixteenth of an inch in thickness to about one-quarter inch in thickness and any width or length desired. It is advantageous to have the mesh size as large as possible in order to have as little blocking material between the strip surface and the electrode as possible. However, the mesh size cannot be so large that the filter sock or bag, if used in the particular process (largely in the case of certain soluble anodes), will protrude through the mesh and catch on any irregularities on the strip such as burrs and the like and be torn or ripped off the surface of the electrodes. Also, the open web plastic mesh cannot have mesh openings so large that irregularities in the flatness of the strip may cause close enough approach of the strip surface to the electrode surface to cause arcing between the strip and the electrodes. Any such arcing is also a function of the breakdown potential of the electrolyte and other factors. Consequently, while an extreme range of mesh thickness might be from one thirty-second of an inch to as much as three eighths of an inch or even more, the best operating range will be from about one sixteenth of an inch to one quarter of an inch with a trade off between the mesh size and the thickness, since in general, webs of greater thickness can safely have larger mesh sizes, other factors being equal. The over-riding factor, however, is that the strip should pass by the electrodes as close as possible, the plating speed and thickness, as well as the general efficiency of plating being in general closely and relatively directly related to the distance between the electrodes and strip surface. Electrical contact is gained from or provide to the electrodes 619 from the busbar 637 partially shown in FIG. 93 through the drop arm 615, which is secured to the busbar by a bolt 639 or other fastening, into the stringers 617 and then into the electrode 619. As indicated, the open-web plastic mesh 633 acts largely as a spacer between the electrode and the strip so that deviations or undulations of the strip between guide rolls, not shown, at the ends of the electroplating operation do not cause the strip to approach closely enough to the electrode surface to cause arcing. As indicated, the open-web plastic mesh 633 also very effectively prevents, in those cases where a soluble electrode is surrounded by a filter bag or cloth, the strip from contacting and possibly catching on and destroying the filter bag. In addition, the open-web plastic mesh serves to wipe the surface of the strip, particularly if it contacts such strip continuously, since even if the plastic mesh is not moving itself, as shown in FIGS. 91 and 92, the passage of the strip over or past the plastic mesh causes turbulence and liquid eddy currents that are effective to break up any barrier layer or depletion layer being carried along with the strip. When the open-web, plastic mesh also moves independently, even greater wiping is achieved.

FIG. 94 is a cross-sectional view of an alternative arrangement similar to that shown in FIG. 93 wherein the perforated electrode 619 is stacked directly upon a series of hangers or drop arms 615 and the filter bag 631 is wrapped or pulled over not only the perforated electrode and lower limb 615*a* of the hanger, but also partially up the hanger 615 as shown. In addition, the open-web, plastic mesh 633 is wrapped over the top of the perforated anode 619 and down around the bottom of the hangers 615 purely as a convenience. The strip 635 can then run on top of the open-web plastic mesh as shown with the plastic mesh spacing the strip from the electrode and preventing arcing while allowing the strip to be as close to the electrode as possible based upon the characteristics of the electrolyte, the voltage applied and the like, as well as breaking up any barrier layer or depletion layer on the strip surface.

FIG. 95 is a plan view in which a series of separate electrode slabs are attached to and supported from a series of separate drop arms or drop bars 615 which are supported from a busbar 637 running along the top. Superimposed over the electrode slabs there are a series of open-web plastic mesh spacers or wipers 633*a* through 633*i* each of which, merely for illustrative purposes, has a different plastic mesh pattern including a first rectangular pattern 633*a*, a second mixed pattern 633*b*, a third longitudinal pattern 633*c*, a fourth transverse pattern 633*d*, a fifth angled square pattern 633*e*, a sixth aligned square pattern 633*f*, a seventh hexagonal pattern 633*g*, an eighth denser hexagonal pattern 633*h*, and a ninth triangular pattern 633*i*. It should be understood that in actuality a single open-web, plastic mesh pattern would be used on top of each electrode slab and the different mesh shapes are used merely for illustration, although there is in general no reason why different patterns could not be used on every electrode as shown or in some other sequence. During operation strips approximately the width of the electrode slabs and the overlying open-web plastic mesh sections 633 will pass across the entire series of separate electrode-mesh combinations and will be electroprocessed. The spaces 639 between the separate electrodes serve basically the same purpose of allowing access of the electrolyte to the strip surface as do the perforations in the electrodes shown in various of the previous figures. One of the main advantages of the arrangement shown in FIG. 95, however, is that while in the usual electroplating line using soluble electrodes in the coating of the bottom of strip the line must be shut down for some time, frequently several days, while the hanger arms or drop arms are removed and the partially dissolved electrodes are replaced with fresh electrodes, while in arrangement shown in FIG. 95, certain of the individual drop bars may be removed on a regular schedule and replaced together, if necessary, with the open-web, plastic mesh wipers, if necessary or desirable, when the line is temporarily halted for routine matters such as, for example, welding the ends of two strips together. At the same time the remaining dropbars may be adjusted upwardly to bring the electrode material closer to the strip. As an illustration, the line may be stopped temporarily to weld two strips together and the first several electrodes overlain with open-web plastic mesh patterns 633*a* through 633*d* may be removed and replaced, during the next stop the electrode assembly overlain with mesh 633*e* through 633*i* may be removed and replaced, during the next stop another group of electrode assemblies may be replaced and so forth until the entire group of electrodes have been replaced without any extensive shutdown of the line as a whole. During each shutdown, the electrode assembly to be replaced will be unbolted from the bus bar 637 and swung, as shown in FIG. 96, from under the strip 635 and removed from the electroplating tank, not shown. An already prepared drop bar and attached electrode can then be swung down in the opposite direction into the electrolytic bath, not shown, in the electrolytic tank, not shown, the drop bar secured to the bus bar and the electroprocessing operation continued until the next temporary halt when one or two further electrodes may be replaced preferably on a regular schedule, thus continuing regular operation around the clock, if necessary. Normally these electrodes are 90 to 95 percent depleted or dissolved will be replaced during each turn or operating day and these electrode assemblies 5 to 90 percent depleted or dissolved will be repositioned closer to the strip. Such repositioning and replacement will be accomplished on as regular a schedule as possible. In FIG. 95, the individual open-web, plastic mesh is shown merely attached to the tops of the electrode slabs or wrapped about the slabs, but not about the drop arm as shown in FIG. 96. If the electrodes under the open-web, plastic mesh separators and wipers shown in FIG. 95 are insoluble electrodes or even soluble electrodes or anodes used in electrolytic coating, such as copper cyanide coating, no cloth filter bags may be used on the bottom. Thus, the arrangement shown in FIG. 95 without a filter bag under the open-web, plastic mesh may be considered to be used in electroprocessing operations either not using soluble electrodes or using soluble electrodes in processes in which insolubles are not left over to contaminate the processing bath or the work product. In the particular drop-arm electrode assembly shown in FIG. 96, on the other hand, the arrangement including a filter bag 631 secured about the electrode and the drop arm is suitable for use in any soluble anode-type electrocoating operation.

FIG. 97 is a perspective view of a different type of flexible wiper blade arrangement in which a blade holder or frame 641 (see FIG. 98) accommodating a flat flexible wiping blade 643 in the form of a rectangular sheet of thin plastic, as shown from the end in FIG. 97 and from the side in FIG. 98, is used. The top of the wiper frame 641, shown in FIG. 98, may have two flanges or tabs 647 extending from the sides which serve to maintain the frame and a contained blade 643 between two adjacent titanium baskets 649 and 651 which contain soluble nuggets on slabs on a coating material such as copper, nickel, tin, zinc or the like. Alternatively, the frame 641 may be hung or otherwise secured between two insoluble electrodes, as will be understood from other figures. The frame arrangement shown in FIGS. 97, 98 and also 99 is particularly useful for coating the upper surface of a strip, since it can be applied, adjusted and replaced during continuous operation from the top through the bath surface. In applying or adjusting the blade arrangement shown in FIGS. 97 through 99, the large rectangular plastic sheet forming the wiping blade 643 is first inserted into the frame 641 in the central groove in which the blade is accommodated. The entire frame and blade may then be placed between or inserted between the titanium baskets 649 and 651 which contain nuggets or slabs of soluble coating metal. Once the frame is seated securely between the baskets 649 and 651, the wiping blade may be slid downwardly in the frame until it just touches a strip passing under the baskets. The frame may then be withdrawn again from between the baskets 649 and 651 and the set screws 645 tightened to clamp the flexible wiper more securely in the frame, after which the frame 641 may be dropped back into the slot between the baskets 649 and 651. Periodically, the frame 641 may be lifted upwardly and removed from between the baskets and the bottom or lower edge of the blade sheared off to provide a fresh edge after which the blade and frame may be reinserted between the baskets and the blade pushed downwardly in the frame until the new edge touches the strip surface. The set screws in the frame may then be reset or tightened to hold the blade securely in the frame.

FIG. 99 shows the blade 643 and frame 641 after the blade has been considerably shortened by repeated shearing off of the lower edge to renew such edge. As will be understood, a skilled operator will learn exactly how far below the frame 641 the lower edge of the blade should extend and will in most cases be able to adjust the blade to the correct position by measurement.

Figure 100:
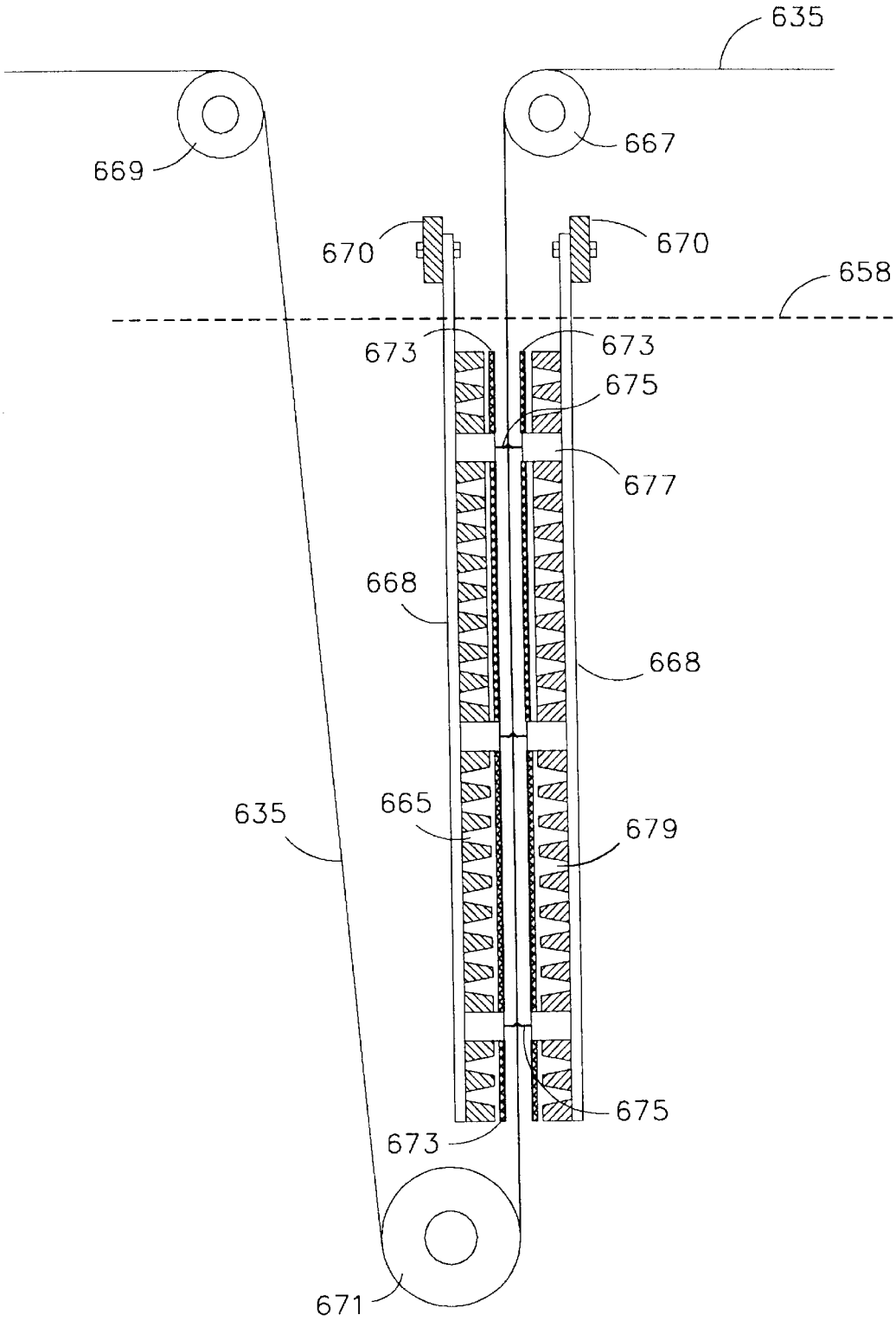
FIG. 100 is a diagrammatic transverse section through a vertically aligned coating arrangement using flexible wiping blades plus an open-web, plastic mesh as combined wiping elements.

FIG. 100 is a diagrammatic side elevation of an arrangement for coating a continuous strip with a chromium or other coating layer in a vertically oriented electrocoating apparatus in which both an open-web plastic mesh is used between the strip and the electrode material and flexible wiping blades are used at intervals along the coating arrangement. In such an operation, i.e. chromium coating process, because the plating is relatively inefficient, a large amount of hydrogen is produced by simultaneous electrolysis of the water in the electrolyte solution, which hydrogen collects upon and coats the surface of the strip interfering with the coating operation. In addition, depletion of the chromium content of the electrolyte occurs. The coating arrangement is shown as a vertical run between perforated lead anodes 665, the strip 635 entering between the anodes at the bottom and progressing upwardly until it passes from the coating operation over the guide roll 667. The strip enters the operation over guide roll 669 above the surface 658 of an electrolytic coating bath 659 and passes around a sinker roll 671 at the bottom before passing up between the perforated anodes 665 which are supported by hangers 668 from bus bars 670 above the surface 672 of an electrolytic bath, not shown. Along the surface of the anodes 665 there is provided an open-webbed plastic mesh such as shown in the previous figures. Such mesh is designated as 673 and serves to keep the strip 635 from contacting the perforated anode 665, even though it is running very close to such anodes. Since a chromium coating operation is a so-called low-efficiency operation, a lot of hydrogen is given off during the operation as indicated above and such hydrogen tends to collect upon the strip 635. Consequently, applicants prefer to also use flexible wiping blades spaced at intervals along the coating operation. These wiping blades are shown as wiping blades 675 supported in holders or in blade tracks 677. The flexible wiping blades 675 very effectively strip the hydrogen bubbles from the surface of the strip 635 and also cause any depleted coating solution to be wiped from the surface whereupon it can be replaced by other coating solution from the tank, not shown, either entering the coating area from the sides between the anodes and the strip or through the perforations 679 in the anodes or from bottom of the tank. The open-web plastic mesh 673 serves as a backup to prevent the strip from touching the anodes, even if the strip overcomes the deflection of the flexible wiping blades 675. Consequently, the flexible wiping blades 675 can be positioned farther apart than they might otherwise be. This illustrates that both the flexible wiping blades and the open-web plastic mesh can be used in the same operation. One is a backup basically for the other and this is particularly desirable in those less efficient plating operations where a large amount of hydrogen or other gas may be given off and tend to interfere with the coating on the surface of the strip. It should be understood that the diagrammatic view shown in FIG. 100 shows the wiping blades stabilizing the strip 635 fairly far from the surface of the open-web, plastic mesh 673. However, normally the flexible wiping blades will be only sufficiently long enough to be flexed against the strip surface and the open-web, plastic mesh will be spaced very close to the surface of the strip allowing the surface of the strip to be very close to the surface of the electrodes to obtain maximum current flow between the two. The flexible blades are particularly effective because of their superlative wiping action. However, when the blades are used by themselves i.e. without the open-web, plastic mesh, it may be desirable to use them as close together as six inches or so and it has been found therefore, that if they are used in conjunction with open-web, plastic mesh, as shown, they can be moved significantly farther apart such as two or three feet under the same conditions with a considerable saving in cost and maintenance. Consequently, a combination of flexible wiping blades and open-web, plastic mesh is particularly desirable and effective.

Figure 101:
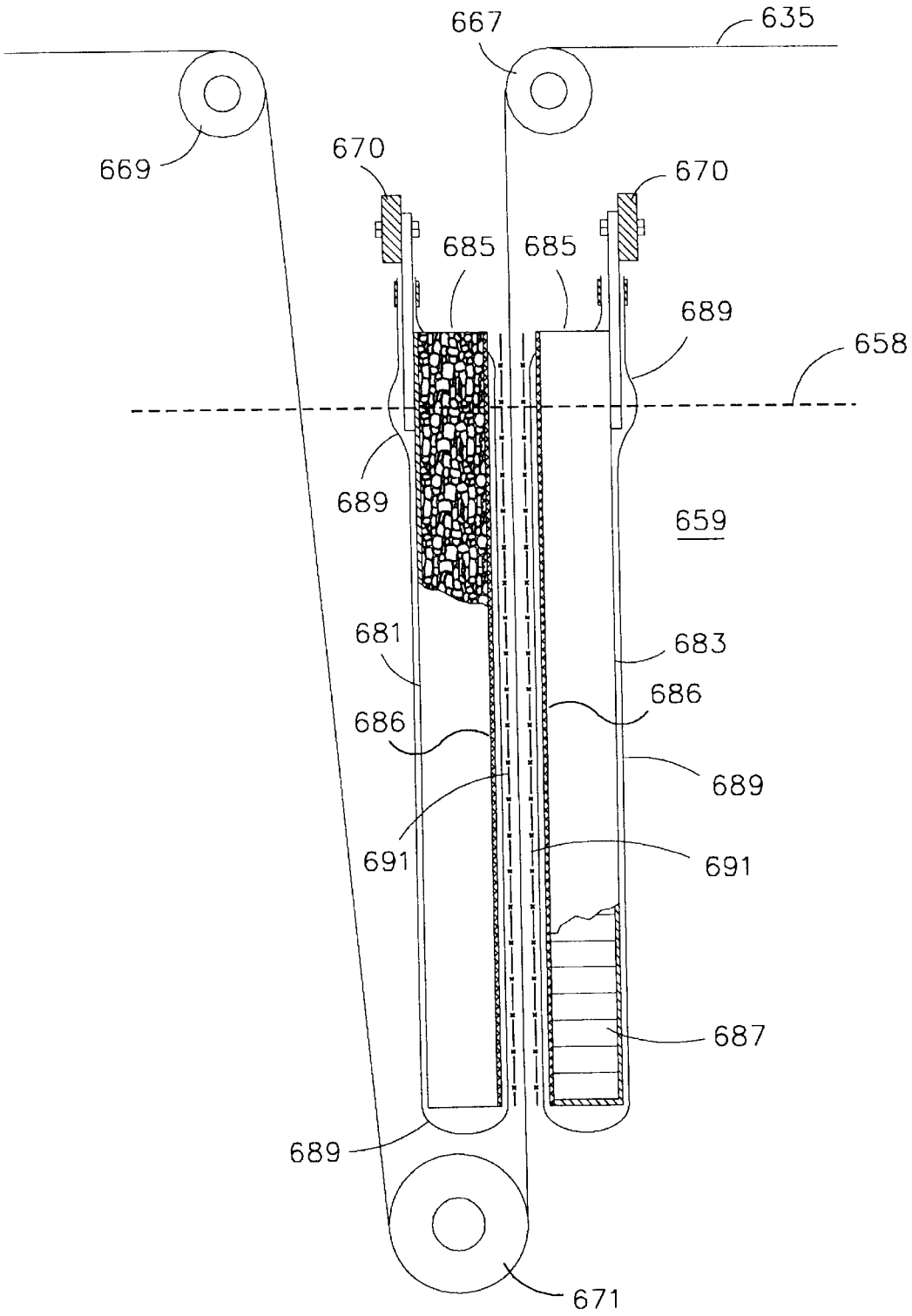
FIG. 101 is a diagrammatic partially broken-away side view of an alternative vertical coating arrangement using an open-web, plastic mesh wiper and spacer.

FIG. 101 shows a further coating arrangement having a vertical orientation. In FIG. 101, a strip 635 again passes over a guide roller 669 down to a sinker roll 671 below the surface 658 of an electrolytic coating bath and then in an upward run between elongated titanium mesh baskets 681 and 683. The baskets 681 and 683 are essentially solid, except for a titanium grid 686 over the surface facing the strip 635. The baskets extend through the surface 658 of the electrolytic bath and are open at the top to allow placement of copper nuggets 685 in them, as shown in basket 681 or, alternatively, copper ingots 687, shown diagrammatically in the basket 683. The titanium faces of the two baskets 681 and 683 are covered with a filter cloth 689 to contain any insolubles released by solution of either the copper nuggets 685 or the ingots 687 of copper and has over the filter cloth an open-web, plastic mesh 691. The open-web, plastic mesh 691 serves to prevent contact of the strip 635 with either the filter cloth 689 or the titanium mesh 686 over the face of the titanium baskets which might otherwise result in tearing the filter cloth or in arcing with the titanium mesh. The aim is, of course, to have the surface of the strip as close as possible to both the soluble anode material and the conductive titanium mesh which serves as a current carrier to the adjacent copper nuggets. At the same time, as explained, the plastic mesh 691 being close to the surface of the strip surface, serves to periodically "wipe" the surface of the strip as the strip approaches the mesh and to cause turbulence and liquid eddy currents in the electrolytic bath which disrupts the barrier layer, or depletion layer, on the surface of the strip, whether such barrier layer is chemical or physical, i.e. depleted of chemical plating elements, or depleted by reason of being physically hotter than surrounding electrolytic which is usually passed through coolers to keep it at a suitable processing temperature.

FIG. 102 is a diagrammatic partially broken away longitudinal side view of an arrangement for coating the bottom of a strip in an electroplating process using soluble anode material. In FIG. 102, an anoded assembly 693 is supported by two drop arms 615. It will be understood that the titanium stringer 694 or other corrosion-resistant stringers will support the electrode slabs of whatever soluble metal is being plated on the strip 635 passing longitudinally above the anode assembly. A series of flexible beaded-type flexible wiping blades 695 are contained in holders or tracks 697 supported, as shown more particularly in larger scale in FIG. 103, between basket sections with the end of the flexible wiping blades 695 flexed against the strip surface as it passes to the left in FIG. 102. The tracks or holders 697 for the flexible wiping blades are underlain by a plastic foam or rubber composition block 699 which serves to provide a constant upward biasing effect as the blade is flexed against the strip surface. If the downward biasing of the blade is increased by either moving the strip downwardly toward the electrode baskets by varying the position of guide rolls, not shown, at the ends of the basket assembly or by moving the baskets upwardly toward the strip, the resilient foam material 699 under the track or blade holder 697 will be compressed. The compressible material is selected so that it will exert an upward force sufficient to maintain the edge of the blade partially flexed against the strip surface, but in the event a greater force is exerted will itself be compressed. It therefore cooperates with the flexibility of the blade to maintain a constant compression of the tip of the flexible blade which is sufficient to constantly flex the end of the blade against the strip sufficiently to damp out oscillations, but not so great that the blade flattened against the strip. Other spring biasing means can be used to maintain a constant compression of the flexible blade against the strip. Such constant compression should, of course, be sufficient to prevent the strip from approaching so close to the anode as to induce arcing. The arrangement shown is particularly useful when using a soluble anode material in an assembly for coating the bottom of a strip passing horizontally through an electrolytic coating bath. In such case, as the soluble anode material dissolves, it recedes from the face of the strip and with increasing distance from the strip the rapidity of plating rapidly decreases. It is necessary, therefore, to either accept the decrease in plating speed with the resultant significant decrease in production or move the anode material closer to the strip. As seen in FIG. 102, the soluble anode material can be moved closer to the strip by loosening the bolts, not shown, that hold the drop arms to the bus bars and retightening with the baskets 693 closer to the strip 635. This not only brings the soluble electrode material closer to the strip to increase plating, but also moves the conductive titanium basket material closer to the strip which also increases the reaction rate. However, if the flexible wiping blades were also moved upwardly toward the strip, either the strip would be lifted or the blades would be further bent, neither of which is desirable. However, if a plastic foam material of the correct resiliency is used, the force of the blade against the strip will force the blade track 697 more forcefully against the foam material which will be compressed while still maintaining a constant force against the strip surface. Thus, the use of the resilient foam backing serves to retain a constant force against the strip by the wiper blades by allowing the blade holders to be pushed downwardly in their housings between the baskets allowing the strip to be brought closer to the coating material. As indicated above, other manners of maintaining a constant force against the strip while bringing the anode material closer to the strip can also be devised, including spring loading of the wiper blade tracks, as well as spring loading the bottom of the trays or stringers to move such bottoms together with the contents closer to the strip as the electrode material dissolves. In this case, the wiper blades will be maintained in a constant position.

FIG. 104 is a diagrammatic side view of a rotatable electrode arrangement in which each rotatable electrode 700 is formed from four individual partially arcuate electrode sections 701 which are supported by radial support arms 703 extending from a central journal 705 of the electrode arrangement. The outer end of the electrode sections is formed from an arcuately-shaped titanium cage or basket 706. The arcuately configured titanium gages or baskets 706 are attached to the radial support arms 703 via arcuate conductive shoes 707 at the end of the support arms 703. This is shown in additional detail in FIG. 105 which shows a series of small ingots 708 of a soluble metal such as copper stacked within the titanium cage 706. Such ingots will be stacked so they do not get thrown around as the section rotates on the central hub or journal. FIG. 106 shows a second embodiment in hub or journal 705. FIG. 106 shows a second embodiment in which the titanium cage or basket 706 is filled with a single curved or arcuate soluble metal slab 709. Rather than fitting the arcuate slab 709 within the arcuate titanium cage as shown in FIG. 106, such slab could be fastened by suitable fastenings directly to the conductive shoe 707 omitting the titanium or other corrosion-resistant metal basket 706. Another desirable arrangement would be to stack side by side a number of identical rectangular ingots within the arcuate cage or basket 706 in a row with their side faces substantially in contact, at least at the inner end. The sides of the individual slabs may be angled outwardly in order to more completely fill the interior of the cage or, alternatively, the lower end or side of each slab or ingot may be screw fastened or the like to an extended conductive shoe 711. Such an arrangement is shown in partial detail in FIG. 107 in which the individual ingots are designated as 710. In any of these cases, the entire arcuate assembly will be enveloped in a fine mesh filter bag or sock 713, the lower or outer end of which is tied off by a suitable plastic band 713*a* about the support arms 703. Over the surface of the filter bag is an open-web, plastic mesh 714 which separates the strip 635 as shown in FIGS. 104, 108 and 109 passing over the arcuate outside of essentially a round electrode roll which the strips 635 passes partially about on the lower radius below the surface 658 of an electrolytic coating bath. The strip enters the electrocoating operation about the first roll arrangement through guide and tension rolls 717 and 719, passing down about the roll beginning essentially at the surface of the bath and around the lower portion of essentially a first rotating coating roll-type electrode 700 formed by the multiple arcuate roll-type sections 701 of the first coating cell, up about the further individual guide roll 721 and then down about the arcuate section roll-type electrode 700*a* of the second plating cell, up about a second guide roll 721*a*, down again about the arcuate section roll-type electrode 700*b* of the third plating cell and then up again about guide and tension rolls 719*a* and 717*a* and out of the plating operation. As the strip passes about the lower portion of the arcuate roll-type plating cells, it is held by the interposed open-web, plastic mesh the correct distance from the surface of the titanium mesh top of the arcuate electrode sections for the best coating deposition. Usually there will also be some slippage across the surface so that at least a minimum amount of wiping of the strip surface by the open-web plastic mesh will also occur further improving the electroplating. The electrode arrangement in FIGS. 104 through 107 allows each separate electrode section to be individually wrapped in a polypropylene filter mesh where this is appropriate. The arrangement shown in FIG. 104 will coat only one side of the strip. The multiple electrode assemblies spaced at discrete angles from each other allow separate replacement and repair of such electrode assemblies, however, and are also much easier to produce by a casting process than one large electrode roll, because each of the individual segments can be replaced and/or maintained out of, i.e., above, the coating bath. Uneven solution or wear is also less of a problem from a maintenance standpoint.

One difficulty with eliminating the titanium basket or cage, as suggested as an option above, is that when the fastenings holding the individual bars or ingots to the shoes 107 dissolves in the electrolyte, the bars or ingots may then become detached from the shoes leaving one or more blank spaces in the segmented electrolytic coating roll or cell. Consequently, it is clearly preferable to retain the bars or ingots in a titanium or other cage such as shown. The cage itself, however, also has the drawback that as the ingots, bars or nuggets dissolve, they lose volume and become loose within the cage. While in a top coating process as shown in figures 104 and 109, the electrode material would at least be retained on the bottom face of the titanium cage material close to the strip surface as the roll-type electrode rotated through its bottom position, the soluble electrode material would then lose contact with the conductive shoe within the cage and would be charged only via the rather poor conductivity of the titanium screen at the perimeter. In addition, having the electrode material loose in the cage as the cage rotates further fragmentates the electrode material and in addition tends to wear the cage material. Consequently, it is very much preferred to provide some way for the conductive shoe to maintain continuous contact with the electrode material in the cage and at the same time retain such electrode material against the outer edge of the titanium cage as close as possible to the strip being coated. This may be accomplished by providing an internal shoe 715 within the titanium cage larger than and extending beyond the primary conductive shoe 707 to which the cage is attached and by providing some means for maintaining such internal conductive shoe 715 always extended against the nuggets or ingots within the cage to force them against the outside radius of the cage by a pneumatic, hydraulic or elastic means to continuously maintain these elements against the outside of the cage. Such an arrangement is illustrated in FIGS. 105, 106 and 107 by the movable rod or piston and spring arrangement 712 which urges the internal conductive shoe 715 always towards the outside of the segmented cage or basket.

As indicated above, the relationship of the mesh size to the mesh thickness and the individual web thickness of the plastic mesh over the outer radius of the segmental cage or other arrangement is complicated. However, the mesh size, i.e. the dimensions of the individual open areas in the plastic mesh or more broadly the ratio of open area to area of plastic web sections interposed between the strip and an adjacent electrode, should generally be maximized consistent with providing sufficient distribution of dielectric shield material between the strip and electrodes to sufficiently physically separate the strip surface from both the electrode and any intermediate filter cloth material to prevent the protrusion of any irregularities upon the strip through the mesh sufficient to touch any intervening plastic filter bag material or to allow the strip to approach the surface of the electrode sufficiently closely to induce any arcing between the strip and the electrode. Arcing itself is basically controlled by the distance the strip is maintained from the electrode, plus the potential difference between the electrode and the strip and the dielectric breakdown potential of the electrolyte, which may differ not only with electrolyte composition, but also with temperature of the electrolyte. Thus, any tendency to arc can be avoided by either increasing the thickness of the intervening dielectric or by decreasing the potential between the electrode and strip. Thus once a minimum distance between the strip and adjacent electrode is established, arcing can be avoided by limiting the potential difference between the electrodes and the strip to less than the dielectric breakdown potential of the electrolyte.

FIG. 108 is a further improvement of the operation with the segmented rotating electrodes shown in FIGS. 104 through 107 in which both sides of the strip may be coated. In FIG. 108, structures the same or broadly similar to those shown in FIG. 104 are identified by the same reference numerals. In FIG. 108, the strip 635 enters from the left side, passes about the guide and tension rolls 717 and 719 and then under the segmented rotating electrode 701. The electrode will be understood to have either a single or multiple consecutive sheets of an open-web, plastic mesh material either coiled or otherwise encircling the outer surface to maintain the strip at a discrete distance from the electrode surface, in order to prevent arcing between the strip and the electrode. Underneath the rotating roll-type electrodes 700, 700*a* and 700*b* in FIG. 108 is a further arcuate electrode 722, 722*a* and 722*b* which is held close to the strip surface. Preferably, the arcuate electrode 722 which has, in most cases, a more or less identical structure to the adjacent rotatable electrode, i.e. it will be an arcuate titanium cage with contained soluble electrode material, separate slabs of electrode material or the like, and will have a surface protected by a sheet of open-web plastic mesh to prevent the strip 635 from contacting the arcuate anode 722. However, because the strip 635 is passed under tension about the rotatable electrode 701, the plastic strip on the surface of the arcuate electrode 721 may in some cases be dispensed with, since so long as the strip is kept tight against the surface of the rotating multiple segmented electrode, it has little chance to contact the surface of the arcuate electrode. In the arrangements shown in these figures, the open-web plastic mesh serves not only as a spacer between the surface of the electrode and the strip, but also has a certain amount of slippage on the surface of the electrode so that a wiping action on the strip is also accomplished. While a discrete distance or space is shown between the arcuate electrode 722 and the surface of the rotatable segmented electrode 701 and the strip upon its surface in FIG. 108, it will be understood such gap should be as small as possible and when an open web, plastic mesh dielectric member is used on the inside surface of the arcuate electrode 722 only sufficient clearance may be provided to prevent the strip from binding between the rotatable segmented electrode and the arcuate electrode, particularly in the case of camber in the strip, wavy edges, burrs on the strip and the like.

FIG. 109 is a diagrammatic side elevation of a coating operation in which structures the same as in FIGS. 104 and 108 are given the same reference numerals and in which the several cells of such operation constitute rotatable electrodes in the form basically of cast rolls 741 journaled in any suitable manner for rotation as the strip 635 passes about them. These rolls 741 are partially submerged in an electrolytic bath, the surface of which is indicated by reference numeral 658. Strip passes over guide and tension rolls 717 and 719 at the ends of the three cells and over guide rolls 721 between the cell or electrode rolls. The rotatable cell or electrode rolls may be either soluble anodes or they may be insoluble anodes. In the case where the anodes are soluble and a sludge tends to form in the particular process from such soluble anodes, the anodes will be encapsulated in small mesh filter bags. On the surface of the roll-type cells 741, there is provided a layer of open-web, plastic mesh material 749 which either completely encircles the rotatable rolls if such rolls are formed of insoluble electrode material, or, as shown in FIG. 109, is instead, if the roll material is soluble in the electrolytic bath, may as shown, instead of being merely wrapped about the roll surface, be preferably passed about the rolls 741 and then about a guide roll 743 at the top which is biased upwardly by a spring arrangement 747 to take up the slack in the plastic mesh as the surface of the dissolving electrode roll becomes effectively smaller. Such open-web mesh material is designated as 749 and serves to basically space the strip 635 from the surface of the rotatable electrode rolls 741. As indicated above, the plastic mesh may be anywhere from approximately one sixteenth of an inch to one quarter of an inch or in the extreme case, one thirty-second of an inch to three eighths of an inch and forms not only a spacer between the strip and the electrode surface preventing arcing between the two, but also by churning the coating bath, serves to wipe the surface of the strip as it passes over such rolls. The most important function, however, is to space the strip from the surface of the rotating electrode a proper amount. It has been found that very rapid plating of the strip may be obtained in this manner.

FIG. 110 is a diagrammatic longitudinal cross section of a top processing arrangement for electro-processing the top of a strip 635 passing through an electrolytic coating bath, not shown. A series of cast waffle pattern perforated electrodes 751 are shown mounted or supported with flexible wiping blades 753 mounted between them in tracks or holders 759. If the electrodes are soluble electrodes, they may be individually wrapped with fine mesh filter material 757 with, of course, provision for contact of the electrodes with a power source. On the lower side of the electrode 751 between the wiping blades 753 and tracks 755 is positioned an open-web, plastic mesh 714 as previously disclosed and described. The flexible wiping blades 753 can be as much as two or three feet apart and serve very effectively to wipe the surface of the strip removing any detrimental bubbles of process gas and wiping away any barrier layer of either chemically or physically depleted electrolyte, i.e. depleted of a chemical or metallic coating element or being of an unsuitable high temperature for effective coating. The flexible plastic wiper blades 753 also serve to stabilize the strip at a suitable distance from the electrodes. At the same time, the open-web, plastic mesh 714 serves as a backup preventing any contact of the strip surface with the electrodes which might cause arcing even if the sidewise undulations of the strip overcome the stabilizing force of flexible wiping blades and also ensuring that the filter sock material 757, where it is used, is not caught upon the passing strip and torn, allowing insoluble contaminants from the soluble electrode to reach the electrolytic bath and possibly marring the surface of the electroplated coated sheet metal. The open-web, plastic mesh 714 also where or if it contacts the strip, wipes the strip, and even where it does not contact the strip, is close enough thereto to serve to cause turbulence in the intervening electrolyte as electrolyte is drawn along with the strip and in this way breaks up the barrier or depletion layer on the strip surface which otherwise would interfere with electrocoating or electroprocessing broadly. This again illustrates that both the flexible wiping blades and the open-web, plastic mesh can be used in the same operation. One is a backup basically for the other and this is particularly desirable in those less efficient plating operations where a large amount of hydrogen or other gas may be given off and tend to interfere with the coating on the surface of the strip, as the positively biased wiper blades do a more effective job of removing hydrogen bubbles, partially depleted electrolyte and the heated electrolyte of an overheated interfacial zone at the surface of the metal strip versus the casual intermittent wiping of the open-web, plastic mesh.

It has been found also that while the open-web plastic mesh does an effective job in both spacing the strip from the electrodes as well as also wiping the surface if actually in contact therewith, or causing turbulence which tends to desirably mix the electrolytic bath if not in contact therewith, the open-web, plastic mesh may also tend to become coated with very fine crystals of a coating metal from the bath. Such fine crystals if allowed to grow may result in scratches upon the product and also tend in themselves to accelerate use of process energy for such undesirable thief crystals rather than the main coating. Such "thieving" of the plastic mesh may be counteracted by periodically brushing the plastic mesh during normal maintenance shutdowns of the line for other purposes. The crystals, particularly when small, are easily brushed off the plastic mesh. Flexible wiping blades do not ordinarily require such maintenance because their continuous flexing serves to keep them clear of any buildup of coating crystals. However, as indicated, the flexible wiping blades are more subject to wear from contact with a passing strip surface.

Reiterating, as to use of the invention for anodizing the present inventors have discovered that their invention of thin resilient or flexible wiping blades originally applied in the production of electrolytic coatings is also effective in the electrochemical processing operation known as anodizing.

In a sense, anodizing, by which a retentive layer of oxygen is applied to the surface of aluminum and some other light metals, (e.g. magnesium alloys) is the reverse or opposite of electroplating, since in anodizing, the workpiece is made the anode in a circuit with cathodic processing electrodes. The electrolyte in anodizing is an acid solution, frequently sulfuric, chromic or sulfamic acid when treating aluminum alloys. When a voltage is applied across the electrodes, oxygen collects at the anodic surface and hydrogen at the cathodic surface, both derived essentially from electrolysis of the water in the solution or electrolyte. The activated or ionic oxygen rapidly oxidizes the surface of the metal forming a relatively pure and adherent oxygen layer which serves both as a corrosion-resistant surface layer and an adherent base for various dyes and sealing materials. The process depends essentially upon a combination of oxidation of the surface of the metal by the oxygen present, plus partial resolution by the acid and reoxidation resulting in a particularly thick and adherent layer of oxide. At the same time, hydrogen collects at the cathodic electrodes. This collection of hydrogen has a detrimental insulating effect upon the cathodes, leading to increased resistance in the circuit and contributing to high resistance of the process requiring a high voltage and current with a resultant very large power requirement. Excess oxygen also collects as gas bubbles at the anodic workpiece tending to block contact of the workpiece surface with ions of oxygen and insulate the surface so that current flow is made non-uniform to certain areas which may cause burns of the surface. In addition, the growing oxide layer is itself an insulating dielectric which, as electrons are driven across its thickness by the voltage applied, rapidly heats to a high temperature so that the anodizing process is interfered with and the anodizing electrolyte adjacent the surface may even boil or vaporize into a pocketed barrier layer essentially further insulating the surface. The present inventors have found that the use of their thin flexible wiping blades previously applied to electrocoating is effective in decreasing the resistance of the anodizing circuit resulting in lower current usage which result in less heat being generated, therefore reducing the cooling requirements and thus improving energy efficiency. In particular, the use of the dielectric wiping blades in the coating or anodizing of continuous strip and the like allows the anodic workpiece and the cathodic electrodes to be more closely spaced with a considerable saving in power required. This is accomplished through the stabilization of the strip material between the electrodes by the dielectric wiper blades. At the same time the wiper blades wipe away from the surface of the anodic work material the heated surface layer of electrolyte allowing it to be replaced with cooler electrolyte, thus alleviating the surface heating problem just as in electroplating the wiper blades remove or displace the depletion layer of electrolyte that tends to be carried along with the workpiece.

In the anodizing of metals, the collection of hydrogen upon the cathodes also tends to insulate the cathodes, decreasing the efficiency of the anodizing operation. In such case, the efficiency can be increased by also using a wiping means passing over the cathodes. Several arrangements for accomplishing this are illustrated. One further effective arrangement is to provide a thin mesh-type wiper, as shown in FIGS. 74, 75, 78, 79 or 80, and draw it against the inner surfaces of the cathodes by an arrangement such as shown in FIG. 76, where, instead of the mesh wiper contacting the surface of the strip 417, as shown in FIG. 76, the mesh wiper contacts the surface of the cathodes 419. In conjunction with such arrangement, separately supported flexible wiper blades may be supplied to wipe the surface of the web material being anodized to remove both oxygen bubbles plus the heated electrolyte layer as well as stabilize the web.

Furthermore, it has now been found that the thin open web, plastic mesh shown in these drawings can also be used as a passive wiping means disposed adjacent a moving strip in which case it both wipes the strip surface and spaces the strip a minimum distance from the electrodes and if not normally touching the surface of the strip causes turbulence in the electrolyte adjacent the strip to disrupt the barrier layer. It has also been found that the open-web, plastic mesh can be very advantageously combined with the flexible wiping blades of the invention.

As will be recognized from the above description and appended drawings, the wiping arrangements of the invention are very effective in both electroplating processes and anodizing processes in removing excess gases from the surface of the workpiece electrodes and continuously replenishing electrolyte adjacent the workpiece as well as preventing accidental contact between cathodic and anodic surfaces during such electroplating or anodizing or in general, any electrochemical reprocessing.

The apparatus shown and described above is particularly useful and effective in the electroplating of chromium coatings on steel strip, frequently called tin free steel, or TFS, and the like, but is also very effective in other types of electroplating including tin plating, thin zinc plating and other electrolytic coatings. In other words, the use of the thin resilient wiping blade to wipe away bubbles of hydrogen, displace hydrogen from the cathodic layer upon the workpiece, remove a thin depletion layer or so-called barrier layer of at least partially depleted electrolytic solution and stabilize the strip as it passes through the electrolytic bath by guiding it with the thin flexible dielectric wiping blade which does not interfere with the electrolytic coating process, has wide application in the continuous electrolytic coating of sheet, strip and other elongated relatively flexible coated products.

As set forth above, it has been discovered that the use of the wiper blades of the invention both in the form of flexible wiping blades and in the form of open-web plastic mesh provide very superior coatings and that their use in a process considerably increases the rate of coating by very effective removal of hydrogen bubbles which will otherwise partially occlude the surface and with some coatings, by shaving off or otherwise removing dendritic material in those cases where such material is a problem. In addition, and very importantly, in many, if not most, cases, the wiping blade also improves the coating operation by stripping away a surface layer of partially depleted electrolytic coating solution and causing new electrolytic solution to be brought down to the coating surface. In order to effectively achieve the renewal of the coating solution next to the coating piece, the wiping blade of the invention should be used in combination with a properly perforated anode through which the electrolytic coating solution can pass. The blade should also be resilient enough to exert a downward force sufficient to prevent the counter force of any thin surface or depletion layer of electrolyte carried along with the workpiece surface from lifting the blade from the coating surface, but not with sufficient downward force to mar the coated surface or interfere with the buildup of a smooth, even coating. The dielectric blade of the invention also very importantly provides a thin contact guide means between the anodes and the cathodic coating surface which effectively prevents the continuous coated material from approaching the anodes or oscillating, and prevents the cathodic work surface from arcing with the anodes which would damage both the work surface and the anodes. The resilient blades, however, are so thin and such a small cross section of them actually touches the surface that the coating action is not interfered with. The resilience or flexibility of the blade also, it has been found, prevents the blades from rapid wear of their surface.

It should be understood that while the present invention has been described at some length, and in considerable detail and with some particularity with regard to several embodiments in connection with the accompanying figures and description, all such description and showing is to be considered illustrative only and the invention is not intended to be narrowly interpreted in connection therewith, or limited to any such particulars or embodiments, but should be interpreted broadly within the scope of the delineation of the invention set forth in the accompanying claims thereby to effectively encompass the intended scope of the invention.

We claim:

1. An improved apparatus arrangement for electrolytic processing of a longitudinally extended metal workpiece comprising:

(a) means to pass a longitudinally extended metallic workpiece having at least one surface to be coated along a pass line through containment means for a body of electrolytic solution bathing such surface to be coated, (b) an electrode mounted closely adjacent the pass line of said metallic workpiece within said containment means in contact with said electrolytic solution, (c) at least one thin substantially solid laterally extended dielectric means substantially bathed by the electrolytic solution and extending adjacent to the electrode generally transversely of said longitudinally extended metallic workpiece to at least periodically contact the surface of the workpiece along a relatively narrow line of contact to simultaneously space the workpiece from the electrode and wipe the surface of the workpiece, (d) means to move the longitudinally extended workpiece along the pass line past the transversely extended dielectric means within the electrolytic solution, and (e) wherein the thin substantially solid laterally extended dielectric means is a portion of an extended unitary open-web, plastic mesh material.

2. An improved apparatus arrangement for electrolytic processing in accordance with claim 1 wherein the electrolytic processing apparatus arrangement is an electroplating apparatus arrangement.

3. An improved apparatus arrangement for electrolyte processing in accordance with claim 1 wherein the electrolytic processing apparatus arrangement is an anodizing apparatus arrangement.

4. An improved arrangement for electrolytic processing in accordance with claim 1 wherein the dielectric means extends from one side of the extended unitary open-web, plastic mesh material.

5. An improved apparatus arrangement for electrochemical processing of metal substrates comprising:

(a) an electrochemical processing bath, (b) means to support a plurality of electrodes of opposite polarity in the electrochemical processing bath, one of said electrodes being a workpiece for treatment which is passed through the electrochemical processing bath, (c) a thin, substantially solid-laterally and longitudinally extended dielectric wiping and spacing means arranged for passage across the surface of at least one of the electrodes to at least partially remove a barrier layer of depleted electrolyte from the surface of such electrode while spacing the workpiece at least a critical distance from the electrode calculated to prevent arcing between the electrode and workpiece, and (d) wherein the dielectric wiping and spacing means is a component of an extended plastic member comprised of a unitary open-web, plastic mesh extending across the workpiece from side to side having a thickness sufficient to prevent arcing between the workpiece and the adjacent electrodes.

6. An improved apparatus arrangement for electrochemical processing in accordance with claim 5 wherein the workpiece is an elongated strip conducted past the electrodes and the dielectric wiping and spacing means is a portion of a laterally and longitudinally extended mesh of intersecting plastic members in the form of a unitary open-web plastic mesh.

7. An improved apparatus arrangement for electrochemical processing in accordance with claim 6 wherein dielectric wiping and spacing means extend from one side of the open-web, plastic mesh.

8. An improved arrangement for electrochemical processing in accordance with claim 7 wherein there are a plurality of dielectric wiping means extending from one side of the open-web, plastic mesh material.

9. An improved apparatus arrangement for electrochemical processing in accordance with claim 8 wherein the dielectric wiping and spacing means are arranged to actively pass over the surface of the elongated strip.

10. A method of electrochemical processing a continuous metal strip section comprising:

(a) passing a charged continuous metal strip section through an electrochemical processing bath having a dielectric breakdown potential adjacent an oppositely charged electrode with respect to which the metal strip moves while applying electrical energy to said strip as a portion of an electrical circuit between said strip and the adjacent electrode, (b) maintaining a dielectric separation element extending generally transversely across the strip between the electrode and strip and in at least periodic contact with the strip to space the strip from the electrode a minimum sufficient distance to prevent arcing between the strip and electrode, at least at some power levels, and restricting the power applied to the circuit to less than sufficient to exceed the dielectric breakdown potential of the electrolyte for the minimum distance to be maintained between the strip and the electrode, and (c) wherein the dielectric separator element with respect to which the strip is passed is a unitary transversely extended open-web, plastic mesh dielectric section maintained generally parallel to and covering the strip surface.

11. A method of electrochemical processing in accordance with claim 10 wherein the dielectric separator element with respect to which the strip is passed is a combination of flexible wiping blades continuously maintained against the strip and transversely extended open-web, plastic mesh dielectric sections disposed between the flexible wiping blades.

12. A strip positioning and wiping means for an electrochemical processing operation on strip material comprising:

(a) a thin unitary laterally extended open-web, plastic mesh adapted for positioning between a moving metal strip and an adjacent electrode in an electrocoating bath, (b) said plastic mesh having a thickness of from one thirty-second to three eights of an inch and having a ratio of open-mesh area to plastic web area of from 1 to 1 to 20 to 1, (c) said thin unitary laterally extended open-web, plastic mesh being mounted between a strip and an electrode in an electrochemical processing line in at least periodic contact with the strip to provide a minimum spacing between the strip and the electrode of from one thirty-second of an inch to three eights of an inch.

13. A strip positioning and wiping means for an electrochemical processing operation in accordance with claim 12 wherein the thickness of the unitary, laterally extended open-web plastic mesh is from one sixteenth to one quarter inch to provide a minimum spacing between the strip and the electrode of between one-sixteenth and one-quarter inch.

14. A strip positioning and wiping means for an electrochemical processing operation in accordance with claim 13 wherein the unitary laterally extended open-web, plastic mesh is dynamically disposed adjacent the strip and dynamically movable with respect to the moving strip.

15. A strip positioning and wiping means for an electrochemical processing operation in accordance with claim 13 wherein the unitary laterally extended open-web, plastic mesh is statically disposed adjacent the strip and the strip moves past the electrode.

16. A strip positioning and wiping means for an electrochemical processing operation in accordance with claim 15 wherein statically disposed unitary laterally extended the open-web, plastic mesh overlies and shields from damage a cloth filter fabric between the electrode and the moving strip.

17. A strip positioning and wiping means in accordance with claim 15 wherein the unitary laterally extended open-web, plastic mesh is positioned longitudinally between laterally extended flexible wiping blades which extend past the open-web plastic mesh toward and continuously contact the surface of the strip at intervals longitudinally along the strip.

18. A wiping arrangement for use in an electrolytic processing bath to contact and position a strip passing through such electrolytic coating bath comprising:

(a) an electrolytic coating bath, (b) means to pass an extended strip longitudinally along a pass line through the coating bath, (c) an open-web plastic mesh wiping means positioned on at least one side of the pass line of the strip through the bath, said open-web plastic mesh having individual web thicknesses between the openings in the open-web plastic mesh less than the thickness of the open-web plastic mesh as a whole in its narrowest dimension, the positioning of the open-web plastic mesh being sufficiently close to the strip pass line to at least periodically contact the strip as its passline oscillates from side to side and prevent it from contacting electrodes adjacent to the passline of the strip as well as wiping the surface of the strip.

19. A wiping arrangement in accordance with claim 18 wherein the open-web plastic mesh is arranged to continuously contact the side of the strip to continuously wipe the strip surface.

20. A wiping arrangement in accordance with claim 19 wherein there is a honeycomb section wiper on both sides of the strip and at least one of such wipers is mounted such that it may move away from the other to accommodate camber and other possible defects in the strip as the strip passes between the two.

21. A wiping arrangement in accordance with claim 18 wherein the open-web plastic mesh is in the form of a honeycomb section to wipe the strip surface and is sufficiently extended along the length of the strip so that the side of the strip on the average is wiped by contact with the honeycomb section on every portion during one pass along the honeycomb section to remove gas bubbles and depleted electrolytic solution from the strip surface.

22. A wiping arrangement in accordance with claim 21 wherein there is a honeycomb section on both sides of the strip to at least periodically wipe both sides of the strip.

23. A wiping arrangement in accordance with claim 18 wherein the open-web, plastic mesh is in the form of a thin, at least partially flexible open-web, plastic mesh having a thickness adapted to provide a minimum spacing between the strip surface and adjacent electrodes.

24. A wiping arrangement in accordance with claim 23 wherein the open-web, plastic mesh is arranged to continuously contact the surface of the strip.

25. A wiping arrangement in accordance with claim 23 wherein the open-web, plastic mesh is arranged to only intermittently contact the surface of the strip.

26. A wiping arrangement in accordance with claim 25 additionally comprising:

(d) flexible wiping blade wipers arranged to continuously contact the strip and spaced periodically along the extent of the open-web, plastic mesh longitudinally along the strip.

27. An improved electrolytic processing line comprising:

(a) containment means for an electrolytic processing bath, (b) means to pass a continuous strip along a pass line through said processing bath, (c) electrode means disposed adjacent the pass line of the strip in the electrolytic processing bath, (d) a plurality of transversely extended resilient wiping blades disposed along the strip pass line in a position to resiliently contact the strip adjacent to the electrodes, (e) open-web, plastic mesh spacers positioned along the strip passline between the flexible wipers and adjacent to the electrode surface, the thickness of the open-web, plastic mesh determining a minimum distance between the surface of the anodes and the strip surface.

28. An improved electrolytic processing line in accordance with claim 27 wherein the plurality of transversely extended resilient wiping blades are flexible wiping blades with their edges flexed against the strip adjacent the electrodes.

29. An improved electrolytic coating arrangement comprising:

(a) a containment means for an electrolytic coating bath, (b) at least one soluble electrode positioned in the electrolytic coating bath, (c) a strip arranged to pass closely by the soluble electrode, (d) a filter cloth material effectively enveloping the soluble electrode to prevent discharge of insoluble contaminants into the electrolytic bath, (e) an open-web, plastic mesh disposed between the surface of the strip and the surface of electrode and over the filter cloth material to shield such filter material from possible rupture or other damage as a result of catching on inequalities on the strip surface.

30. An improved electrolytic coating arrangement in accordance with claim 29 wherein the thickness of the open-web plastic mesh also determines the minimum approach distance of the strip to the electrodes sufficient to prevent arcing between the strip and the electrode.

31. An improved electrolytic processing arrangement comprising:

(a) containment means for an electrolytic coating bath, (b) electrode support means for electrodes in said electrolytic coating bath, (c) guide means for passing a continuous strip through said coating bath adjacent the electrode support means, (d) support means for strip surface wiping means disposed adjacent the electrodes, (e) said support means for strip surface wiping means being pivotable to remove the wiping means in an arcuate path from the electrolytic bath under the strip without adjusting the pass line position of the strip, (f) the support means for the electrodes and support means for the strip surface wiper means being substantially the same means and both the electrodes and associated wiper means being can be pivotable out from under the strip for maintenance/replacement without disturbing the position and passline of the strip, and (g) wherein the strip surface wiper means comprises an open-web, plastic mesh disposed on top of the electrodes.

32. An improved electrolytic processing line in accordance with claim 31 wherein the electrodes and open-web, plastic mesh are unitized as a combined electrode and wiping means secured to a single pivotable support arm and a series of such unitized support arm, electrode, wiper combinations are disposed in serial order along the strip to facilitate periodic individual removal and replacement without lengthy shutdown.

33. An improved electrolytic processing line in accordance with claim 31 wherein the wiper means supported by the support means is a transversely disposed flexible wiping blade adapted for flexing at one edge against the strip.

34. An improved electrolytic processing arrangement comprising:

(a) a containment means for an electrolytic processing bath, (b) at least one electrode in the processing bath, (c) means for passing a continuous elongated strip through said processing bath, (d) dielectric contact means extending transversely across the strip surface in contact therewith and adapted by interposition between the strip and the electrode as well as contact with the strip to:

(i) maintain a minimum separation between the strip and the electrode;

(ii) remove a substantial proportion of any excessively heated barrier layer that may be carried along with the strip.

35. An improved electrolytic processing arrangement in accordance with claim 34 wherein a substantial portion of any gas bubbles generated during electrolytic processing plus a substantial portion of any chemically depleted barrier layer are wiped from the surface of the strip by the dielectric contact means.

36. An improved electrolytic processing arrangement in accordance with claim 35 wherein the dielectric contact means extending transversely across and in contact with the strip surface comprises a narrow flexible wiping blade with one edge deflected against the surface of the strip.

37. An improved electrolytic processing arrangement in accordance with claim 35 wherein the dielectric contact means extending transversely across and in contact with the strip surface comprises an open-web, plastic mesh wiping means.

38. An improved electrolytic processing arrangement in accordance with claim 37 wherein the dielectric contact means in the form of an open-web, plastic mesh overlies a filter cloth material disposed over the surface of the electrode and such plastic mesh has a mesh size and thickness effective to prevent any portion of such filter cloth from protruding through the openings of said plastic mesh sufficiently to contact any portion of the strip.

39. An improved electrolytic processing arrangement in accordance with claim 37 wherein the dielectric contact means includes narrow wiping blades which are components of the open-web, plastic mesh wiping means.

40. An improved electrolytic processing arrangement in accordance with claim 39 wherein the narrow wiping blades depend from one side of the open-web, plastic mesh wiping means.

41. An improved arrangement for electrochemical processing comprising:

(a) a containment means for an electrochemical processing bath, (b) means for passing continuous strip through said processing bath, (c) a rotatable electrode having a substantially cylindrical surface configuration about at least a portion of which the continuous strip is passed, (d) a dielectric spacer grid upon the surface of the cylindrical surface of the rotatable electrode having a thickness sufficient to prevent arcing between the strip surface and the surface of the electrode, (e) said dielectric spacer grid being comprised of a unitary open-web, plastic mesh upon the surface of the rotatable electrode.

42. An improved arrangement for electrochemical processing in accordance with claim 41 additionally comprising a guide roll adjacent the rotatable electrode around which the unitary open-web, plastic mesh passes before passing back to the rotatable electrode.

43. An improved arrangement for electrochemical processing in accordance with claim 41 wherein the rotatable electrode is segmented into separate sections with cooperating arcuate surfaces which sections are individually replaceable.

44. An improved arrangement for electrochemical processing in accordance with claim 43 wherein the segments of the rotatable electrode are formed in part of soluble electrode material and the individual segments are encased in filter cloth over the arcuate sections of which the open-web, plastic mesh is disposed.

45. An improved arrangement for electrochemical processing in accordance with claim 44 in which the electrode material is contained in corrosion resistant baskets forming at least a portion of the segments additionally comprising:

(e) outwardly moveable shoes in each segment to urge the electrode material toward the outer perimeter of the basket, (f) biasing means attached to the outwardly movable shoes to move such shoes outwardly.

46. An improved arrangement for electrochemical processing in accordance with claim 45 wherein the biasing means are compressible resilient means.

47. An improved arrangement for electrochemical processing in accordance with claim 46 wherein the compressible resilient means comprise resilient springs.

48. An apparatus for electrochemical processing of metal strip material comprising:

(a) a containment means for electrolytic solution arranged to expose at least one side of a metal strip to said solution, (b) an electrode exposed to said electrolytic solution, (c) means to pass metallic strip close to the electrode in contact with the electrolytic solution, (d) means to position a unitary generally planar open-web, plastic mesh parallel to and between the metallic strip and the electrode to space the strip from the electrode, said open-web, plastic mesh being at least periodically in content with said strip.

49. An apparatus for electroprocessing of metal strip material in accordance with claim 48 wherein the open-web, plastic mesh comprises a single layer of plastic material.

50. An apparatus for electroprocessing of metal strip material in accordance with claim 49 wherein the unitary planar generally planar open-web, plastic mesh is between one thirty-second and three-eighth inches in thickness to establish a minimum distance of such dimensions between the strip and the electrode.

51. An apparatus for electroprocessing of metal strip material in accordance with claim 50 wherein the unitary, generally planar open-web, plastic mesh has a thickness between one-sixteenth and one-quarter inch.

52. An apparatus for electroprocessing of metal strip material in accordance with claim 51 wherein the thickness of the web material between the openings in the open-web, plastic mesh is less than the thickness of the plastic mesh at least in a transverse direction forming integral wiping blades extending transversely of the strip.

53. An apparatus for electroprocessing of metal strip in accordance with claim 52 wherein there are generally transverse flexible wiping blades extending downwardly from one surface of the open-web plastic mesh in contact with the strip.

54. An apparatus for electroprocessing of metal strip material in accordance with claim 52 wherein the strip and open-web, plastic mesh are maintained in substantially continuous contact.

55. An apparatus for electroprocessing of metal strip material in accordance with claim 54 wherein the open-web, plastic mesh is oriented in the apparatus parallel to the plane of the strip.

56. An apparatus for electroprocessing of metal strip in accordance with claim 54 wherein the open-web, plastic mesh is moved in a plane parallel to the strip with respect to the apparatus as well as relative to the strip.

57. An apparatus for electroprocessing of metal strip in accordance with claim 54 wherein the open-web, plastic mesh has a large plurality of openings with from 50 to 95 percent of the open-web, plastic mesh constituting such openings.

58. An apparatus for electroprocessing of metal strip in accordance with claim 57 wherein from 75 to 95 percent of the open-web, plastic mesh constitutes such openings.

59. An apparatus for electroprocessing of metal strip in accordance with claim 58 wherein the individual openings are small enough to prevent any filter net on one side of such openings from protruding through.

60. A method of electrochemical processing a continuous metal strip section comprising:

(a) passing a charged continuous metal strip section through an electrochemical processing bath having a dielectric breakdown potential adjacent an oppositely charged electrode with respect to which the metal strip moves while applying electrical energy to said strip as a portion of an electrical circuit between said strip and the adjacent electrode, (b) maintaining a dielectric separation element extending generally transversely across the strip between the electrode and strip and in at least periodic contact with the strip to space the strip from the electrode a minimum sufficient distance to prevent arcing between the strip and electrode, and restricting the power applied to the circuit to less than sufficient to exceed the dielectric breakdown potential of the electrolyte for the minimum distance to be maintained between the strip and the electrode, and wherein the dielectric separator element with respect to which the strip is passed is a combination of flexible wiping blades continuously maintained against the strip and transversely extended open-web, plastic mesh dielectric sections disposed between the flexible wiping blades.

61. An improved electrolytic processing arrangement comprising:

(a) containment means for an electrolytic coating bath, (b) electrode support means for electrodes in said electrolytic coating bath, (c) guide means for passing a continuous strip through said coating bath adjacent the electrode support means, (d) support means for strip surface wiping means disposed adjacent the electrodes, (e) said support means for strip surface wiping means being pivotable to remove the wiping means in an arcuate path from the electrolytic bath under the strip without adjusting the pass line position of the strip, and (h) wherein the wiper means supported by the support means is a transversely disposed flexible wiping blade adapted for flexing at one edge against the strip.

* * * * *